US008272560B2

(12) United States Patent
Quaintance

(10) Patent No.: US 8,272,560 B2
(45) Date of Patent: Sep. 25, 2012

(54) CONTAINER WITH TRIANGULATED CORNERS

(75) Inventor: Benjamin William Quaintance, Germantown, TN (US)

(73) Assignee: International Paper Company, Memphis, TN (US)

( * ) Notice: Subject to any disclaimer, the term of this patent is extended or adjusted under 35 U.S.C. 154(b) by 534 days.

(21) Appl. No.: 12/553,686

(22) Filed: Sep. 3, 2009

(65) Prior Publication Data

US 2010/0065621 A1 Mar. 18, 2010

Related U.S. Application Data

(60) Provisional application No. 61/190,840, filed on Sep. 3, 2008.

(51) Int. Cl.
*B65D 5/28* (2006.01)
*B65D 5/32* (2006.01)

(52) U.S. Cl. ..... 229/122.26; 229/109; 229/191

(58) Field of Classification Search ..... 229/109, 229/122.26, 191, 192, 199, 915, 918, 919
See application file for complete search history.

(56) References Cited

U.S. PATENT DOCUMENTS

| | | | | |
|---|---|---|---|---|
| 1,974,527 | A | 9/1934 | Bliss | |
| 2,147,563 | A * | 2/1939 | Turner | 229/109 |
| 2,522,597 | A * | 9/1950 | Blandford | 229/192 |
| 3,184,139 | A | 5/1965 | Conescu | |
| 3,841,476 | A | 10/1974 | Elford | |
| 3,921,893 | A | 11/1975 | Randle, Jr. | |
| 4,417,686 | A | 11/1983 | Wozniacki | |
| 4,792,084 | A * | 12/1988 | Dreeszen | 229/109 |
| 4,828,929 | A * | 5/1989 | Pierson | 229/109 |
| 5,263,634 | A | 11/1993 | Korine | |
| 5,294,044 | A * | 3/1994 | Clark | 229/191 |
| 5,395,043 | A * | 3/1995 | Bacques et al. | 229/109 |
| 5,458,283 | A | 10/1995 | Southwell et al. | |
| 5,507,390 | A | 4/1996 | Vila | |
| 5,560,539 | A * | 10/1996 | Baxter | 229/109 |
| 5,562,227 | A | 10/1996 | Takezawa et al. | |
| 5,673,848 | A | 10/1997 | Garza | |
| 5,752,648 | A | 5/1998 | Quaintance | |
| 5,860,590 | A | 1/1999 | Blomfield et al. | |
| 5,996,885 | A | 12/1999 | Chu | |

(Continued)

FOREIGN PATENT DOCUMENTS

ES 2103177 A2 8/1997

(Continued)

*Primary Examiner* — Gary Elkins
(74) *Attorney, Agent, or Firm* — Matthew M. Eslami

(57) ABSTRACT

A multi-sided container comprises a bottom wall, opposite side walls, opposite end walls, a longitudinal axis, and a transverse axis. The multi-sided container also comprises diagonal corners connecting adjacent ends of the side walls and the end walls. The diagonal corners each comprising an inner diagonal corner panel and an outer diagonal corner panel. One of the inner and outer diagonal corner panels extends at an angle of less than 45° with respect to an adjacent end wall, and the other of said inner and outer diagonal corner panels extends at an angle of less than 45° with respect to an adjacent side wall. One of the inner and outer diagonal corner panels has a major thrust vector in a direction parallel to the transverse axis of the container and said other of said inner and outer diagonal corner panels has a major thrust vector in a direction parallel to the longitudinal axis of the container. The inner and outer diagonal corner panels provide resistance to both lateral and longitudinal deflection of the container.

16 Claims, 48 Drawing Sheets

U.S. PATENT DOCUMENTS

| | | | | |
|---|---|---|---|---|
| 6,186,393 | B1 | 2/2001 | Tsamourgelis | |
| 6,196,393 | B1 * | 3/2001 | Kruk et al. | 53/492 |
| 6,309,335 | B1 | 10/2001 | Holton | |
| 6,394,742 | B1 | 5/2002 | Buscema | |
| 6,471,124 | B1 | 10/2002 | Tedeschi, Jr. | |
| 6,598,785 | B2 | 7/2003 | Quaintance | |
| 6,719,191 | B1 | 4/2004 | Christensen et al. | |
| 6,749,107 | B2 | 6/2004 | Quaintance | |
| 6,868,968 | B1 * | 3/2005 | Casanovas | 206/509 |
| 7,290,696 | B2 | 11/2007 | McClure | |
| 2008/0237320 | A1 * | 10/2008 | Philips | 229/109 |
| 2009/0277952 | A1 * | 11/2009 | Smith | 229/109 |
| 2010/0219232 | A1 * | 9/2010 | Smith | 229/199 |

FOREIGN PATENT DOCUMENTS

| | | | | |
|---|---|---|---|---|
| ES | 2137822 | A1 | 12/1999 | |
| FR | 2602495 | A1 * | 2/1988 | 229/109 |

* cited by examiner

CONTAINER WITH TRIANGULATED CORNERS

RELATED PATENT APPLICATION

This is a non-provisional application which claims priority from U.S. Provisional Patent Application Ser. No. 61/190,840 filed on Sep. 3, 2008.

FIELD OF THE INVENTION

This invention relates generally to multi-sided container and in particular to a tray and tray-bliss style shipping container having triangulated corners.

BACKGROUND OF THE INVENTION

Fresh poultry is commonly packaged in sealed plastic bags and placed in open top corrugated coated trays, with dry ice commonly placed on top of the bag to aid cooling, and covered for shipment. Fresh poultry processing plants are wet in the packing and coolers areas. The traditional package barrier coating has been wax curtain coating. The common body and cover package style easily fits into the manufacturing limitations of a corrugated box plant's die cutting and wax curtain coating process.

Over the years, wax alternative coatings have become quite common since the box manufacturing process is no longer limited by the wax curtain coating process and the package style alternatives have been broadened. In recent years, users have begun shipping the same product in a machine erected corner post bliss container with integral top flaps. Although this container performed satisfactory, but it has four places on the top edge and four places on the bottom corners that have corrugated flute tip edges exposed to the processing plant free wetness. The barrier coating applied to the container exterior does not cover these open flute tips. Top flap closure panels are also limited in size by this generic container style.

A conventional four sided internal flange bliss container generates good stacking performance with an efficient use of materials. The bliss wrap provides the top, bottom and sides for containment with relatively light weight materials. The heavier weight, flanged end panels are laminated to the side walls and secured to the wrap bottom and side edges to complete the container containment and generate significant container stacking compression strength from the four two ply corners.

The corner post bliss is an improvement over the conventional four sided bliss. The corner post bliss has end panels with extra vertical scores to create diagonal corners between the end and side walls. The wrap has extended glue flanges that stretch over the corner void and secured to the main panel of the end creating a corner post. The exterior of the container remains rectangular. The inside is eight sided. The finished package generates more compression strength with twelve single ply corners. The wrap blank size is larger than the four sided bliss wrap. The external outside corners have exposed flutes on the top and bottom edges.

Some Bliss-style containers have modified corners wherein a diagonal corner panel extends across each corner to increase the stacking strength, but in these conventional modified corner Bliss-style containers there is nothing behind the angled panel except the edge of the wrapper and the wrapper flange that is secured to the end panel. Moreover, these modified corner design of the flanges on the wrapper must be relatively wide to reach past where the diagonal corner panel joins the end panel. This results in weak areas in the bottom of the container at each corner.

Accordingly, there is need to for a container that has superior stacking strength and resistance to distortion when transverse forces are applied to the ends or sides of the container.

SUMMARY OF THE INVENTION

The shipping container of the present invention has features of both Corner Post Bliss and the eight sided tray bliss containers, but has advantages possessed by neither of them. The eight sided tray bliss containers utilize modified diagonal corners on both the end walls and the wrap. When the container is assembled, the outer wrap and ends walls are laminated into a continuous two ply corner that wraps from the container side on to its ends. The container is more rigid than an eight sided tray and has more top to bottom compression strength than the corner post bliss, when made from the same materials. The container blank sizes are the same as the same size corner post bliss.

The present invention tray bliss containers have the following benefits and characteristics:

1. Compact and closed container exterior corners. The eight sided tray style wrap utilizes compact corners to form a tray with exterior closed corners, leaving minimal vertical stacking flutes exposed to the outside environment. Poultry & meat processing plants are damp with wet conveyor and palletizing surfaces. Shielding the structural portions of a package from these wet conditions greatly improves the container's field performance.

2. Improved eight sided container resistance to end to end and side to side shape distortion. Each container corner is constructed from four angular folds. These four angular folds form opposing dual triangulated corners. Each of these triangulated corners is less than 45 degrees to their attached side or end wall. The "outside diagonal corners" of the tray wrap form approximately 30 degree angles to direct their largest thrust vectors in the side to side direction. The "inside diagonal corners" of the ends form approximately 35 degree angles to direct their largest thrust vectors in the end to end direction. These opposing thrust vectors greatly improve the container's side to side and end to end resistance to horizontal distortion.

3. The tray bliss wrap "outside bottom end sealing flap" crosses the container full width. This full width panel adds to the container bottom end beam strength. This full width panel also provides a large end panel labeling surface. For example, almost all poultry and meat containers are labeled on the container ends.

4. The tray bliss wrap "outside bottom end sealing flap" "insert panel" flexes inward to adhere to the tray bliss end between the two "vertical outside end walls". The small space below the "insert panel" and above the bottom score line remains uncrushed to improve the panel's beam strength.

5. The interior of the container has four strongly modified diagonal corners (about 35° degrees to the side wall) with attached "inside vertical side wall" panels that glue to the tray bliss wrap "outside side walls". The strongly modified diagonal corners move the attached end "inside vertical side walls" inward towards the container mid section. This places the two ply lamination area of the container sides in the weakest portion of the container, the mid section of the sides. This added structure in this weakest portion of the container, improves the overall container stacking strength and field performance. The modified diagonal corners (less than 45° degrees) are also lengthened. The longer diagonal also improves the top to bottom compression strength.

6. The opposing dual triangulated corners form a structural honeycomb in each of the container's four outer quadrants (16 corners per container). This array of folds and panels in each corner of the container provides a relatively broad and stable container stacking platform even when the container stacks are misaligned.

7. The compression strength of the tray bliss container appears to be very close to the performance of the eight sided tray bliss container, but with better container appearance, improved container wetness shielding and increased overall container rigidity.

8. The tray bliss container configuration allows the package containment, top, bottom and side panels (wrap) to be made from lighter material than the end closure panels (the ends).

9. A slotted tray style container with similar dual triangulated corners can also be formed from a single sheet of container material.

10. The tray bliss and the slotted tray containers may optionally have or may not have integrated top flaps.

Accordingly, a multi-sided container comprises a bottom wall, at least one top wall, opposite side walls, opposite end walls, a longitudinal axis, a transverse axis and a plurality of dual triangulated diagonal corner walls cooperate with one another to form an interior space. At least one of the plurality of dual triangulated diagonal corner walls is defined by two gusset panels or diagonal corner walls foldably joined to two partial sidewall panels and end wall to form four corners within each corner of the container. The partial side walls and the end walls are joined by the gusset panels or diagonal corner panels. Each of the plurality of the dual triangulated diagonal corner walls comprises an inner diagonal corner panel and an outer diagonal corner panel. One of the inner and outer diagonal corner panels extends at an angle of less than 45° with respect to an adjacent end wall and the other of said inner and outer diagonal corner panels extends at an angle of less than 45° with respect to an adjacent side wall. One of the inner and outer diagonal corner panels has a major thrust vector in a direction parallel to the transverse axis of the container and said other of said inner and outer diagonal corner panels has a major thrust vector in a direction parallel to the longitudinal axis of the container. The inner and outer diagonal corner panels provide resistance to both lateral and longitudinal deflection of the container.

Another aspect of the present invention relates to a blank for making a multi-sided container comprises a bottom wall, at least one top wall, opposite side walls, opposite end walls, a longitudinal axis, a transverse axis and a plurality of dual triangulated diagonal corner walls. The blank comprises a unitary piece of generally rectangularly shaped material having a plurality of first, approximately parallel, spaced apart fold lines delimiting a bottom wall panel, side wall panels, and top wall panels. A plurality of approximately parallel spaced apart second fold lines extend perpendicular to the first fold lines and defining a transversal edge of the bottom panel, side wall panels, and top wall panels, a plurality of reinforcement flaps and end flaps joined to the opposite transversal edges of the side wall panels, two flaps each of which being joined to the opposite transversal edges of the bottom wall panel and respective top wall panels. A pair of end pieces each of which formed to be attached to the respective transversal edges of the bottom wall panel, side wall panels, and top wall panels. Each of the end pieces comprises a plurality of third, parallel, spaced apart fold lines delimiting end wall panels, dual triangulated diagonal corner panels, and partial side wall panels. The dual triangulated diagonal corner panels are defined by inner and outer diagonal corner panels having different widths. The width of inner diagonal corner panel is larger than the width of the outer diagonal corner panel. The partial side wall panels have different width.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAIL DESCRIPTION OF THE INVENTION

Figure 1:
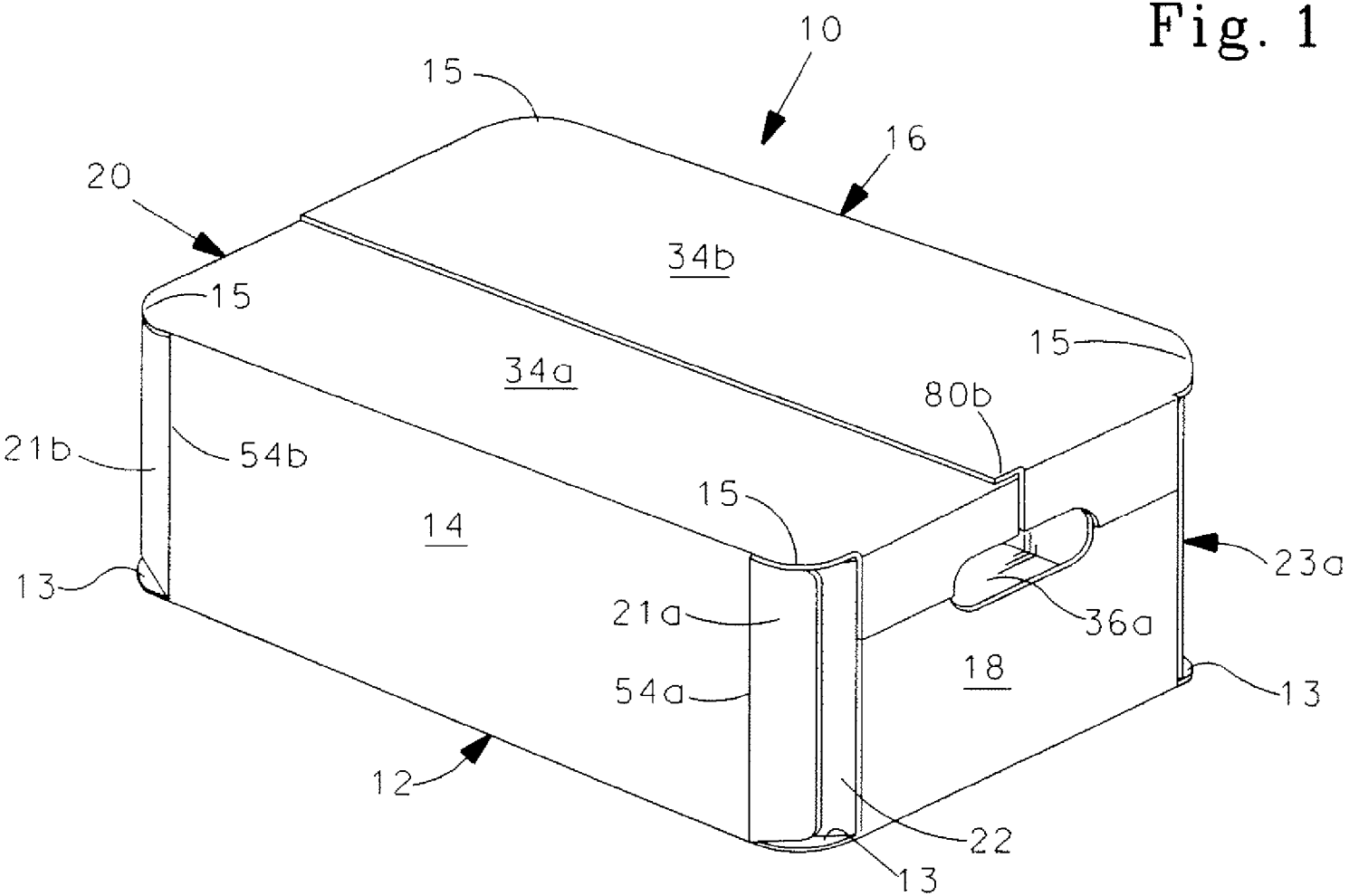
FIG. 1 is a top perspective view of a multi-sided container in accordance with a first embodiment of the invention.
Figure 2:
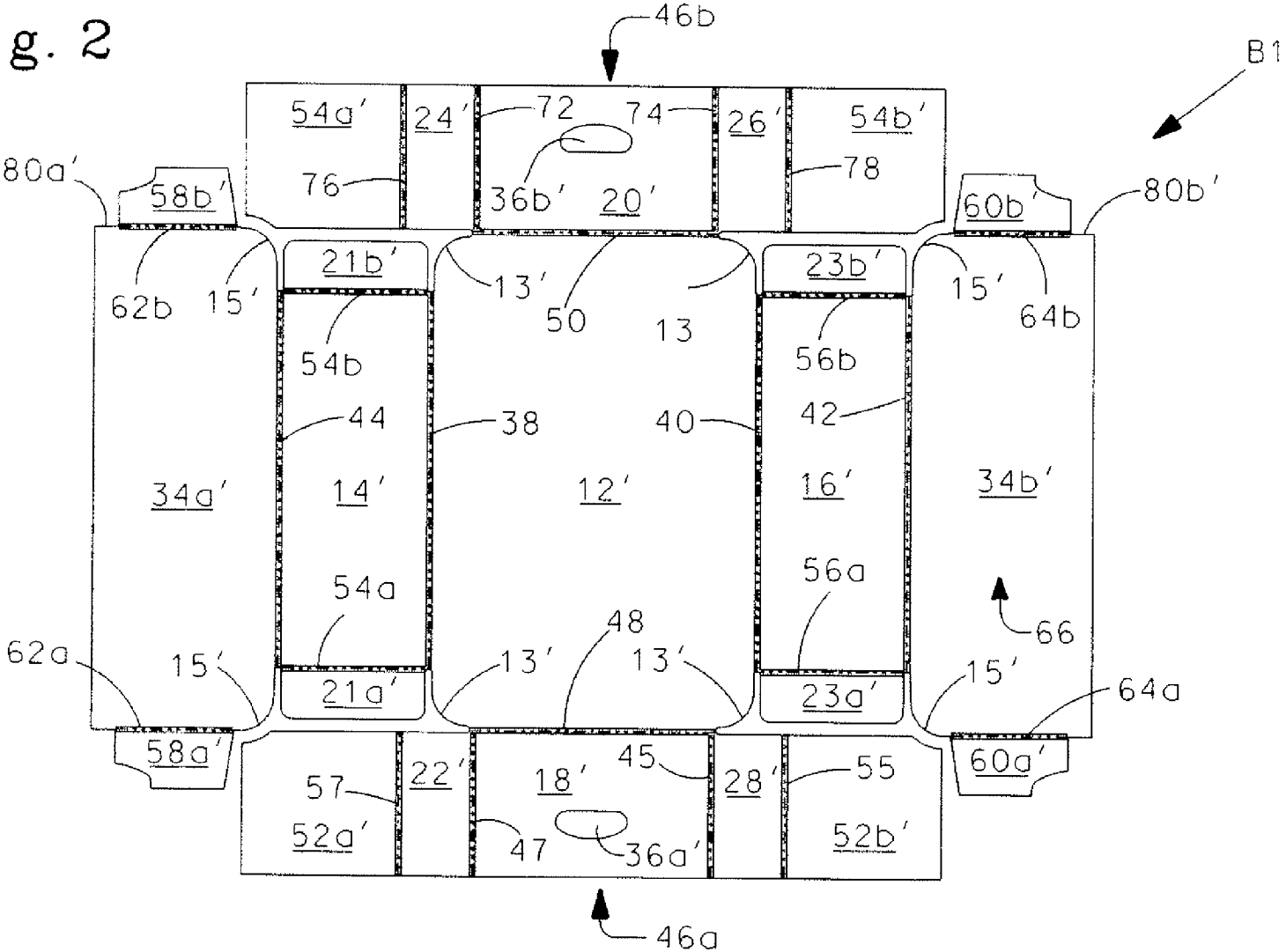
FIG. 2 is a plan view of a unitary blank B1 used to form the multi-sided container shown in FIG. 1 in accordance with a first embodiment of the invention.

FIG. 1 is a top perspective view of a container 10 in accordance with a first embodiment of the invention. The container 10 comprises a bottom wall 12, opposite parallel side walls 14, 16, opposite parallel end walls 18, 20 and diagonal corner panels 22, 24, 26 and 28 (FIG. 3) connecting the respective side walls 14, 16 and respective end walls 18, 20 at adjacent ends. The bottom 12 has an advantage of having four identical rounded corners 13 which enhances the integrity of the container 10 as will be described in greater detail hereinafter. The diagonal corner walls or gusset walls 22, 24, 26 and 28 extend at an angle generally ranges from about 33 to 38 degrees with respect to the longitudinal axis of the container 10. As one of ordinary skill in the art would appreciate, it is within the scope of the present invention to use other angles such as 45° to meet the requirement of the intended design of the container 10. Each of the side walls 14, 16 includes a respective pair of reinforcement flaps 21*a*, 21*b* and 23*a*, 23*b* that are defined by respective fold lines 54*a*, 54*b*, 56*a*', 56*b*' (FIG. 2). The opposite width of the respective side walls 14 and 16 is such that the reinforcement flaps 21*a*, 21*b* and 23*a*, 23*b* project at their opposite side edges over the diagonal corner walls 22, 24, 26 and 28, terminating the flaps at their edges proximately in the middle of the respective diagonal corner walls 22, 24, 26 and 28. Alternatively, the flaps 21*a*, 21*b* and 23*a*, 23*b* may project at their opposite side edges beyond the width of the diagonal corner walls 22, 24, 26 and 28, terminating the flaps at their edges on the end walls 78 and 80. Two top wall panels 34*a*, 34*b* generally defined a top wall that encloses the container 10. The top wall panel 34*a* is integrally attached to the side wall 14 and the top wall panel 34*b* is integrally attached to the side wall 16, but one of ordinary skill in the art would appreciate that it is within the scope of the present invention to use a single cover integrally attached to one of the side walls or end walls of the container. Alternatively, the top wall panels 34*a*, 34*b* may detachably cover the container 10. Two hand hole openings 36*a*, 36*b* (FIG. 3) are formed on the respective end walls 18, 20 to facilitate handling of the container 10.

FIG. 2 is a plan view of a unitary blank B1 used to form the container 10 shown in FIG. 1 in accordance with a first embodiment of the invention. The blank B1 comprises a centrally located rectangular panel 12' that forms the bottom wall 12. The rectangular panel 12' has an advantage of having four identical rounded corners 13' which enhances the integrity of the container 10 when the blank B1 is formed into container 10. Side wall forming panels 14' and 16' are foldably joined to opposite side edges of the panel 12' by respective fold lines 38, 40. Each of the side wall panels 14', 16' includes two respective identical reinforcement flaps 21*a*', 21*b*' and 23*a*', 23*b*' defined by respective fold lines 54*a*', 54*b*', and 56*a*', 56*b*'. Top wall panels 34*a*' and 34*b*' are foldably joined to respective longitudinal edges of the sidewall panels 14' and 16', opposite of their folded connection to the panel 12', by fold lines 42, 44. Each of the top wall panels 34*a*', 34*b*' includes two respective identical flaps 58*a*', 58*b*' and 60*a*', 60*b*' defined by respective fold lines 62*a*, 62*b*, and 64*a*', 64*b*'. An Arrow mark 66 indicates the direction of corrugation of the blank B1. Similarly, each of the top wall panels 34*a*', 34*b*', as noted with respect to the rectangular panel 12', has an advantage of having two identical rounded corners 15' which enhances the integrity of the container 10 when the blank B1 is formed into container 10. In addition, it should be noted that flaps 58*a*', 58*b*' and 60*a*', 60*b*' do not extend the full width of the top wall panels 34*a*', 34*b*', but terminate short of the outer free edge thereof, defining projecting tabs 80*a*' and 80*b*'. A pair of end pieces 46*a*, 46*b* is foldably joined to respective transverse edges of the panel 12' by fold lines 48, 50. The end pieces 46*a*, 46*b* are essentially identical to one another and they are mirror images of one another. The end piece 46*a* includes an end wall panel 18', two relatively reinforcing corner panels 22' and 28' foldably joined to opposite ends of the panel 18' by fold lines 45', 47', and second partial sidewall panels 52*a*', 52*b*' are foldably joined to outer edges of respective narrow reinforcing corner panels 22', 28', opposite of their folded connection to the panel 18', by fold lines 55' and 57'. Similarly, The end piece 46*b* includes an end wall panel 20', two relatively reinforcing corner panels 24' and 26' foldably joined to opposite ends of the panel 20' by fold lines 72', 74', and second partial sidewall panels 54*a*', 54*b*' are foldably joined to outer edges of respective corner panels 24', 26', opposite of their folded connection to the panel 20', by fold lines 76' and 78'. Openings 36*a*', 36*b*' are formed on the respective end wall panels 18', 20' so that when the blank B1 is folded, these openings 36*a*', 36*b*' forms the hand hole openings 36*a*, 36*b* in the container 10 as described with reference to FIG. 1.

Figure 3:
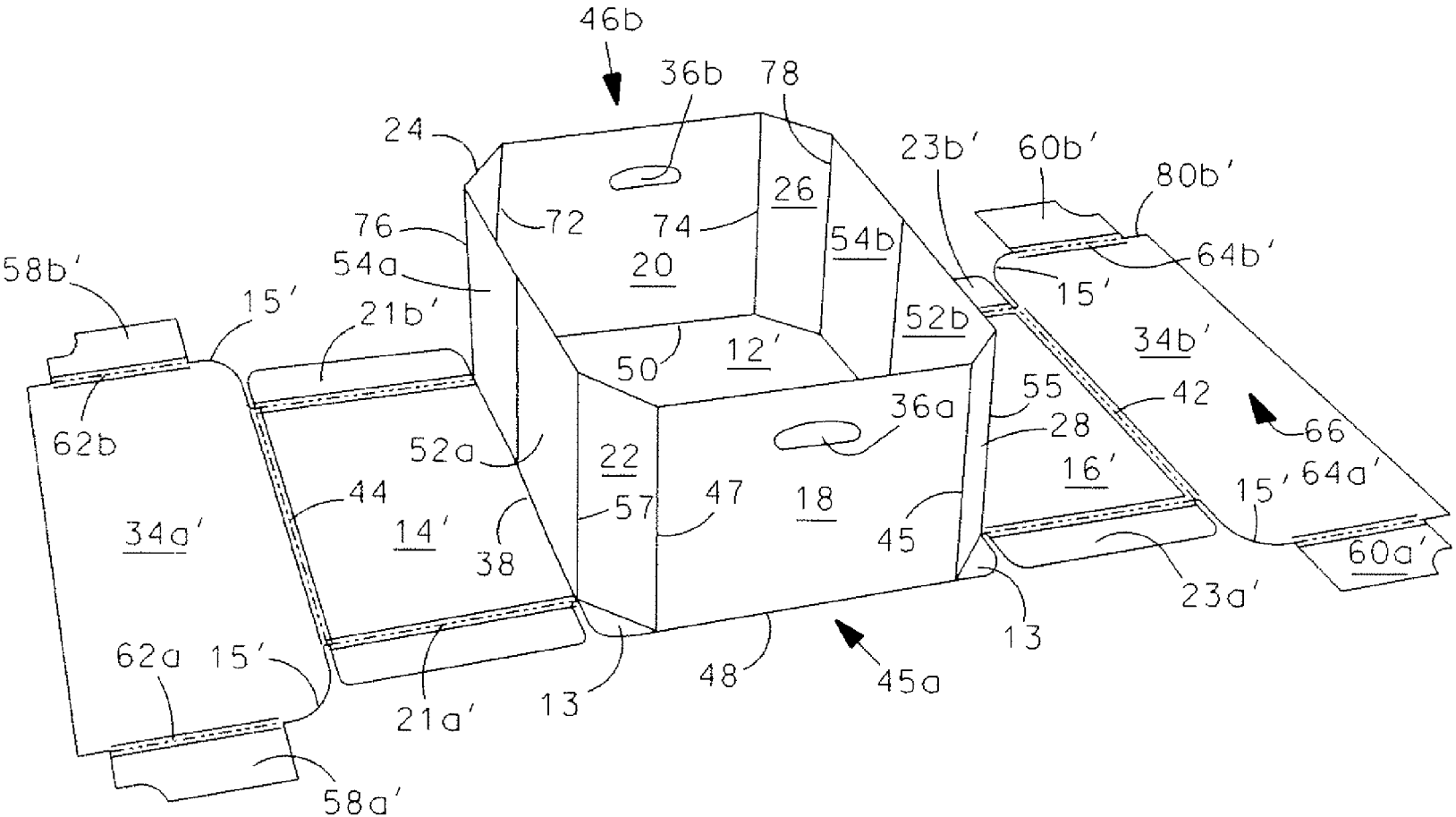
FIG. 3 is similar to FIG. 2, showing the unitary blank in a partially folded position by illustrating a portion of the unitary blank formed into the end walls of the container depicted in FIG. 1.

FIG. 3 is similar to FIG. 2, showing the unitary blank B1 in a partially folded position by illustrating a portion of the unitary blank B1 formed into the end walls 18, 20 of the container 10 depicted in FIG. 1. Each of the end pieces 46*a*' and 46*b*' is folded 90 degrees with respect to their fold lines 48 and 50. Then, the respective relatively diagonal corner panels 22', 24' and 26', 28' are folded inwardly toward the bottom panel 12' to form the diagonal corner panels 22', 24' and 26', 28' at an angle generally 38 degrees with respect to the longitudinal axis of the container 10 so that each of the rounded corners 13 provides a greater base by increasing surface area for the diagonal corner panels 22', 24' and 26', 28' to transmit pressure applied at the contact area of the diagonal corner panels and the bottom wall. Then, partial sidewall panels 52*a*', 52*b*', 54*a*', 54*b*' are folded with respect to fold lines 55', 57', 76', and 78' in a manner such that the bottom edges of the partial sidewall panels 52*a*', 52*b*', 54*a*', 54*b*' are respectively coincided with the fold line 38 and 40.

Figure 4:
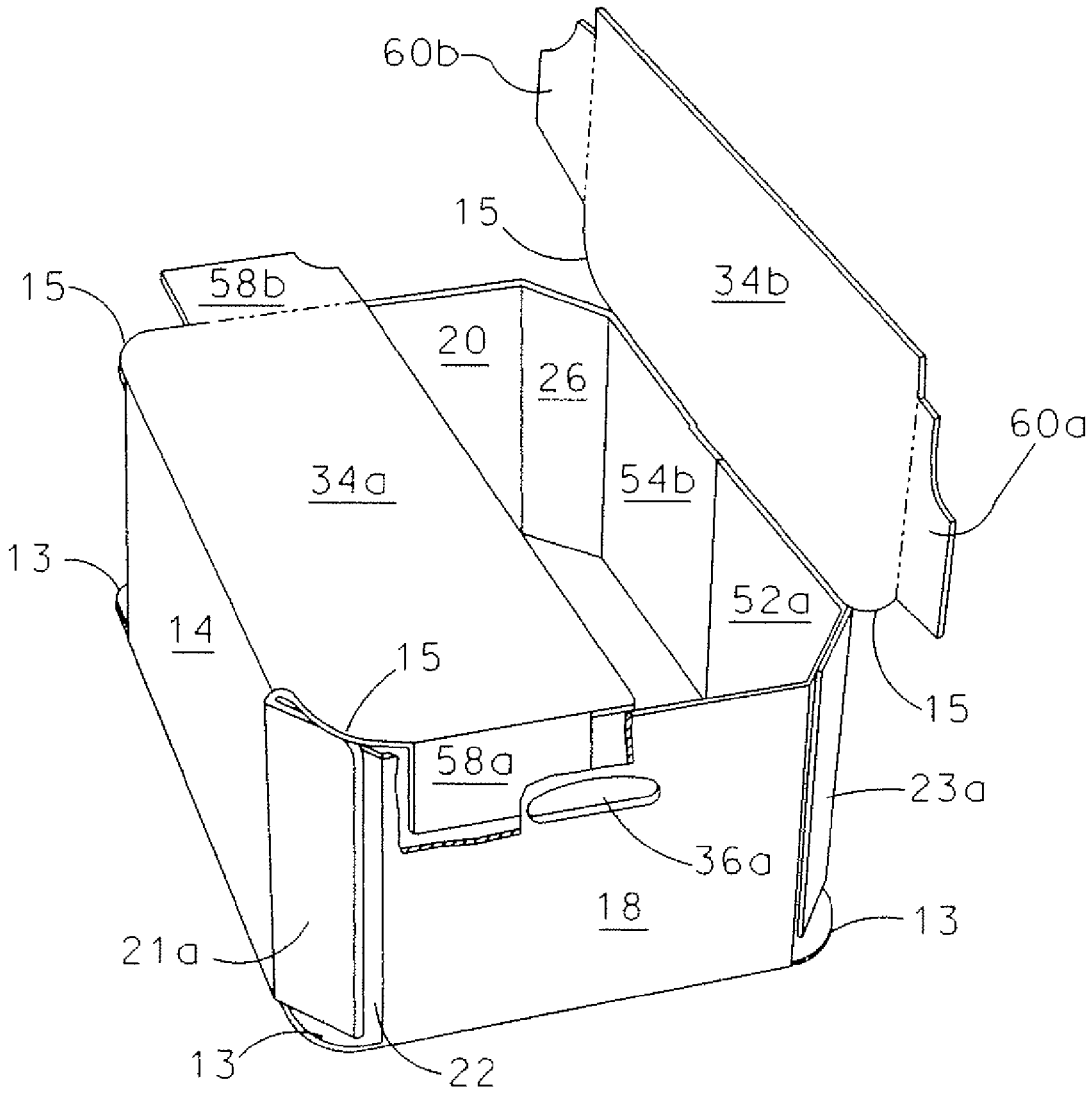
FIG. 4 is a perspective view of the fully constructed multi-sided container formed from the unitary blank shown in FIG. 2 and illustrating the container in FIG. 1 in a partially open position.

FIG. 4 is a perspective view of the fully constructed multi-sided container 10 formed from the blank shown in FIG. 2 and illustrating the container 10 in FIG. 1 in a partially opened position. The respective side wall forming panels 14' and 16' are folded at 90 degrees with respect to the panel 12' along the fold lines 38, 40 and configured to be attached with the respective partial sidewall panels 52*a*, 52*b* and 54*a*, 54*b* so that the respective side wall forming panels 14' and 16' and the respective partial sidewall panel 52*a*, 52*b* and 54*a*, 54*b* are glued to one another. Next, the respective top wall panels 34*a*', 34*b*' are folded along respective fold lines 42, 44 to form top wall 34*a*, 34*b* as depicted in FIG. 4. The respective flaps 58*a*, 58*b*, 60*a*, 60*b* are folded along the respective fold lines 62'*a*, 62*b*', 64*a*', 64*b*' and glued to the outside of panels 18 and 20.

Figure 5:
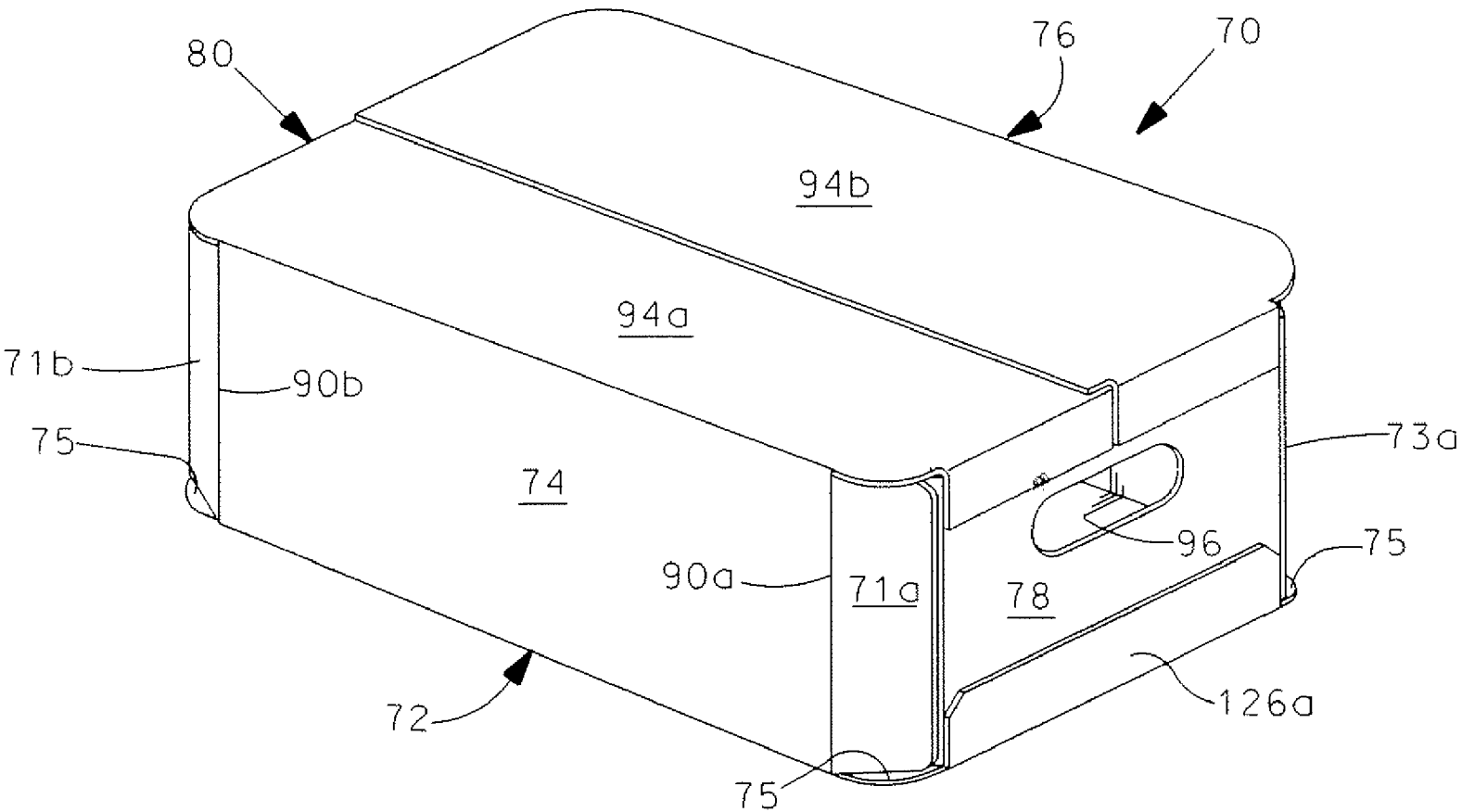
FIG. 5 is a top perspective view of a three pieces multi-sided container in accordance with a second embodiment of the invention.

FIG. 5 is a top perspective view of a multi-sided container 70 in accordance with a second embodiment of the invention. The container 70 comprises a bottom wall 72, opposite parallel side walls 74, 76, opposite parallel end walls 78, 80 and diagonal corner panels 82, 84, 86 and 88 (FIG. 8) connecting the respective side walls 74, 76 and respective end walls 78, 80 at adjacent ends. The diagonal corner walls 82, 84, 86 and 88 extend at an angle generally ranges from about 33 to 38 degrees with respect to the longitudinal axis of the container 70. Each of the side walls 74, 76 includes a respective pair of reinforcement flaps 71*a*, 71*b* and 73*a*, 73*b* that are defined by respective fold lines 90*a*, 90*b*, 92*a*, 92*b*. The pair of reinforcement flaps 71*a*, 71*b* and 73*a*, 73*b* of the opposite width of the respective side walls 74 and 76 is such that they project at their opposite side edges over the entire surface of the diagonal corner walls 82, 84, 86 and 88, terminating their edges at the respective edges of the diagonal corner walls 82, 84, 86 and 88. Two top walls 94*a*, 94*b* are generally defined as top wall that encloses the container 70. The top wall 94*a* is integrally attached to the side wall 74 and the top wall 94*b* is integrally attached to the side wall 76, but one ordinary skill in the art would appreciate that it is within the scope of the present invention to use a single cover integrally attached to one of the side walls 74, 76 or end walls 78, 80 of the container 70. Alternatively, the top walls 94*a*, 94*b* may detachably cover the container 70. Two hand hole openings 96*a*, 96*b* are formed on the respective end walls 78, 80 to facilitate handling of the container 70.

Figure 6:
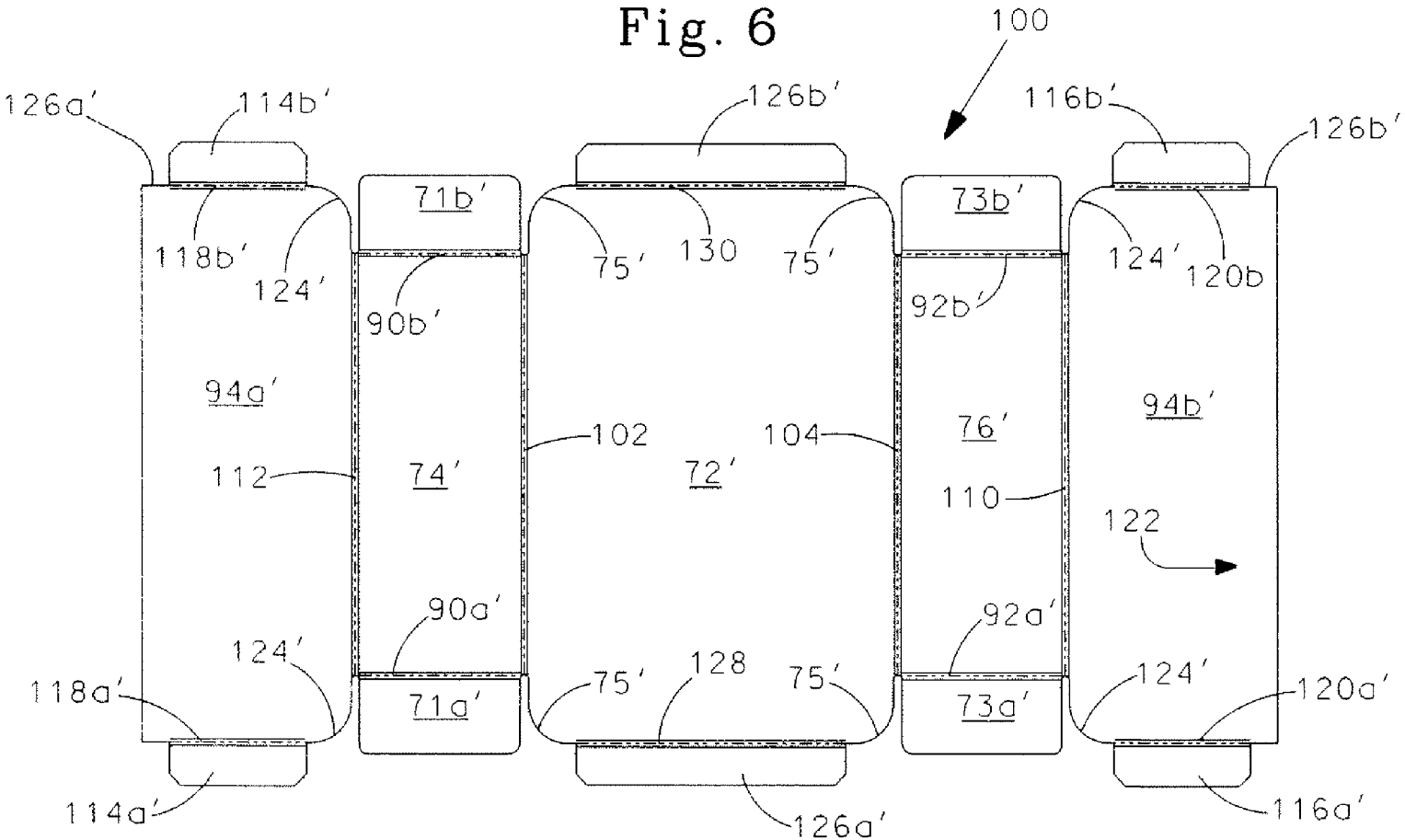
FIG. 6 is a plan view of a wrapper blank that forms the bottom wall, top and side walls of the three-piece multi-sided container depicted in FIG. 1.

FIG. 6 is a plan view of a wrapper blank 100 that forms the bottom wall panel 72, top walls 94*a*, 94*b* and side walls 74*a*, 76*b* of the three-piece container 70 depicted in FIG. 5 in accordance with the second embodiment of the invention. The wrapper blank 100 comprises a centrally located rectangular panel 72' that forms the bottom wall 72. The rectangular panel 72' has an advantage of having four identical rounded corners 75' which enhances the integrity of the container 70 when the wrapper blank 100 is folded. Side wall forming panels 74' and 76' are foldably joined to opposite side edges of the panel 72' by respective fold lines 102, 104. Each of the side wall panels 74', 76' includes two respective identical flaps 71*a*', 71*b*' and 73*a*', 73*b*' defined by respective fold lines 90*a*', 90*b*', and 92*a*', 92*b*'. Top wall panels 94*a*' and 94*b*' are foldably joined to respective longitudinal edges of the sidewall panels 74' and 76', opposite of their folded connection to the panel 72', by fold lines 110, 112. Each of the top wall panels 94*a*', 94*b*' includes two respective identical flaps 114*a*', 114*b*' and 116*a*', 116*b*' defined by respective fold lines 118*a*', 118*b*', and 120*a*', 120*b*'. An Arrow mark 122 indicates the direction of corrugation of the wrapper blank 100. Similarly, each of the top wall panels 94*a*', 94*b*', as noted with respect to the rectangular panel 72', has an advantage of having two identical rounded corners 124' which enhances the integrity of the container 70 when the wrapper blank 100 is folded. In addition, it should be noted that flaps 114*a*', 114*b*' and 116*a*', 116*b*' do not extend the full width of the top wall panels 94*a*', 94*b*', but terminate short of the outer free edge thereof, defining projecting tabs 126*a*' and 126*b*'. A pair of flaps 126*a*', 126*b*' is foldably joined to respective transverse edges of the panel 72' by fold lines 128, 130. The flaps 126*a*', 126*b*' are essentially identical to one another and they are mirror images of one another. The respective flaps 126*a*', 126*b*' are glued to the respective end walls 78, 80 when the wrapper blank 100 is folded to form the bottom wall 72, side walls 74, 76, and top walls 94*a* and 94*b*.

Figure 7:
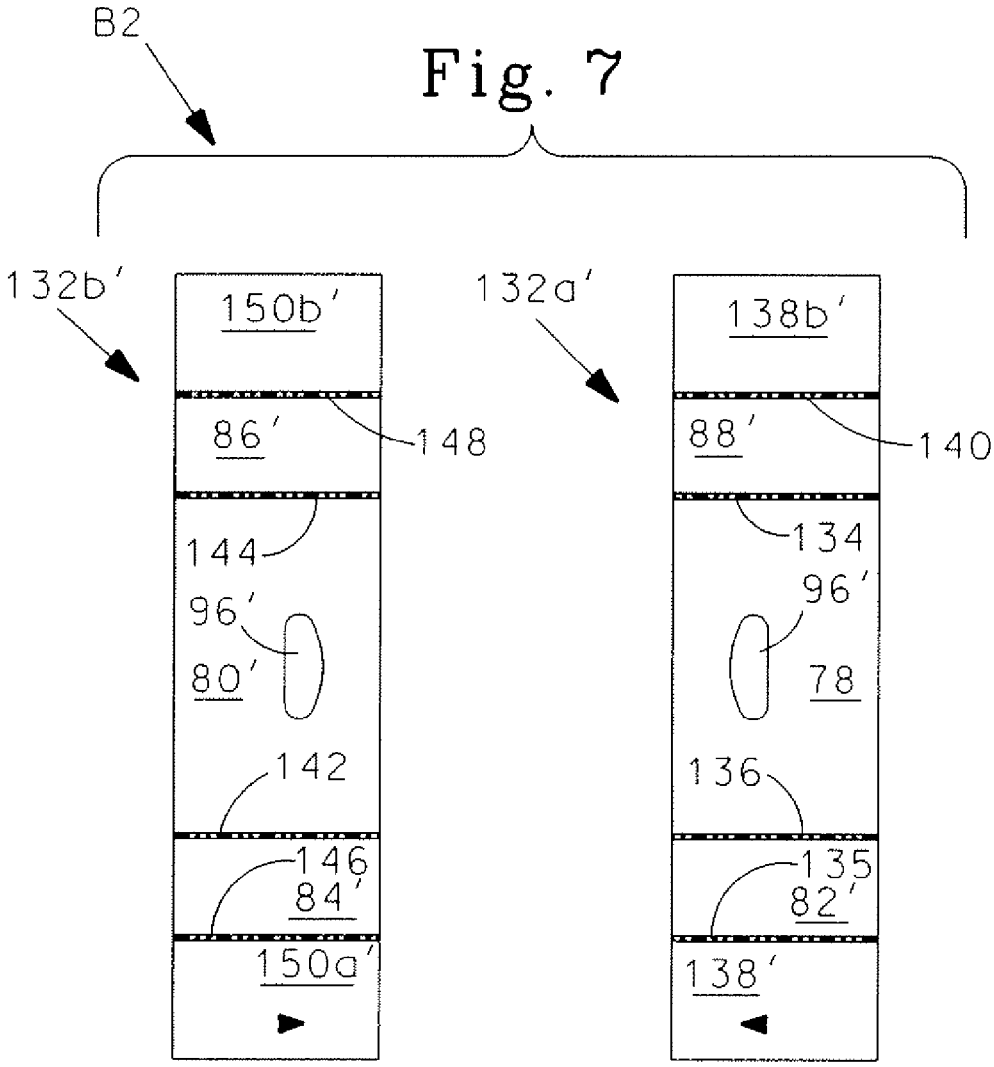
FIG. 7 is a plan view of a pair of blanks B2 that form the end pieces used to construct the three-piece multi-sided container depicted in FIG. 5.

FIG. 7 is a plan view of a pair of blanks B2, blank 132*a*' and blank 132*b*' each form the end walls 78 and 80 used to construct the three-piece multi-sided container 70 depicted in FIG. 5. The pair of end pieces 132*a*' and 132*b*' is attached to respective transverse edges of the panel 72'. The end pieces 132*a*' and 132*b*' are essentially identical to one another and they are mirror images of one another. The end piece 132*a*' includes an end wall panel 78', two relatively narrow reinforcing corner panels 82' and 88' foldably joined to opposite ends of the panel 78' by fold lines 134, 136, and second partial sidewall panels 138*a*', 138*b*' are foldably joined to outer edges of respective narrow reinforcing corner panels 82' and 88' by fold lines 135 and 140. Similarly, The end piece 132*b*' includes an end wall panel 80', two relatively narrow reinforcing corner panels 84' and 86' foldably joined to opposite ends of the panel 80' by fold lines 142, 144, and second partial sidewall panels 150*a*', 150*b*' are foldably joined to outer edges of respective narrow reinforcing corner panels 84' and 86' by fold lines 146 and 148. Openings 96*a*', 96*b*' are formed on the respective end wall panels 78', 80' so that when the end pieces 132*a*', 132*b*' are folded, these openings 96*a*', 96*b*' forms the hand hole openings 96 in the container 70 as described with reference to FIG. 5.

Figure 8:
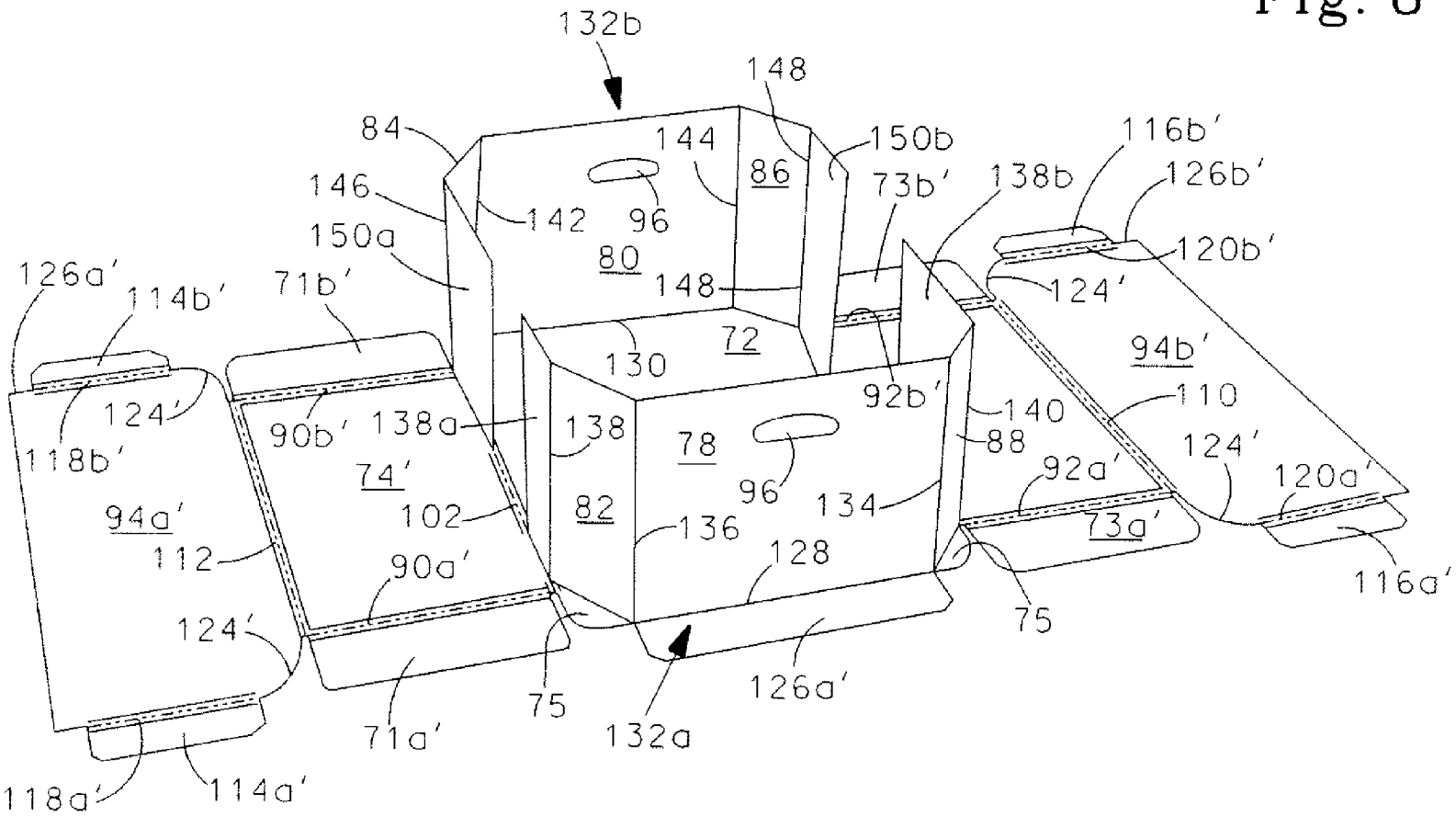
FIG. 8 is a top perspective view of the end pieces located in their operative positions on the wrapper blank shown in FIG. 6, and illustrating the wrapper blank in the folding position around the end pieces.

FIG. 8 is a top perspective view of the end pieces 132*a*, 132*b* located in their operative positions on the wrapper blank 100 shown in FIG. 6 and illustrating the wrapper blank 100 in the folding position around the end walls pieces 132*a*, 132*b*. The end pieces 132*a*, 132*b* are folded along their respective fold lines 134, 136, 142, and 144. The respective relatively narrow reinforcing corner panels 82', 84' and 86', 88' are folded inwardly toward the bottom panel 72' at approximately 45 degrees so that the rounded corners 75 provides a greater base by increasing surface area for the reinforcing corner panels 82', 84' and 86', 88' to transmit pressure applied at those location. Then, partial sidewall panels 138*a*', 138*b*', 150*a*', 150*b*' are folded with respect to fold lines 138, 140, 146, and 148 in a manner such that the bottom edges of the partial sidewall panels 138*a*', 138*b*', 150*a*', 150*b*' are respectively coincided with the fold line 102 and 104.

Figure 9:
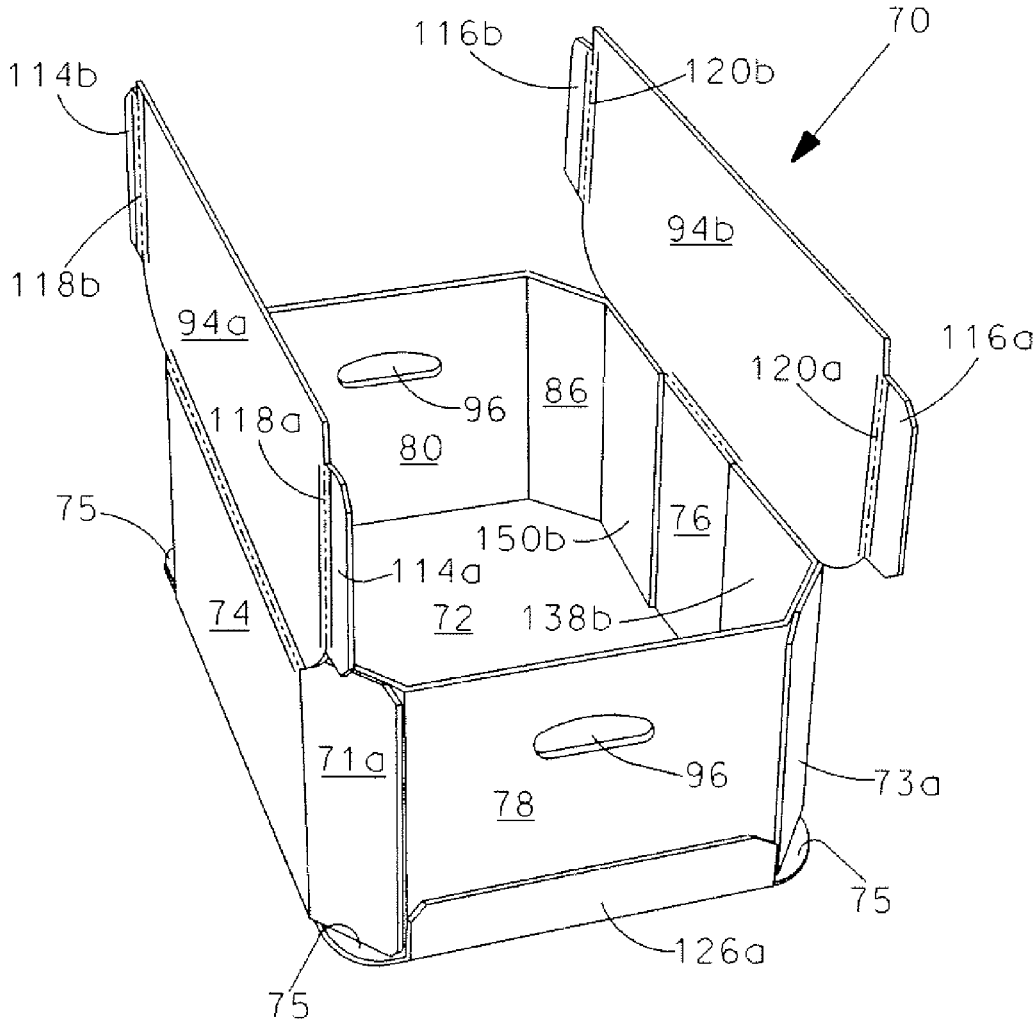
FIG. 9 is a perspective view of the fully constructed three-piece multi-sided container depicted in FIG. 5 showing the wrapper blank folded and glued against the end pieces to form the bottom wall and side walls of the container.

FIG. 9 is a perspective view of the fully constructed three-piece multi-sided container 70 depicted in FIG. 5 showing the wrapper blank 100 folded and glued against the end pieces 132*a*, 132*b* to form the bottom wall 72 and side walls 74, 76 of the container 70. The respective side wall forming panels 74 and 76 are folded at 90 degrees with respect to the panel 72' along the fold lines 102, 104 and configured to be attached with the respective partial sidewall panels 138*a*, 138*b* and 150*a*, 150*b* so that the respective side wall forming panels 14' and 16' and the respective partial sidewall 138*a*, 138*b* and 150*a*, 150*b* are glued to one another. Next, the respective top wall panels 94*a*', 94*b*' are folded along respective fold lines 112, 110 to form top wall 94*a*, 94*b* as depicted in FIG. 4. The respective flaps 114*a*, 114*b*, 116*a*, 116*b* are folded along the respective fold lines 118*a*, 118*b*, 120*a*, 120*b* and the flaps 126*a*, 126*b* are glued to the respective end walls 78, 80.

Figure 10:
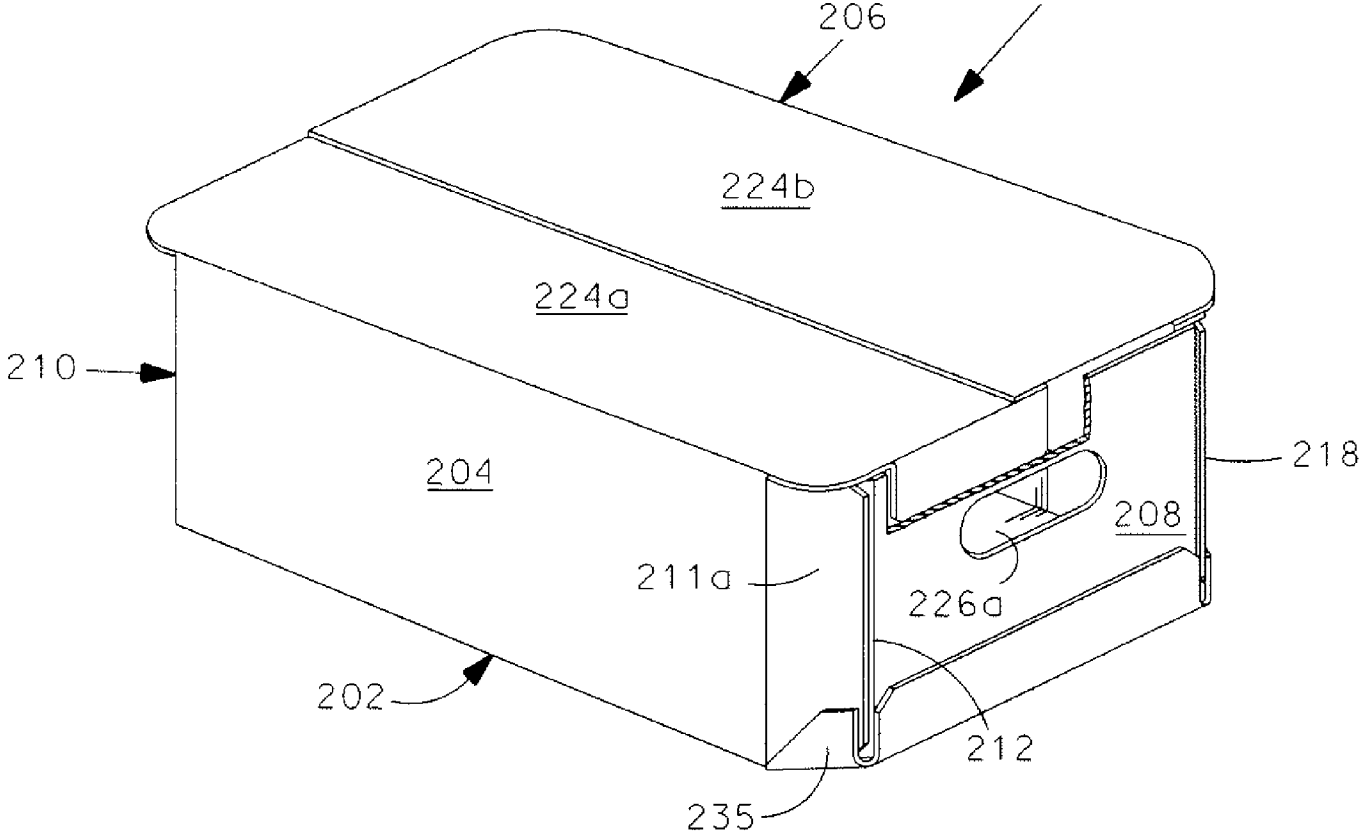
FIG. 10 is a top perspective view of a three piece multi-sided container in accordance with a third embodiment of the invention.

FIG. 10 is a top perspective view of a multi-sided container 200 in accordance with a third embodiment of the invention. The multi-sided container 200 comprises a bottom wall 202, opposite parallel side walls 204, 206, opposite parallel end walls 208, 210 and diagonal corner panels 212, 214, 216 and 218 (FIG. 13) connecting the respective side walls 204, 206 and respective end walls 208, 210 at adjacent ends. The diagonal corner walls 212, 214, 216 and 218 extend at an angle generally 38 degrees with respect to the longitudinal axis of the container 200. Each of the side walls 204, 206 includes a respective pair of reinforcement flaps 211*a*, 211*b* and 213*a*, 213*b* that are defined by respective fold lines 220*a*, 220*b*, 222*a*, 222*b*. The respective pair of reinforcement flaps 211*a*, 211*b* and 213*a*, 213*b* of the opposite width of the respective side walls 204 and 206 is such that they project at their opposite side edges over the most part of or entire surface of the diagonal corner walls 212, 214, 216 and 218, terminating their edges at the respective edges of the diagonal corner walls 212, 214, 216 and 218. Two top walls 224*a*, 224*b* are generally defined as the top wall that encloses the container 200. The top wall 224*a* is integrally attached to the side wall 204 and the top wall 224*b* is integrally attached to the side wall 206, but one ordinary skill in the art would appreciate that it is within the scope of the present invention to use a single cover integrally attached to one of the side walls 204, 206 or end walls 208, 210 of the container 200. Alternatively, the top walls 224*a*, 224*b* may detachably cover the container 200. Two hand hole openings 226 are formed on the respective end walls 208, 210 to facilitate handling of the container 200.

Figure 11:
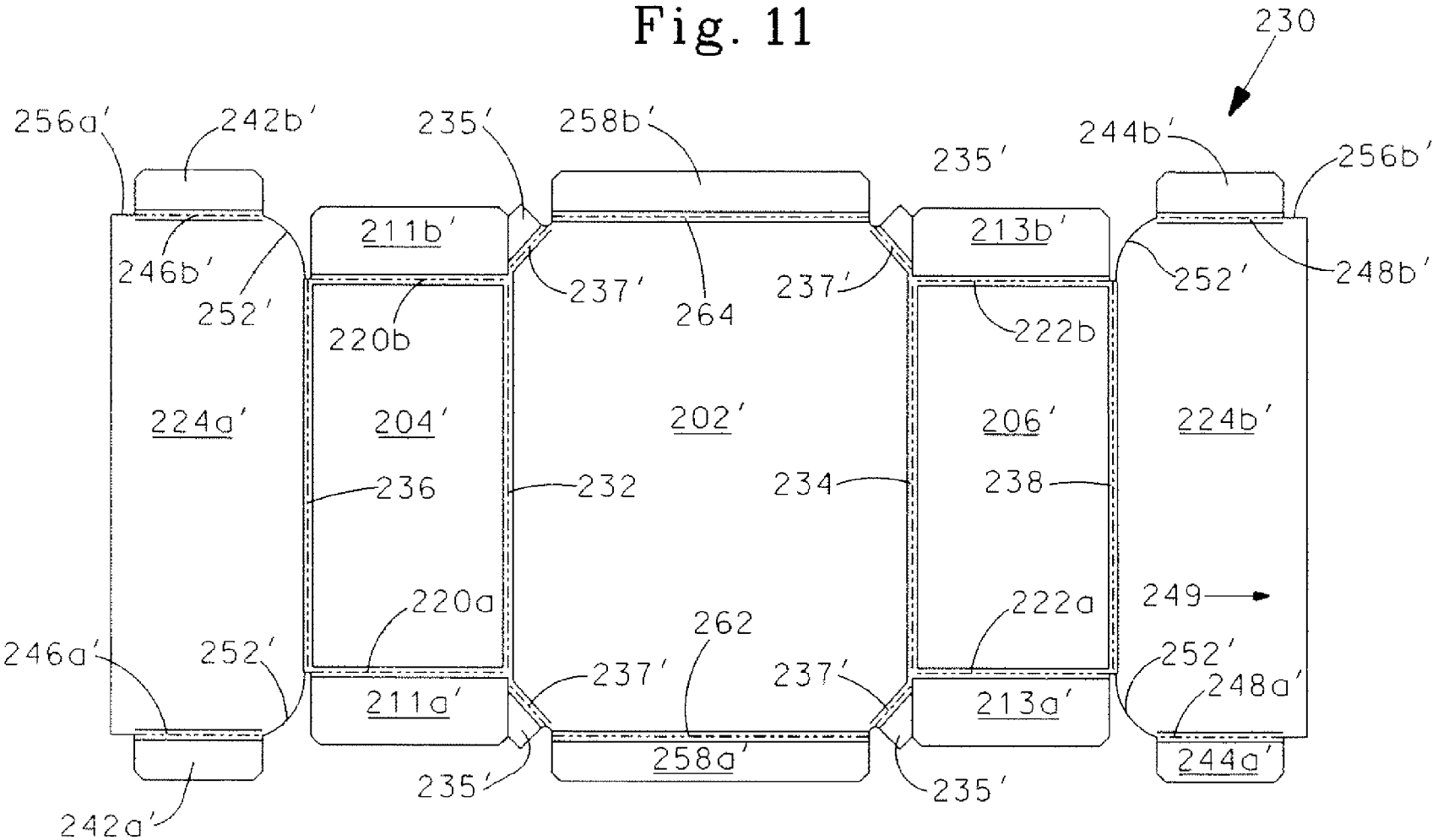
FIG. 11 is a plan view of a wrapper blank that forms the bottom wall, top and side walls of the three-piece multi-sided container depicted in FIG. 10.

FIG. 11 is a plan view of a wrapper blank 230 that forms the bottom wall 202', top walls 224*a*', 224*b*' and side walls 204*a*', 206*b*', of the three-piece container 200 depicted in FIG. 10 in accordance with the third embodiment of the invention. The wrapper blank 230 comprises a centrally located rectangular panel 202' that forms the bottom wall 202. The rectangular panel 202' has an advantage of having four identical tapered corners 235' which enhances the integrity of the container 200 when the wrapper blank 230 is folded. The respective tapered corners 235' fold over respective diagonal walls when the blank 230 is constructed. The side wall forming panels 204' and 206' are foldably joined to opposite side edges of the panel 202' by respective fold lines 232, 234. Each of the side wall panels 204', 206' includes two respective identical reinforcement flaps 211*a*', 211*b*' and 213*a*', 213*b*' defined by respective fold lines 220*a*', 220*b*', and 222*a*', 222*b*'. Top wall panels 224*a*' and 224*b*' are foldably joined to respective longitudinal edges of the sidewall panels 204' and 206', opposite of their folded connection to the panel 202', by fold lines 236, 238. Each of the top wall panels 224*a*', 224*b*' includes two respective identical flaps 242*a*', 242*b*' and 244*a*', 244*b*' defined by respective fold lines 246*a*', 246*b*', and 248*a*', 248*b*'.

An Arrow mark 249 indicates the direction of corrugation of the wrapper blank 100. Similarly, each of the top wall panels 224*a*', 224*b*' has an advantage of having two identical rounded corners 252' which enhances the integrity of the container 200 when the wrapper blank 230 is folded. In addition, it should be noted that flaps 242*a*', 242*b*' and 244*a*', 244*b*' do not extend the full width of the top wall panels 224*a*', 224*b*', but terminate short of the outer free edge thereof, defining projecting tabs 256*a*' and 256*b*'. A pair of flaps 258*a*', 258*b*' is foldably joined to respective transverse edges of the panel 202' by fold lines 262, 264. The flaps 258*a*', 258*b*' are essentially identical to one another and they are mirror images of one another. The respective flaps 258*a*', 258*b*' are glued to the respective end walls 208, 210 when the wrapper blank 230 is folded to form the bottom wall 202, side walls 204, 206, and top walls 224*a* and 224*b*.

Figure 12:
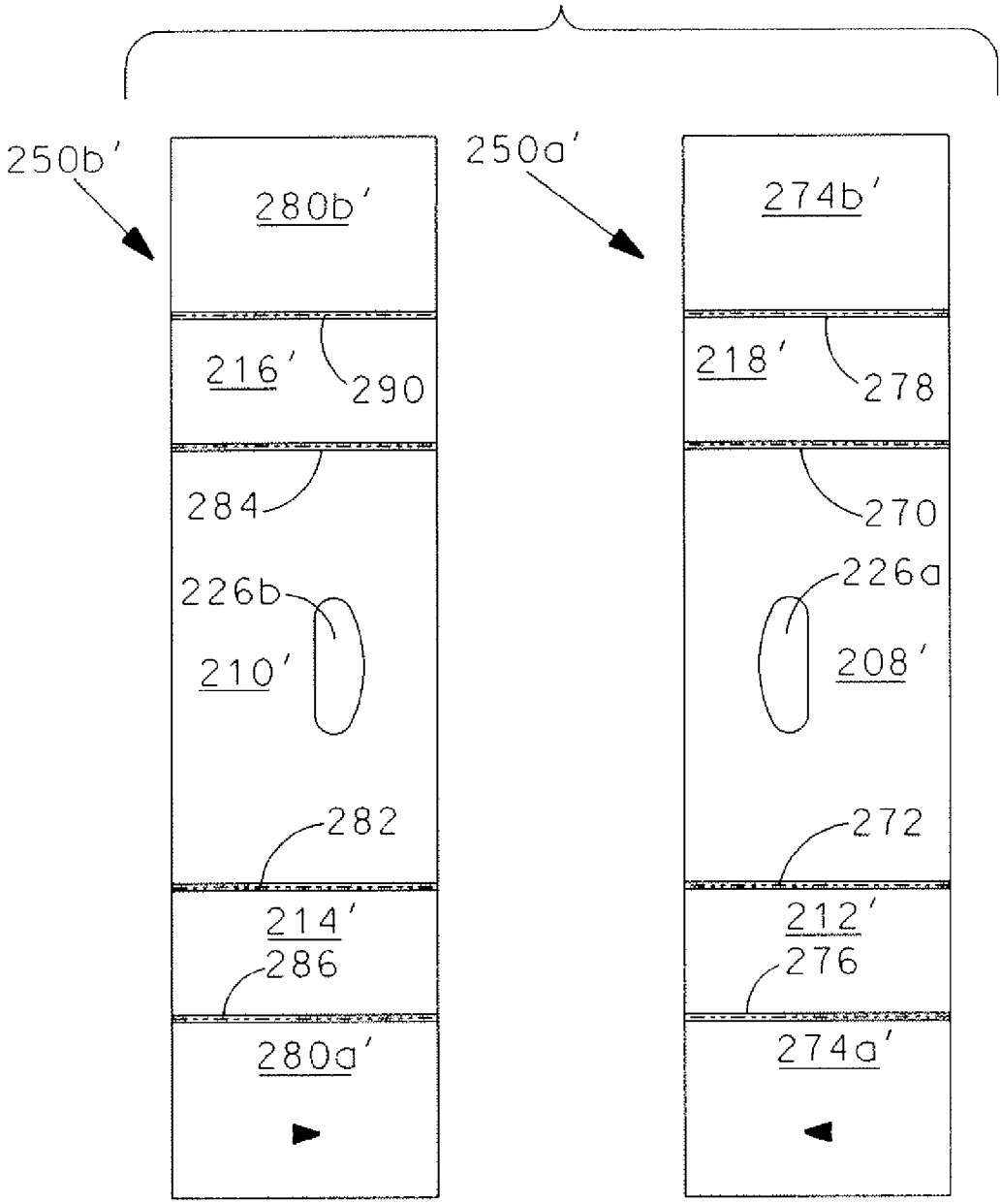
FIG. 12 is a plan view of a pair of blanks that form the end pieces used to construct the three-piece multi-sided container depicted in FIG. 10.

FIG. 12 is a plan view of a pair of end pieces 250*a*', 250*b*' that forms the end walls 208, 210 used to construct the three-piece container 200 as depicted in FIG. 10. The pair of end pieces 250*a*', 250*b*' is attached to respective transverse edges of the panel 202'. The end pieces 250*a*', 250*b*' are essentially identical to one another and they are mirror images of one another. The end piece 250*a*' includes an end wall panel 208', two relatively narrow reinforcing corner panels 212' and 218' foldably joined to opposite ends of the panel 208' by fold lines 270, 272, and second partial sidewall panels 274*a*', 274*b*' are foldably joined to outer edges of respective narrow reinforcing corner panels 212' and 218' by fold lines 276 and 278. Similarly, The end piece 250*b*' includes an end wall panel 210', two relatively narrow reinforcing corner panels 214' and 216' foldably joined to opposite ends of the panel 210' by fold lines 282, 284, and second partial sidewall panels 280*a*', 280*b*' are foldably joined to outer edges of respective narrow reinforcing corner panels 214' and 216' by fold lines 286 and 290. Openings 226*a*', 226*b*' are formed on the respective end wall panels 208', 210' so that when the end pieces 250*a*', 250*b*' are folded, these openings 226*a*', 226*b*' forms the hand hole openings 226*a*, 226*b* in the container 200 as described with reference to FIG. 10.

Figure 13:
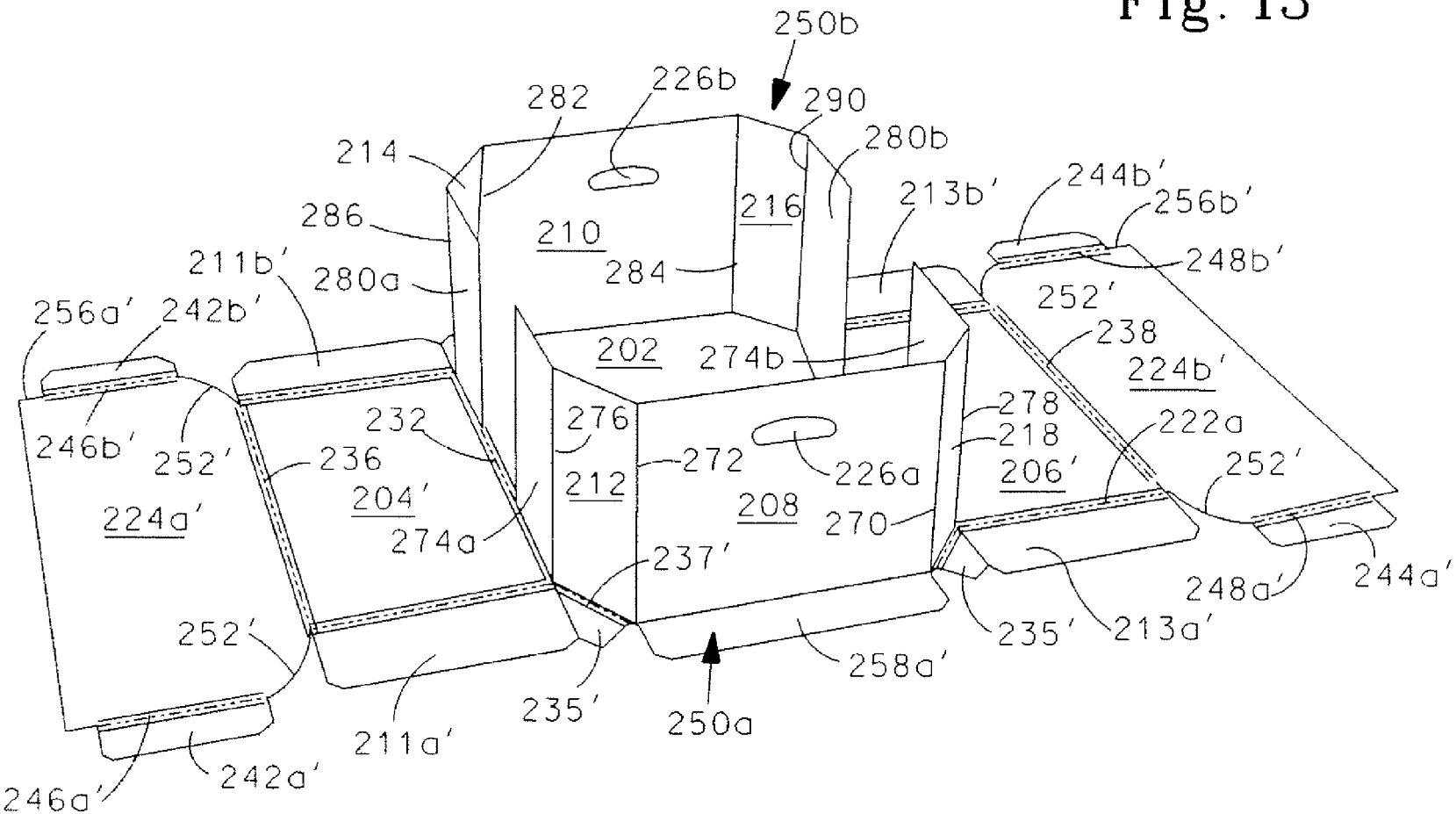
FIG. 13 is a top perspective view of the end walls located in their operative positions on the wrapper blank shown in FIG. 11 and illustrating the wrapper blank in the folding position around the end walls.

FIG. 13 is a top perspective view of the end pieces 250*a*, 250*b* located in their operative positions on the wrapper blank 230 shown in FIG. 11 and illustrating the wrapper blank 230 in the folding position around the end pieces 250*a*, 250*b*. The end pieces 250*a*, 250*b* are folded along their respective fold lines 270, 272, 282, and 284. The respective relatively narrow reinforcing corner panels 212', 214' and 216', 218' are folded inwardly toward the bottom panel 202' at proximately 45° degrees so that the respective corner flaps 235' glued to the respective reinforcing corner panels 212', 214' and 216', 218' to enhance the integrity of the container 200. Then, partial sidewall panels 274*a*', 274*b*', 280*a*', 280*b*' are folded with respect to fold lines 276, 278, 286, and 290 in a manner such that the bottom edges of the partial sidewall panels 274*a*', 274*b*', 280*a*', 280*b*' are respectively coincided with the fold line 232 and 234.

Figure 14:
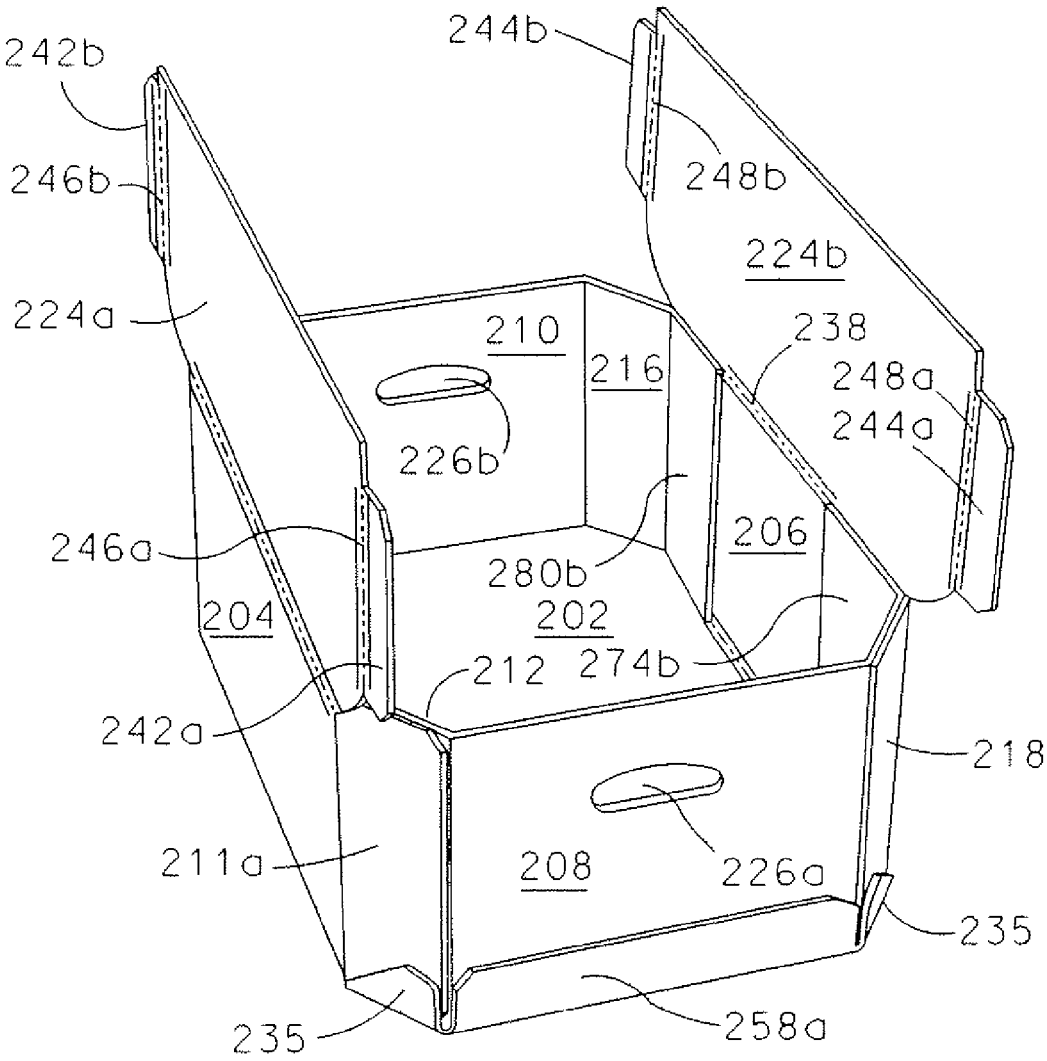
FIG. 14 is a perspective view of the fully constructed three-piece multi-sided container depicted in FIG. 10 showing the wrapper blank folded and glued against the end walls to form the bottom wall and the side walls of the multi-sided container.

FIG. 14 is a perspective view of the fully constructed three-piece multi-sided container 200 depicted in FIG. 10 showing the wrapper blank 230 folded and glued against the end walls 208, 210 and partial side panels 274*a*', 274*b*', 280*a*', 280*b*' to form the bottom wall 202 and the side walls 204, 206 of the container 200. The respective side wall forming panels 204' and 206' are folded at 90 degrees with respect to the panel 202' along the fold lines 232, 234 and configured to be attached with the respective partial sidewall panels 274*a*', 274*b*', 280*a*', 280*b*' so that the respective side wall forming panels 204' and 206' and the respective partial sidewall 274*a*, 274*b*, 280*a*, 280*b* are glued to one another. Next, the respective top wall panels 224*a*', 224*b*' are folded along respective fold lines 236, 238 to form top wall 224*a*, 224*b* as depicted in FIG. 14. The respective flaps 242*a*, 242*b*, 244*a*, 244*b* are folded along the respective fold lines 246*a*, 246*b*, 248*a*, 248*b* and are glued to the respective end walls 208, 210.

Figure 15:
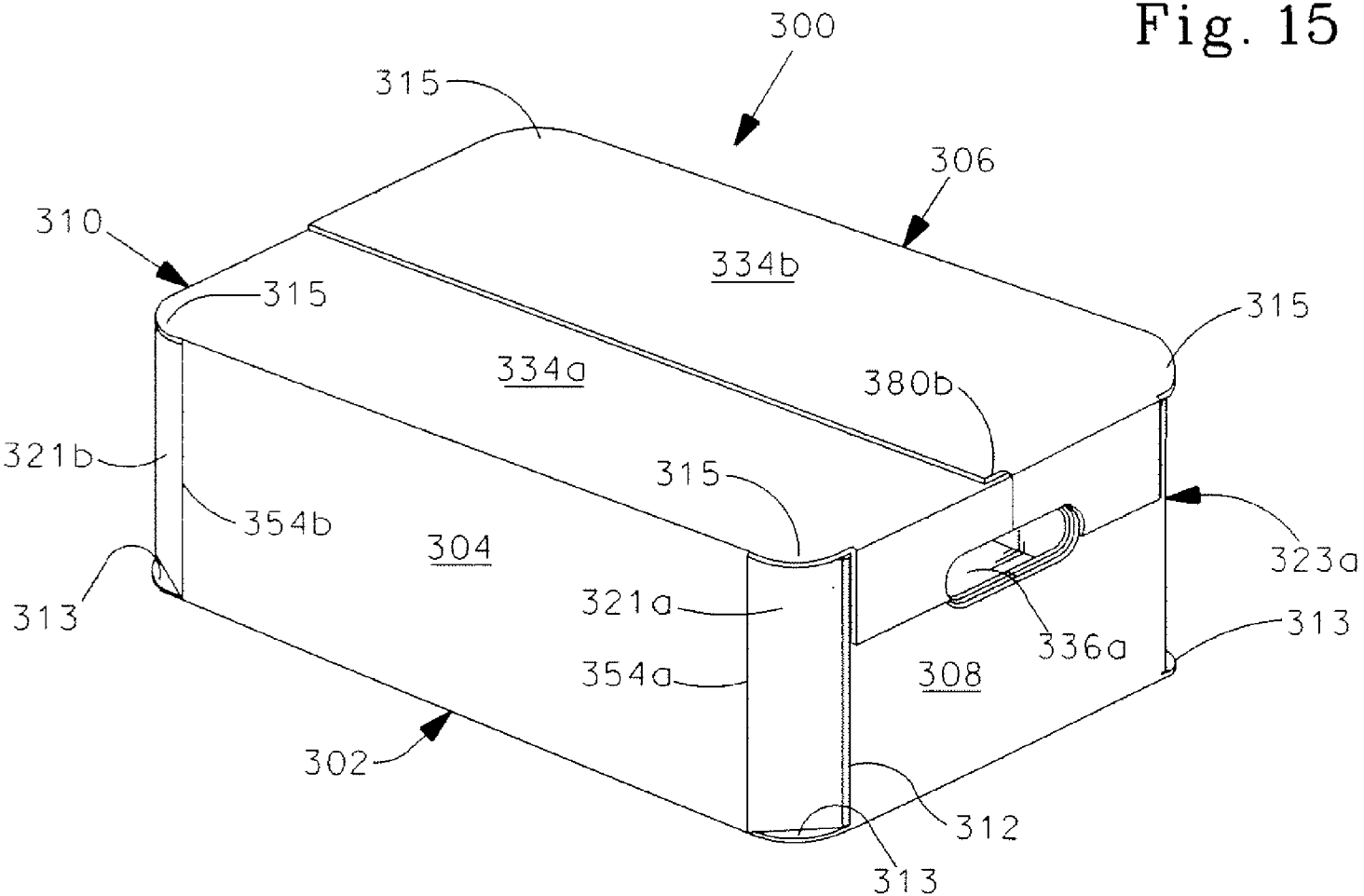
FIG. 15 is a top perspective view of a multi-sided container in accordance with a fourth embodiment of the invention.

FIG. 15 is a top perspective view of a multi-sided container 300 in accordance with a fourth embodiment of the invention. The multi-sided container 300 comprises a bottom wall 302, opposite parallel side walls 314, 316, opposite parallel end walls 308, 310 and diagonal corner panels 312, 314, 316 and 318 (FIG. 19) connecting the respective side walls 304, 306 and respective end walls 308, 310 at adjacent ends. The diagonal corner walls 312, 314, 316 and 318 extend at an angle generally 38 degrees with respect to the longitudinal axis of the container 300. Each of the side walls 304, 306 includes a respective pair of reinforcement flaps 321*a*, 321*b* and 323*a*, 323*b* that are defined by respective fold lines 354*a*', 354*b*', 356*a*', 356*b*'. The respective pair of reinforcement flaps 321*a*, 321*b* and 323*a*, 323*b* of the opposite width of the respective side walls 304 and 306 is such that they project at their opposite side edges 321*a*, 321*b* over the diagonal corner walls 322, 324, 326 and 328, terminating at their edges proximately on the edge of the respective diagonal corner walls 322, 324, 326 and 328. Two top walls 334*a*, 334*b* are generally defined as top wall that encloses the container 300. The top wall 334*a* is integrally attached to the side wall 304 and the top wall 334*b* is integrally attached to the side wall 306, but one ordinary skill in the art would appreciate that it is within the scope of the present invention to use a single cover or top wall integrally attached to one of the side walls or end walls of the container. Alternatively, the top walls 334*a*, 334*b* may detachably cover the container 300. Two hand hole openings 336*a*, 336*b* are formed on the respective end walls 308, 310 to facilitate handling of the container 300.

Figure 16:
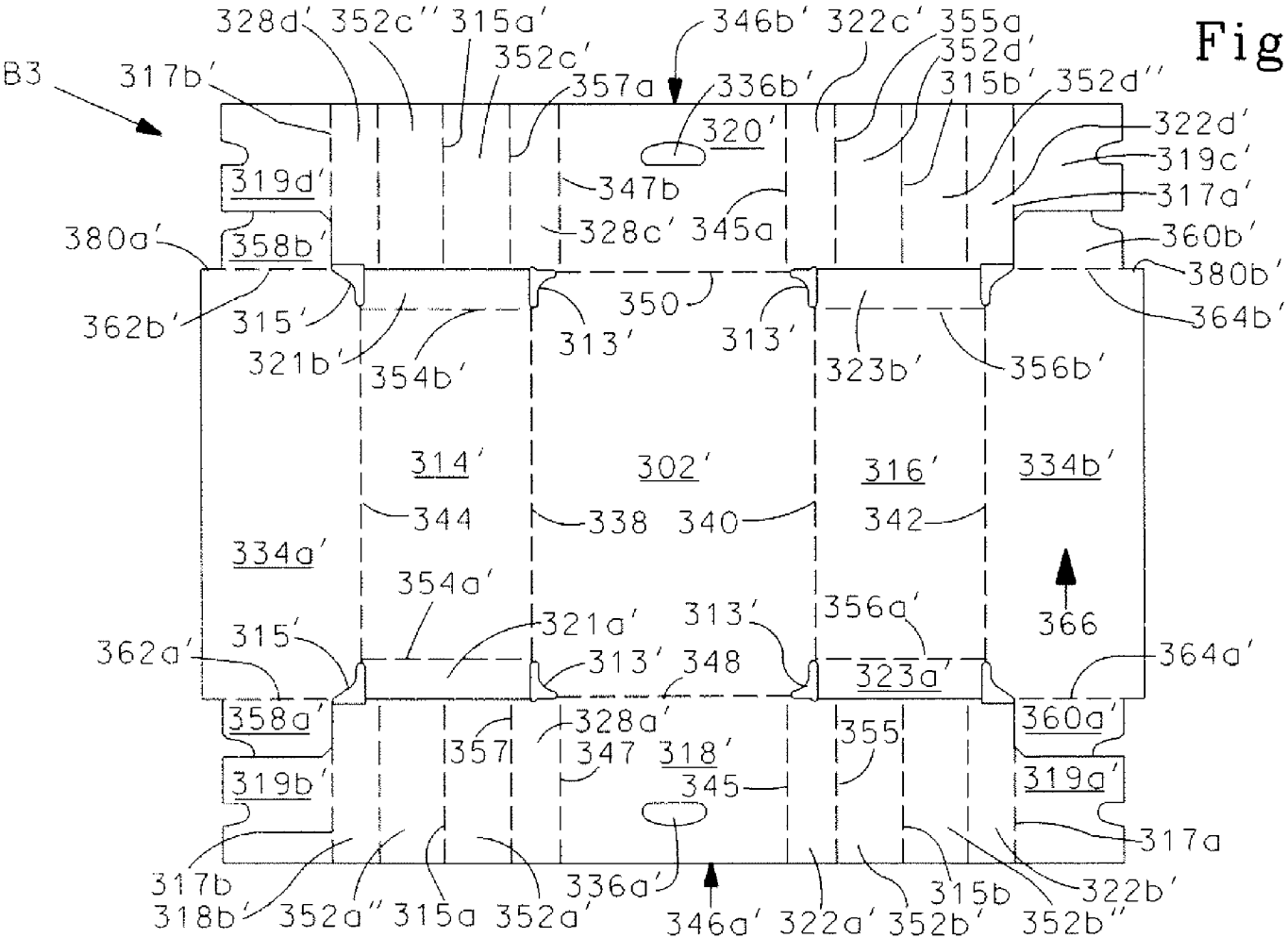
FIG. 16 is a plan view of a unitary blank B3 used to form the multi-sided container shown in FIG. 15 in accordance with a fourth embodiment of the invention.
Figure 19:
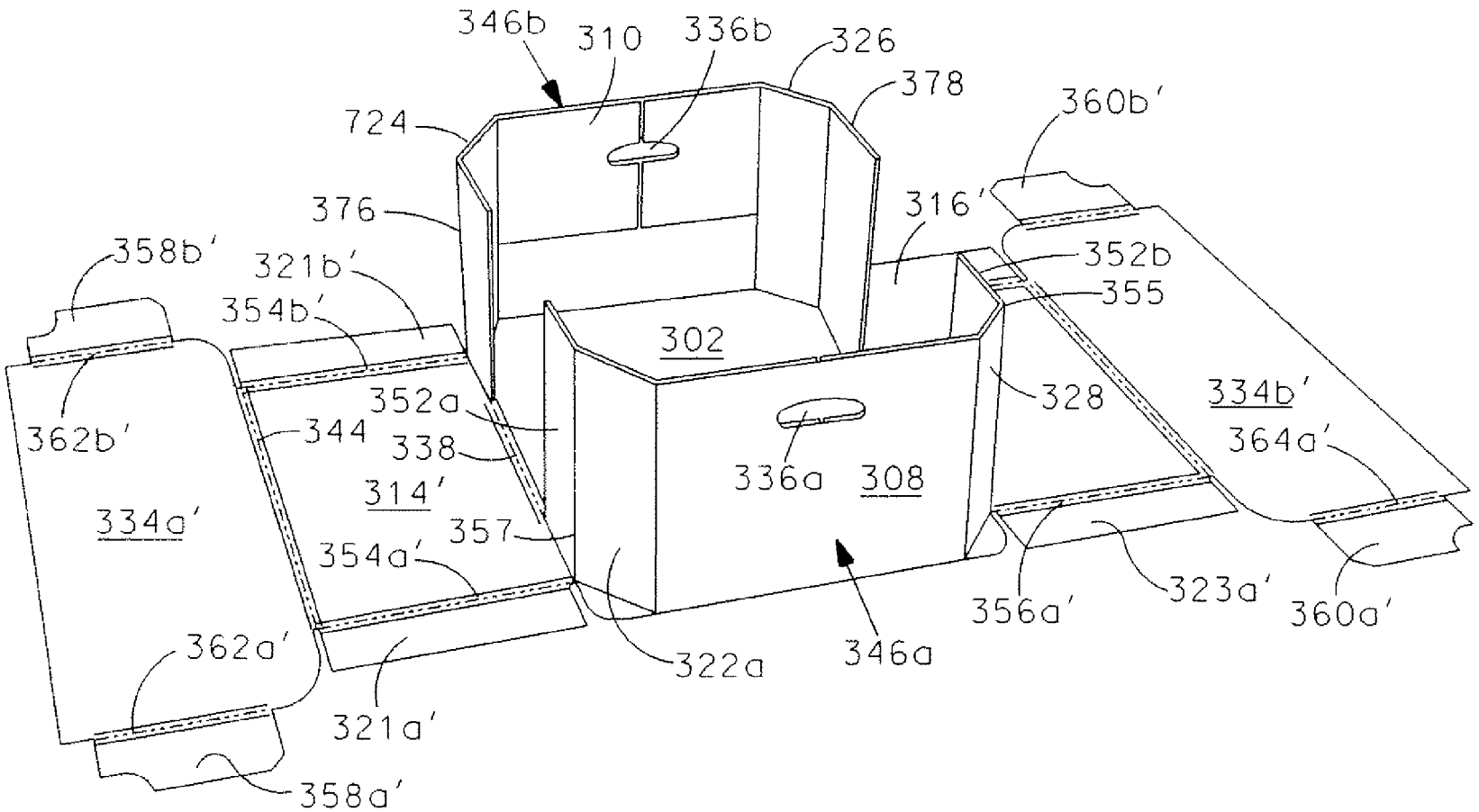
FIG. 19 is similar to FIG. 18, showing the unitary blank B3 in a partially folded position by illustrating a portion of the unitary blank B3 formed into the end walls of the multi-sided container depicted in FIG. 15.

FIG. 16 is a plan view of a unitary blank B3 used to form the container 300 shown in FIG. 15 in accordance with a fourth embodiment of the invention. The blank B3 comprises a centrally located rectangular panel 302' that forms the bottom wall 302 (FIG. 19). The rectangular panel 302' has an advantage of having four identical rounded corners 313' which enhances the integrity of the container 300' when the blank B3 is formed into container 300 (FIG. 15). Side wall forming panels 314' and 316' are foldably joined to opposite side edges of the bottom panel 302' by respective fold lines 338, 340. Each of the side wall panels 314', 316' includes two respective identical reinforcement flaps 321*a*', 321*b*' and 323*a*', 323*b*' defined by respective fold lines 354*a*', 354*b*', and 356*a*', 356*b*'. Top wall panels 334*a*' and 334*b*' are foldably joined to respective longitudinal edges of the sidewall panels 314' and 316', opposite of their folded connection to the bottom panel 302', by fold lines 342, 344. Each of the top wall panels 334*a*', 334*b*' includes two respective identical flaps 358*a*', 358*b*' and 360*a*', 360*b*' defined by respective fold lines 362*a*', 362*b*', and 364*a*', 364*b*'. An Arrow mark 366 indicates the direction of corrugation of the blank B3. Similarly, each of the top wall panels 334*a*', 334*b*', as noted with respect to the rectangular panel 302', has an advantage of having two identical rounded corners 315' which enhances the integrity of the container 300 when the blank B3 is formed into container 300. In addition, it should be noted that flaps 358*a*', 358*b*' and 360*a*', 360*b*' do not extend the full width of the top wall panels 334*a*', 334*b*', but terminate short of the outer free edge thereof, defining projecting tabs 380*a*' and 380*b*'.

A pair of end pieces 346*a*', 346*b*' is foldably joined to respective transverse edges of the panel 302' by fold lines 348, 350. The end pieces 346*a*', 346*b*' are essentially identical to one another and they are mirror images of one another. The end piece 346*a*' includes an end wall panel 318', four relatively narrow reinforcing corner panels 322*a*', 322*b*' and 328*a*', 328*b*' foldably joined to opposite ends of the panel 318' by fold lines 345, 347, and second partial sidewall panels 352*a*', 352*a*", 352*b*', 352*b*" are foldably joined to outer edges of the end wall panel 318' by fold lines 355 and 357. Respective end wall panels 319*a*', 319*b*' are foldably joined to the end wall panel 318' by fold lines 317*a* and 317*b*. Respective end panels 319*a*', 319*b*', respective reinforcing corner panel 322*b*', 328*a*', and reinforcing corner panels 322*b*', 328*b*' are folded along respective fold lines 315*a* and 315*b*. It should be noted that respective reinforcing corner panel 322*b*', 328*b*' fold 180 degrees onto respective reinforcing corner panel 322*a*', 328*a*' which ultimately provide double wall for the reinforcing corner wall 322*a*, 328*b*. Likewise, respective partial sidewall panels 352*a*", 352*b*" fold 180 degrees onto respective partial sidewall panels 352*a*', 352*b*' which ultimately provide double wall for the respective partial sidewall 352*a*, 352*b*. End panels 319*a*', 319*b*' fold onto the end wall panel 318' and thereby provide a stronger end wall 308 when the blank B3 is in the folded position. The substantially doubled end walls reinforce the hand hole openings 336*a*', 336*b*' so that greater weight may be carried on by the container 300 without tearing the hand hole openings 336*a*', 336*b*' during transportation.

The end piece 346*b* includes an end wall panel 320', four relatively narrow reinforcing corner panels 322*c*', 322*d*' and 328*c*', 328*d*' foldably joined to opposite ends of the panel 320' by fold lines 345*a*, 347*b*, and second partial sidewall panels 352*c*', 352*c*", 352*d*', 352*d*" are foldably joined to outer edges of the end wall panel 320' by fold lines 355*a* and 357*a*. Respective end panels 319*c*', 319*d*' are foldably joined to the end wall panel 320' by respective fold lines 317*a*', 317*b*'. Respective end panels 319*c*', 319*d*', respective reinforcing corner panel 322*c*', 322*d*', and reinforcing corner wall 328*c*', 328*d*' are folded along respective fold lines 315*c*' and 315*d*'. It should be noted that respective reinforcing corner panel 322*d*', 328*d*' fold onto respective reinforcing corner panel 322*c*', 322*d*' which provide double wall for the reinforcing corner wall 322, 328. Likewise, respective partial sidewall panels 352*a*", 352*b*" fold onto respective partial sidewall panels 352*a*', 352*b*' which provide double wall for the respective partial sidewall 352*a*, 352*b*. End panels 319*a*', 319*b*' fold onto the end wall panel 320' and thereby provide a stronger end wall 310 when the blank B3 is in the folded position.

Figure 17:
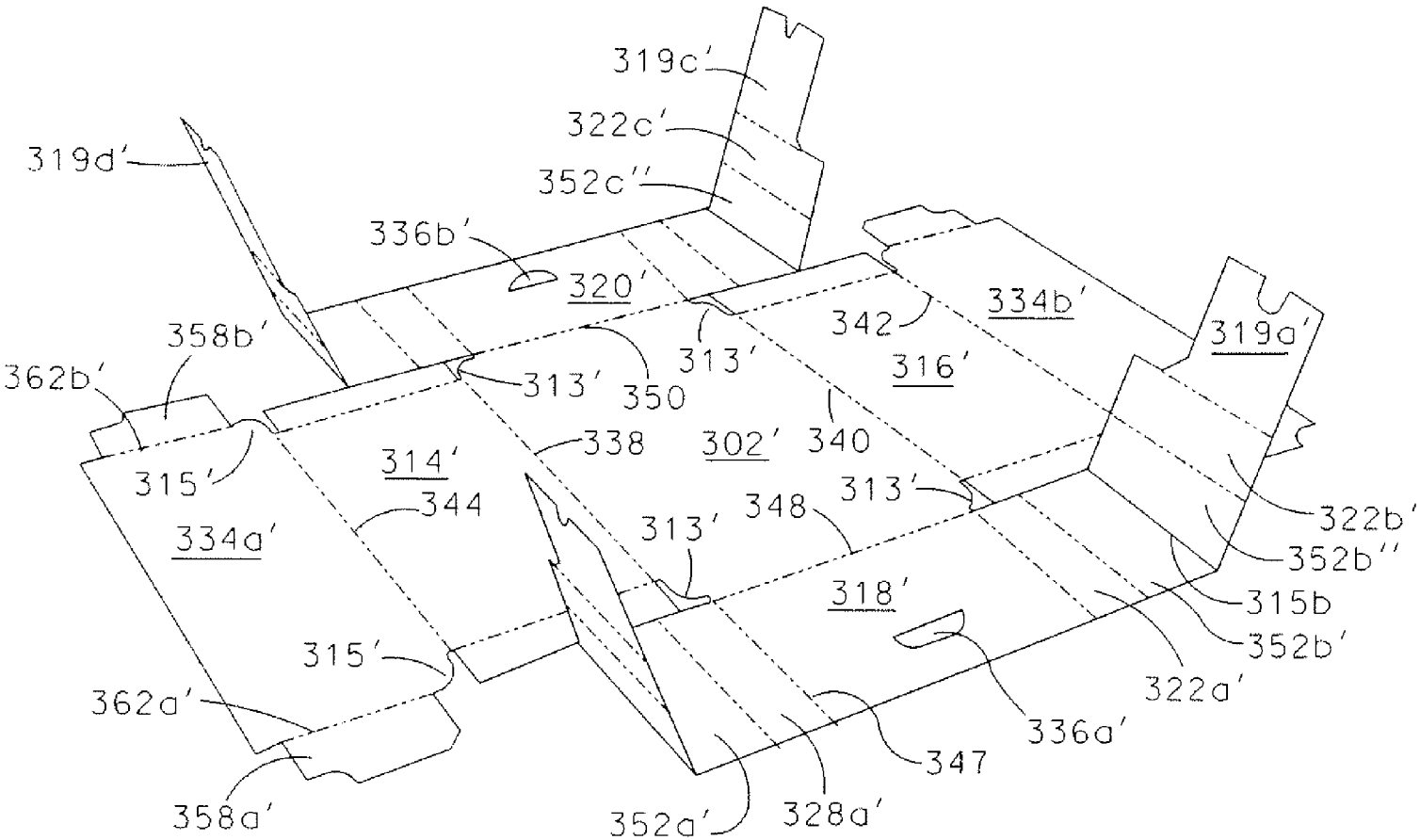
FIG. 17 is similar to FIG. 16 illustrating a portion of end pieces partially folded.
Figure 18:
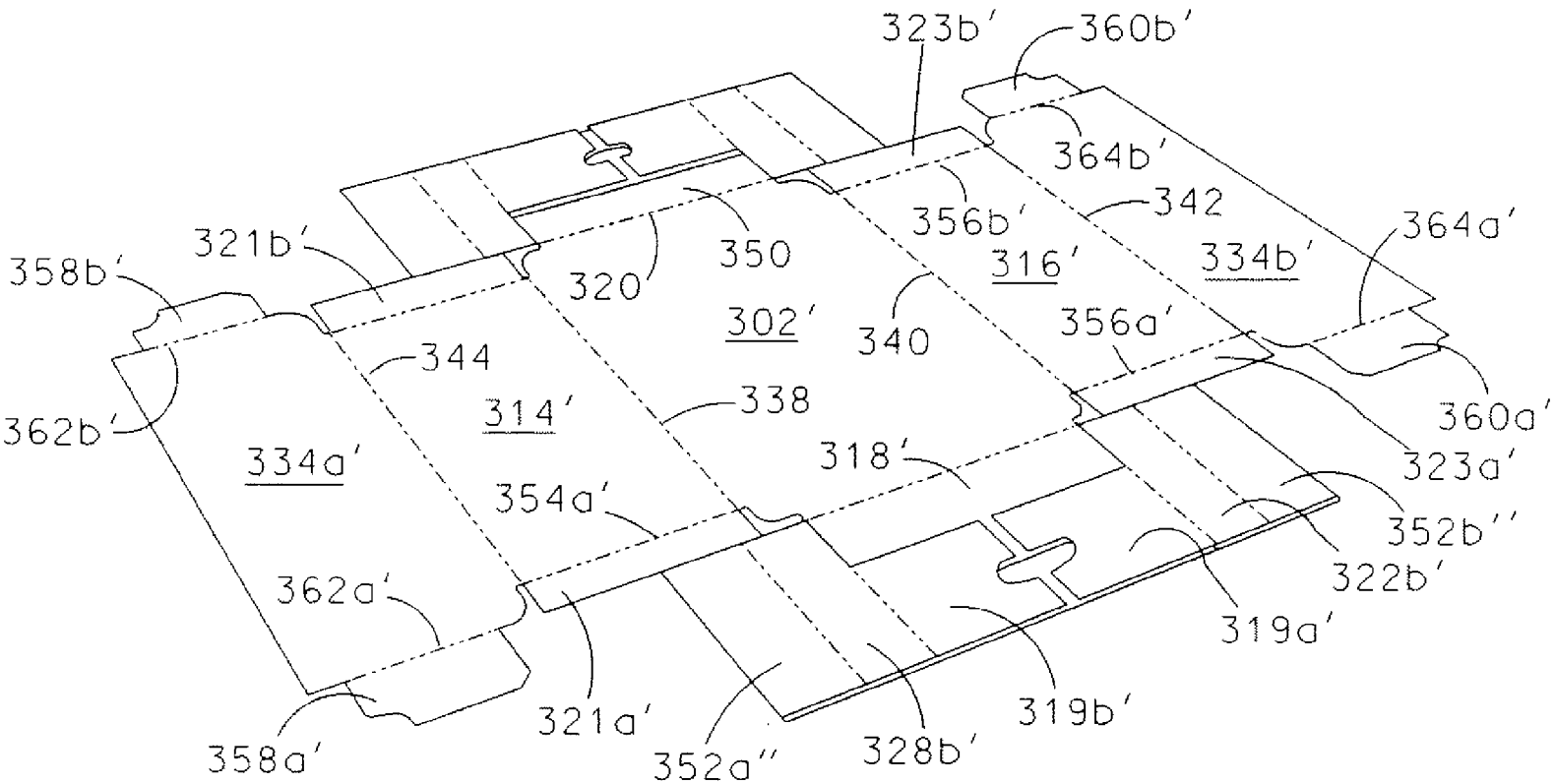
FIG. 18 is similar to FIG. 17 illustrating the end panels are folded onto the end wall panels.

Respective FIGS. 17, 18 are similar to FIG. 16, showing end panels 319*a*', 319*b*', 319*c*', 319*d*', reinforcing corner panels 322*b*', 322*c*', 328*b*', 328*c*' and partial sidewall panels 352*a*", 352*b*", 352*c*", 352*d*" in respective partially folded position and completely folded position with respect to their fold lines so that reinforcing corner panels 322*a*', 328*a*', 322*c*', 328*d*' and the partial sidewall panels 352*a*', 352*b*', 352*c*', 352*d*' are concealed by their respective identical panels as described hereinbefore.

FIG. 19 is similar to FIG. 17, showing the unitary blank B3 in a partially folded position by illustrating a portion of the unitary blank B3 formed into the end walls 308, 310 of the container 300 depicted in FIG. 15. Each of the end pieces 346*a*' and 346*b*' is folded 90° degrees with respect to bottom panel 302' along the fold lines 348 and 350. Then, the respective relatively narrow reinforcing doubled corner panels 322, 324 and 326, 328 are folded inwardly toward the bottom panel 302' at angles from about 33 to about 38 degrees so that each of the rounded corners 313' provides a greater base by increasing surface area for the reinforcing corner panels 322*a*', 322*b*' and 322*c*', 322*d*' to transmit pressure applied at those locations. Then, partial sidewall panels 352*a*', 352*b*', 352*c*', 352*d*' are folded with respect to fold lines 355, 357, 376, and 378 in a manner such that the bottom edges of the partial sidewall panels 352*a*', 352*b*', 352*c*', 352*d*' are respectively coincided with the fold line 338 and 340.

Figure 20:
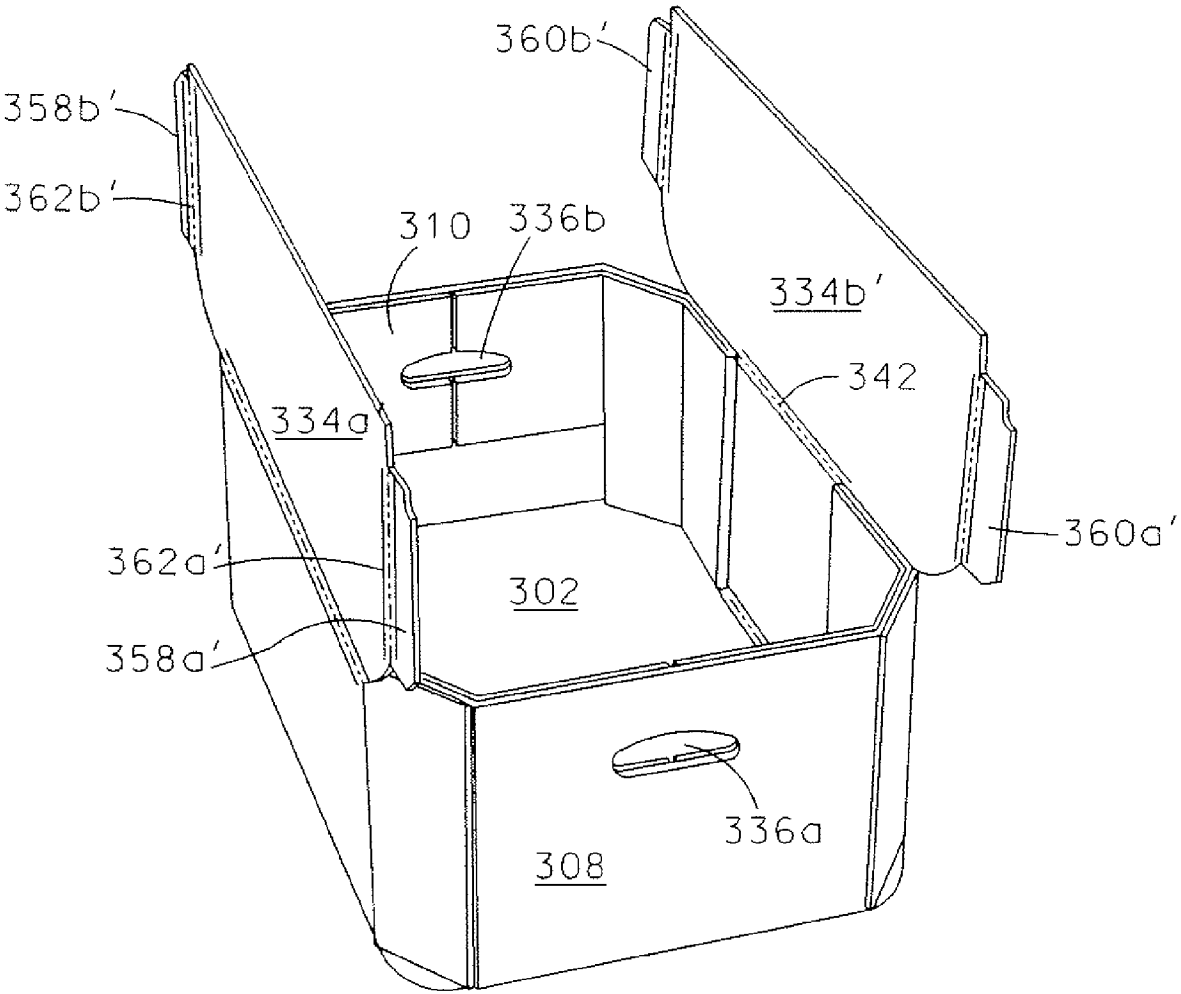
FIG. 20 is a perspective view of the fully constructed the multi-sided container formed from the blank B3 shown in FIG. 16 and illustrating the multi-sided container in FIG. 15 in a partially opened position.

FIG. 20 is a perspective view of the fully constructed multi-sided container 10 formed from the blank B3 shown in FIG. 16 and illustrating the container 300 in FIG. 15 in a partially opened position. The respective side wall forming panels 314' and 316' are folded at 90 degrees with respect to the panel 302' along the fold lines 338, 340 and configured to be attached with the respective partial sidewall panels 352*a*, 352*b* and 352*c*, 352*d* so that the respective side wall forming panels 314' and 316' and the respective partial sidewall 352*a*, 352*b* and 352*c*, 352*d* are glued to one another. Next, the respective top wall panels 334*a*', 334*b*' are folded along respective fold lines 342, 344 to form top wall 34*a*, 34*b* as depicted in FIG. 20. The respective flaps 358*a*, 358*b*, 360*a*, 360*b* are folded along the respective fold lines 362*a*, 362*b*', 364*a*', 364*b*' and glued over the end walls 318 & 320.

Figure 24:
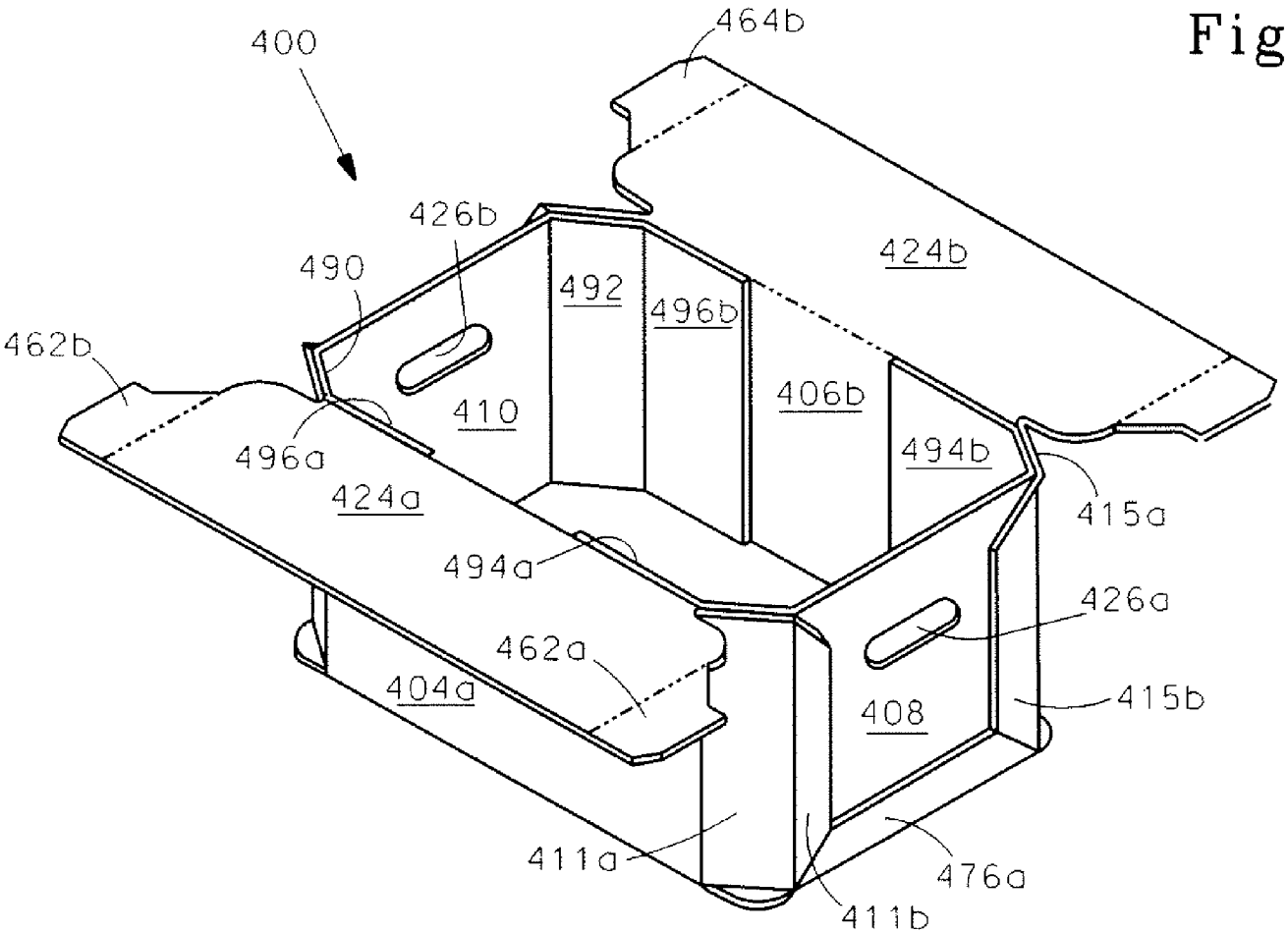
FIG. 24 is a perspective view of the fully constructed three-piece container depicted in FIG. 24 showing the wrapper blank folded and glued against the end pieces to form the bottom wall and side walls of the container.

FIG. 24 is a top perspective view of a container 400 in accordance with a fifth embodiment of the invention. The container 400 comprises a bottom wall 402, opposite parallel side walls 404, 406 opposite parallel end walls 408, 410 and diagonal corner panels 412, 414, 416 and 418 connecting the respective side walls 404, 406 and respective end walls 408, 410 at adjacent ends. The diagonal corner walls 412, 414, 416 and 418 extend at an angle generally ranges from about 33 to 38 degrees with respect to the longitudinal axis of the container 400. Each of the respective diagonal corner walls 412, 414, 416 and 418 is defined by a respective diagonal panel and a reinforcement flap. For example, the diagonal corner wall 412 is defined by a diagonal panel 486' and a reinforcement flap 411*a*' and the diagonal corner wall 414 is defined by diagonal panel 488' and a reinforcement flap 415*a*'. The other two diagonal walls 416 and 418 are the same as diagonal walls 412, 414 except on the opposite side of the container. Each longitudinal end of the respective side walls 404, 406 includes reinforcement flaps 411*a*', 413*a*' and end flaps 411*b*', 413*b*'. For example, each short side of the side wall 404*a*' has respective reinforcement flaps 411*a*', 413*a*' and end flaps 411*b*', 413*b*'. Similarly, short side of the side wall 406*a*' has respective reinforcement flaps 415*a*', 417*a*' and end flaps 415*b*', 417*b*'. The flaps 411*a*', 411*b*' are defined by a fold line 419. The flaps 413*a*, 413*b* are defined by a fold line 421. The flaps 415*a*, 415*b* are defined by a fold line 423. The flaps 417*a*, 417*b* are defined by a fold line 424. The opposite width of the respective side walls 404 and 406 is such that the flaps 411*a*', 415*a*' project beyond the entire surface of the diagonal corner walls 412, 414 terminating their edges at the respective end walls 408, 410. Two top walls 424*a*, 424*b* are generally defined as top wall that encloses the container 400. The top wall 424*a* is integrally attached to the side wall 404 and the top wall 424*b* is integrally attached to the side wall 406, but one ordinary skill in the art would appreciate that it is within the scope of the present invention to use a single cover integrally attached to one of the side walls 404, 406 or end walls 408, 410 of the container 400. Alternatively, the top walls 424*a*, 424*b* may detachably cover the container 400. Two hand hole openings 426*a*, 426*b* are formed on the respective end walls 408, 410 to facilitate handling of the container 400.

Figure 21:
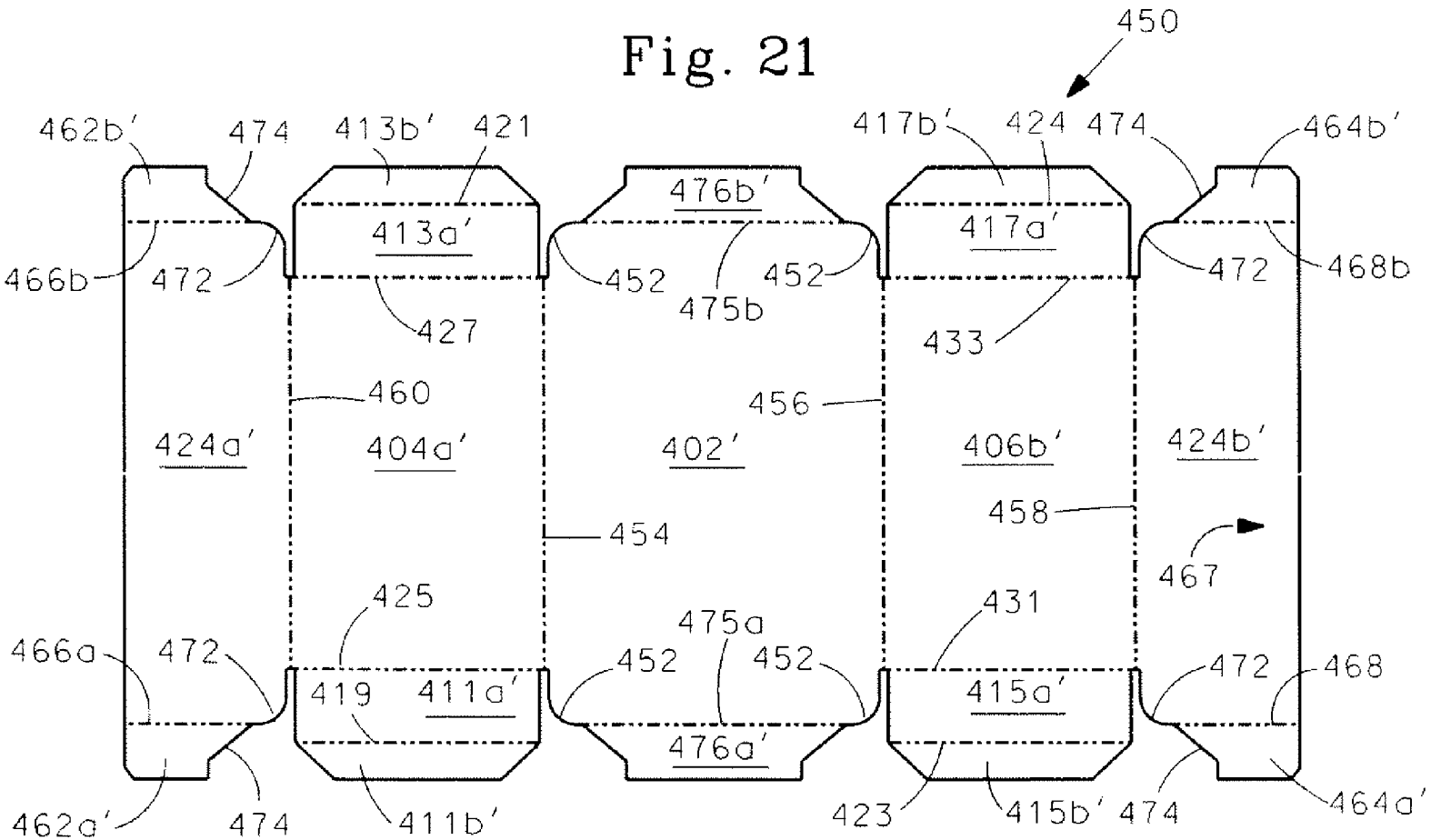
FIG. 21 is a plan view of a wrapper blank that forms the bottom wall, top and side walls of the three-piece container depicted in FIGS. 24 & 25.

FIG. 21 is a plan view of a wrapper blank 450 that forms the bottom wall panel 402, top walls 424*a*, 424*b* and side walls 404*a*, 406*b* of the three-piece container 400 depicted in FIG. 24 in accordance with the fifth embodiment of the invention. The wrapper blank 450 comprises a centrally located rectangular panel 402' that forms the bottom wall 402. The rectangular panel 402' has an advantage of having four identical rounded corners 452 which enhances the integrity of the container 400 when the wrapper blank 450 is folded. Side wall forming panels 404' and 406' are foldably joined to opposite side edges of the panel 402' by respective fold lines 454, 456. Each longitudinal end of the side wall panels 404*a*', 406*b*' includes a respective pair of diagonal panels 411*a*', 413*a*', reinforcement flaps 411*b*', 413*b*' and respective pair of diagonal panels 415*a*', 417*a*', and reinforcement flaps 415*b*', 417*b*'. The diagonal panel 411*a*' and reinforcement flap 411*b*' are defined by respective fold lines 419, 425. The diagonal panel 413*a*' and reinforcement flap 413*b*' are defined by fold lines 421, 427. The diagonal panel 415*a*' and reinforcement flap 415*b*' are defined by fold lines 423, 431. The diagonal panel 417*a*' and reinforcement flap 417*b*' are defined by fold lines 424, 433. Top wall panels 424*a*' and 424*b*' are foldably joined to respective long edges of the sidewall panels 404*a*' and 406*b*', opposite of their folded connection to the panel 402', by fold lines 458, 460. Each of the top wall panels 424*a*', 424*b*' includes two respective identical flaps 462*a*', 462*b*' and 464*a*', 464*b*' defined by respective fold lines 466*a*', 466*b*', and 468*a*', 468*b*'. The two respective identical flaps 462*a*', 462*b*' and 464*a*', 464*b*' are extended from short sides of the top wall panels 424*a*' and 424*b*'. An arrow mark 467 indicates the direction of corrugation of the wrapper blank 100. Similarly, each of the top wall panels 424*a*', 424*b*', as noted with respect to the rectangular panel 402', has an advantage of having two identical rounded corners 472 which enhances the integrity of the container 400 when the wrapper blank 450 is folded. In addition, it should be noted that one side edge 474 of each flaps 462*a*', 462*b*' and 464*a*', 464*b*' is tapered so that when these flaps are folded, the tapered 474 would align the tapered edges of the flaps 411*b*', 413*b*', 415*b*', and 417*b*'. A pair of flaps 476*a*', 476*b*' is foldably joined to respective transverse edges of the panel 402' by fold lines 475*a*', 475*b*'. The flaps 476*a*', 476*b*' are essentially identical to one another and they are mirror images of one another. The respective flaps 476*a*', 476*b*' are glued to the respective end walls 408, 410 when the wrapper blank 450 is folded to form the bottom wall 402, side walls 404, 406, and top walls 424*a* and 424*b*.

Figure 22:
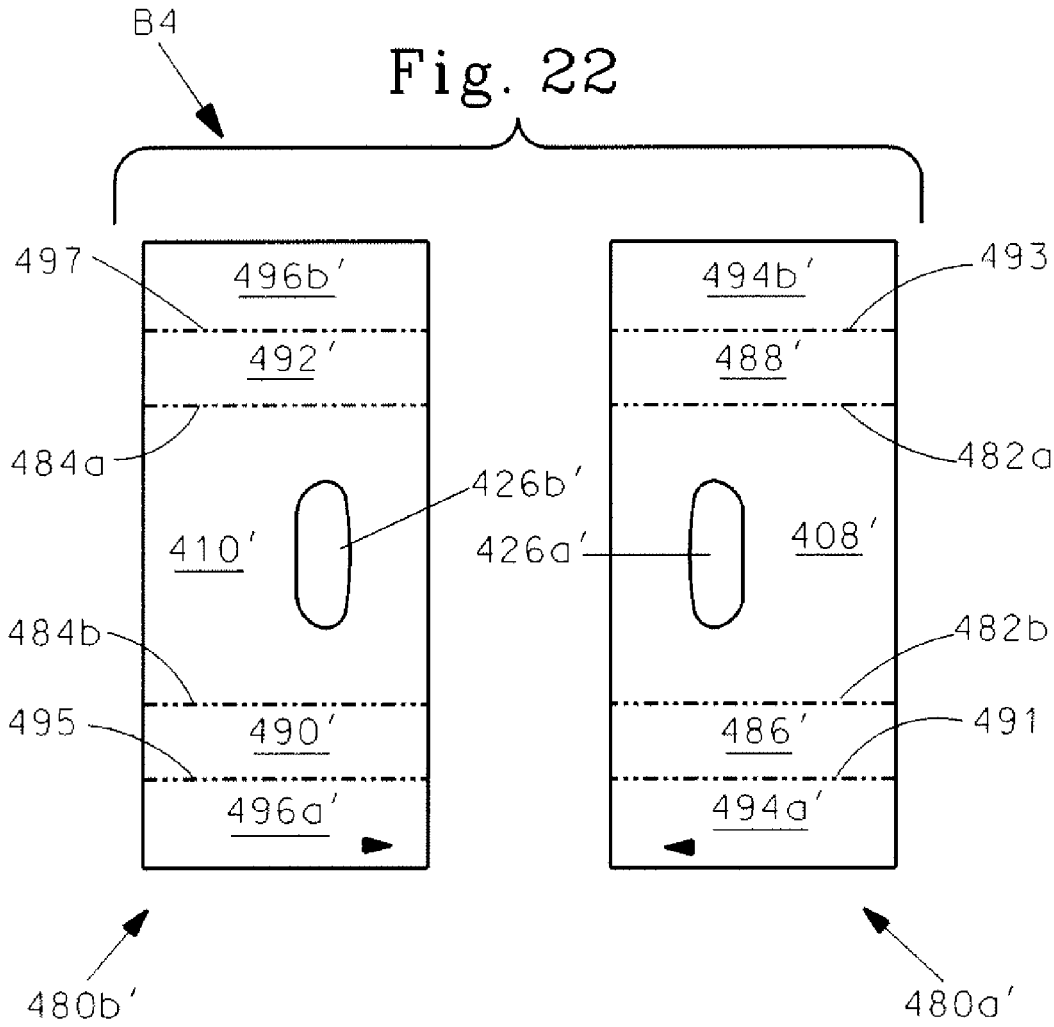
FIG. 22 is a plan view of a pair of blanks B4 that form the end pieces used to construct the three-piece multi-sided container depicted in FIGS. 24 & 25.

FIG. 22 is a plan view of a pair of blank B4 includes blank 480*a*' and blank 480*b*' which each form the end walls 408 and 410 used to construct the three-piece container 400 depicted in FIG. 24. The pair of end pieces 480*a*' and 480*b*' is attached to respective transverse edges of the panel 402'. The end pieces 480*a*' and 480*b*' are essentially identical to one another and they are mirror images of one another. The end piece 480*a*' includes an end wall panel 408', two relatively narrow reinforcing corner panels 486' and 488' foldably joined to opposite ends of the panel 408' by fold lines 482*a*', 482*b*', and second partial sidewall panels 494*a*', 494*b*' are foldably joined to outer edges of respective narrow reinforcing corner panels 486' and 488' by fold lines 491 and 493. Similarly, The end piece 480*b*' includes an end wall panel 410', two relatively narrow reinforcing corner panels 490' and 492' foldably joined to opposite ends of the panel 410' by fold lines 484*a*', 484*b*', and second partial sidewall panels 496*a*', 496*b*' are foldably joined to outer edges of respective narrow reinforcing corner panels 490' and 492' by fold lines 495 and 497. Openings 426*a*', 426*b*' are formed on the respective end wall panels 408', 410' so that when the end pieces 480*a*', 480*b*' are folded, these openings 426*a*', 426*b*' forms the hand hole openings 426*a*, 426*b* in the container 400 as described with reference to FIG. 24.

Figure 23:
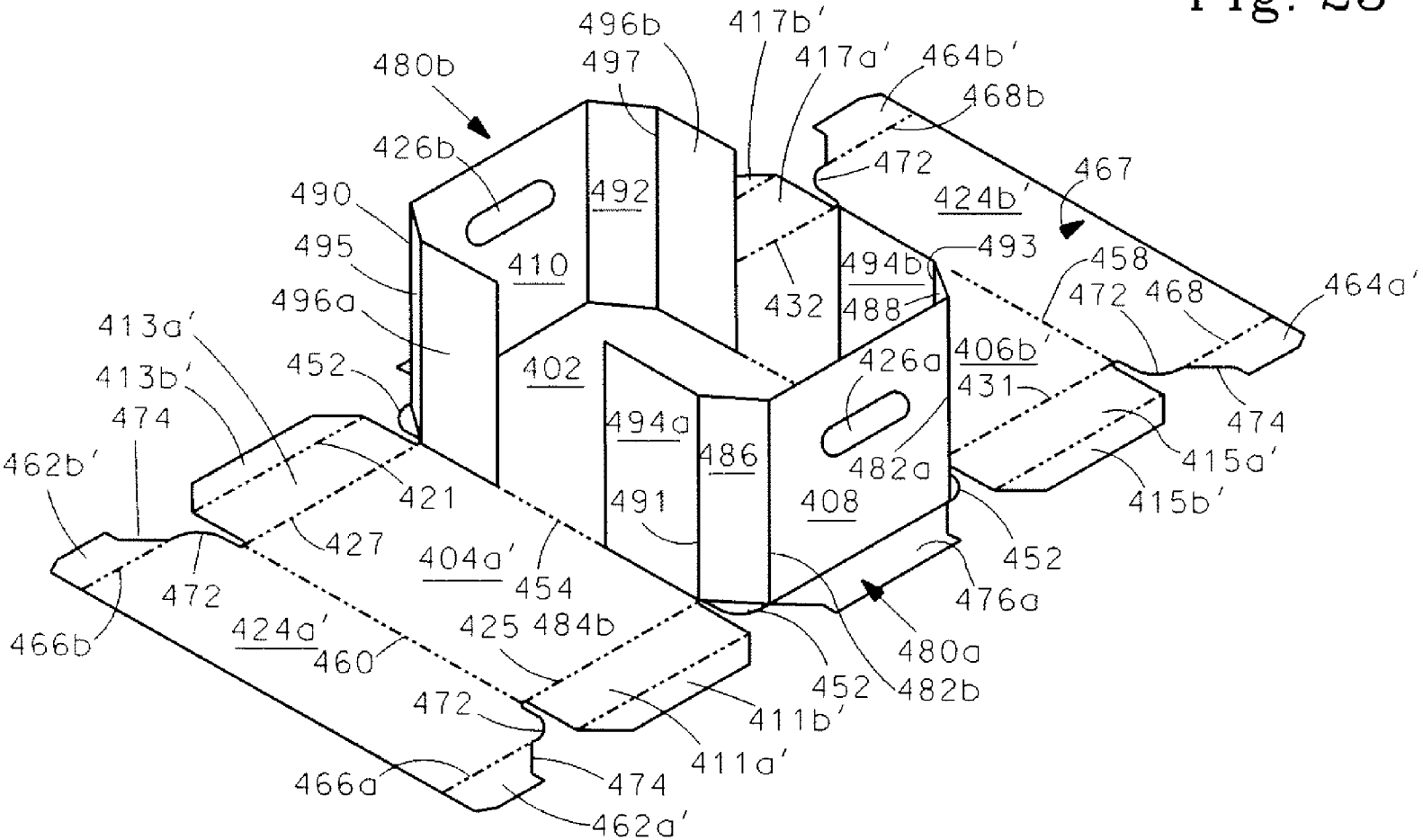
FIG. 23 is a top perspective view of the end pieces located in their operative positions on the wrapper blank shown in FIG. 22, and illustrating the wrapper blank in the folding position around the end pieces.

FIG. 23 is a top perspective view of the end pieces 480*a*, 480*b* located in their operative positions on the wrapper blank 450 shown in FIG. 22 and illustrating the wrapper blank 450 in the folding position around the end walls pieces 480*a*, 480*b*. The end pieces 480*a*, 480*b* are folded along their respective fold lines 482*a*, 482*b* and 484*a*, 484*b*. The respective relatively narrow reinforcing corner panels 486, 488 and 490, 492 are folded inwardly toward the bottom panel 402 at approximately 45 degrees so that the rounded corners 452 provides a greater base by increasing surface area for the reinforcing corner panels 486, 488 and 490, 492 to transmit pressure applied at those location. Then, partial sidewall panels 494*a*, 494*b*, 496*a*, 496*b* are folded with respect to fold lines 491, 493, 495, and 497 in a manner such that the bottom edges of the partial sidewall panels 494*a*, 494*b*, 496*a*, 496*b* are respectively coincided with the fold line 454 and 456.

Figure 25:
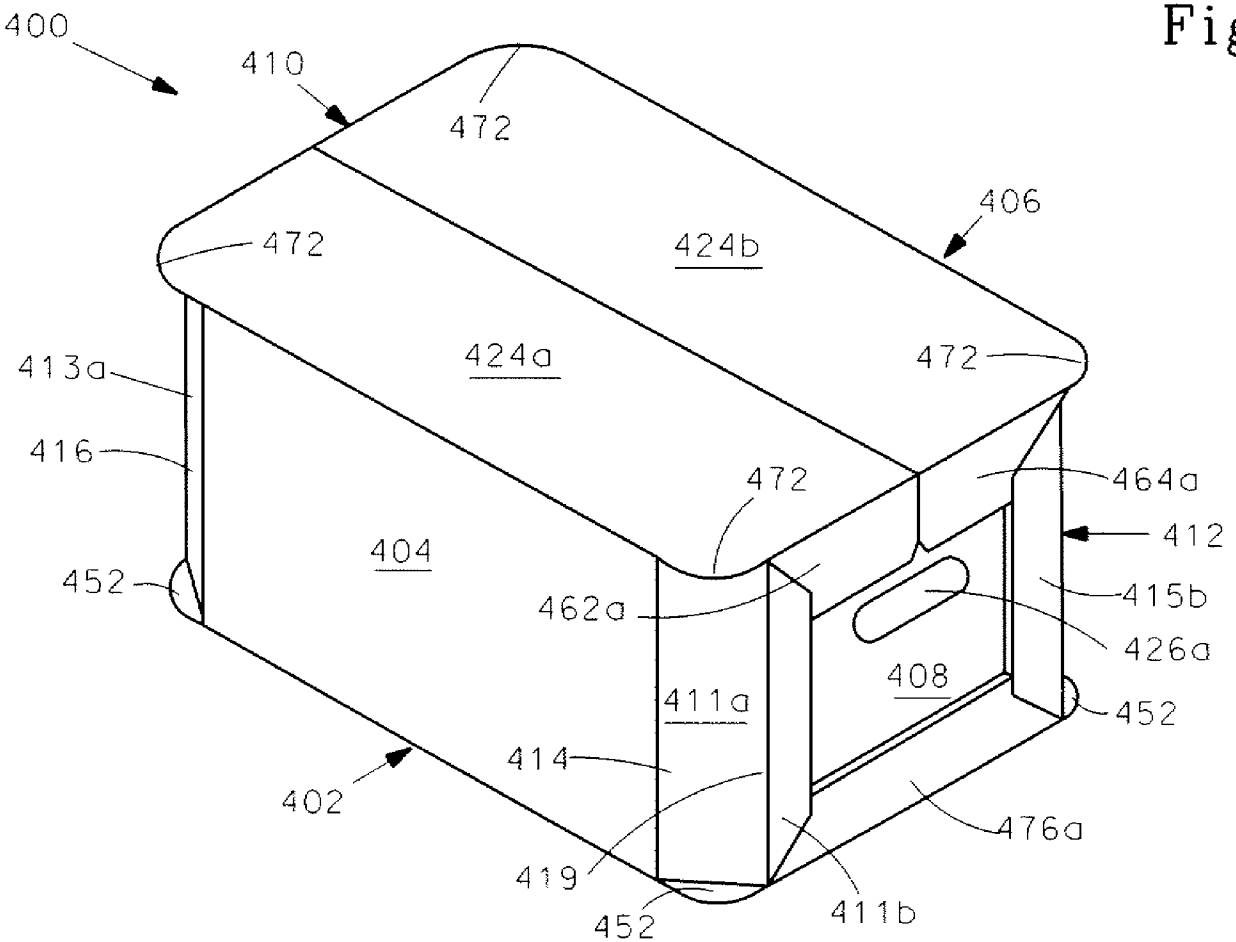
FIG. 25 is a top perspective view of a three pieces multi-sided container in accordance with a fifth embodiment of the invention.

FIG. 25 is a perspective view of the fully constructed three-piece container 400 depicted in FIG. 24 showing the wrapper blank 450 folded and glued against the end pieces 480*a*, 480*b* to form the bottom wall 402 and side walls 404, 406 of the container 400. The respective side wall forming panels 404*a*' and 406*b*' are folded at 90 degrees with respect to the panel 402' along the fold lines 454, 456 and configured to be attached with the respective partial sidewall panels 494*a*, 494*b* and 496*a*, 496*b* so that the respective side wall forming panels 404*a*' and 406*b*' and the respective partial sidewall 494*a*, 494*b* and 496*a*, 496*b* are glued to one another. Then the flaps 476*a*', 476*b*' are glued to the respective end walls 408, 410. Next, the respective top wall panels 424*a*', 424*b*' are folded along respective fold lines 458, 460 to form top wall 424*a*, 424*b* as depicted in FIG. 21. The respective flaps 462*a*', 462*b*', 464*a*', 464*b*' are folded along the respective fold lines 466*a*, 466*b*, 468*a*, 468*b* and are glued to the end walls 408 & 410.

Figure 27A:
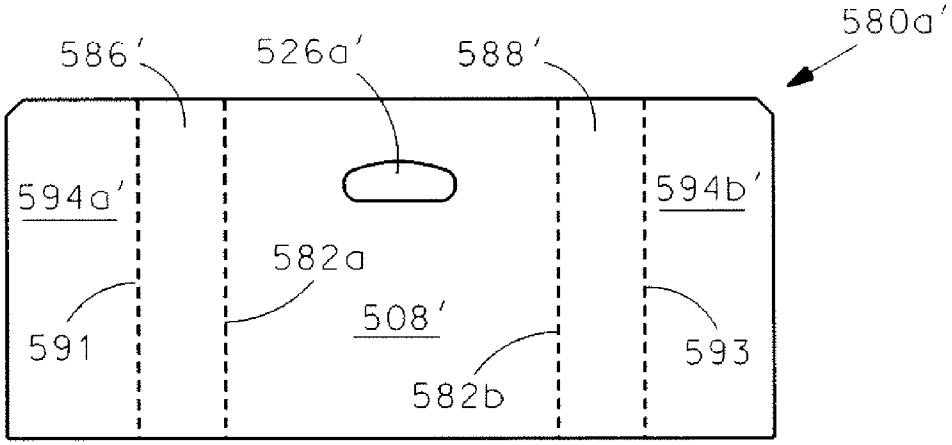
FIG. 27A-B is a plan view of one of a pair of blanks that form the tray bliss end pieces used to construct the three-piece container depicted in FIG. 25.
Figure 27B:
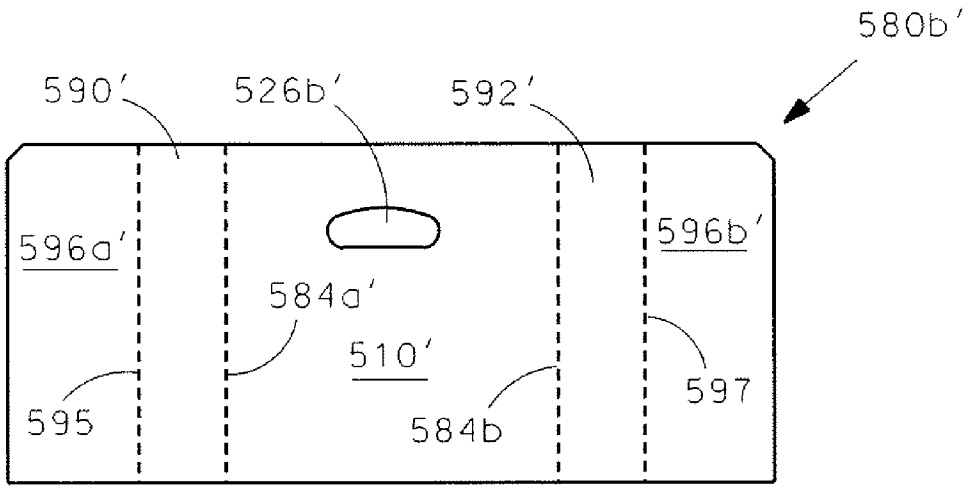
Figure 28:
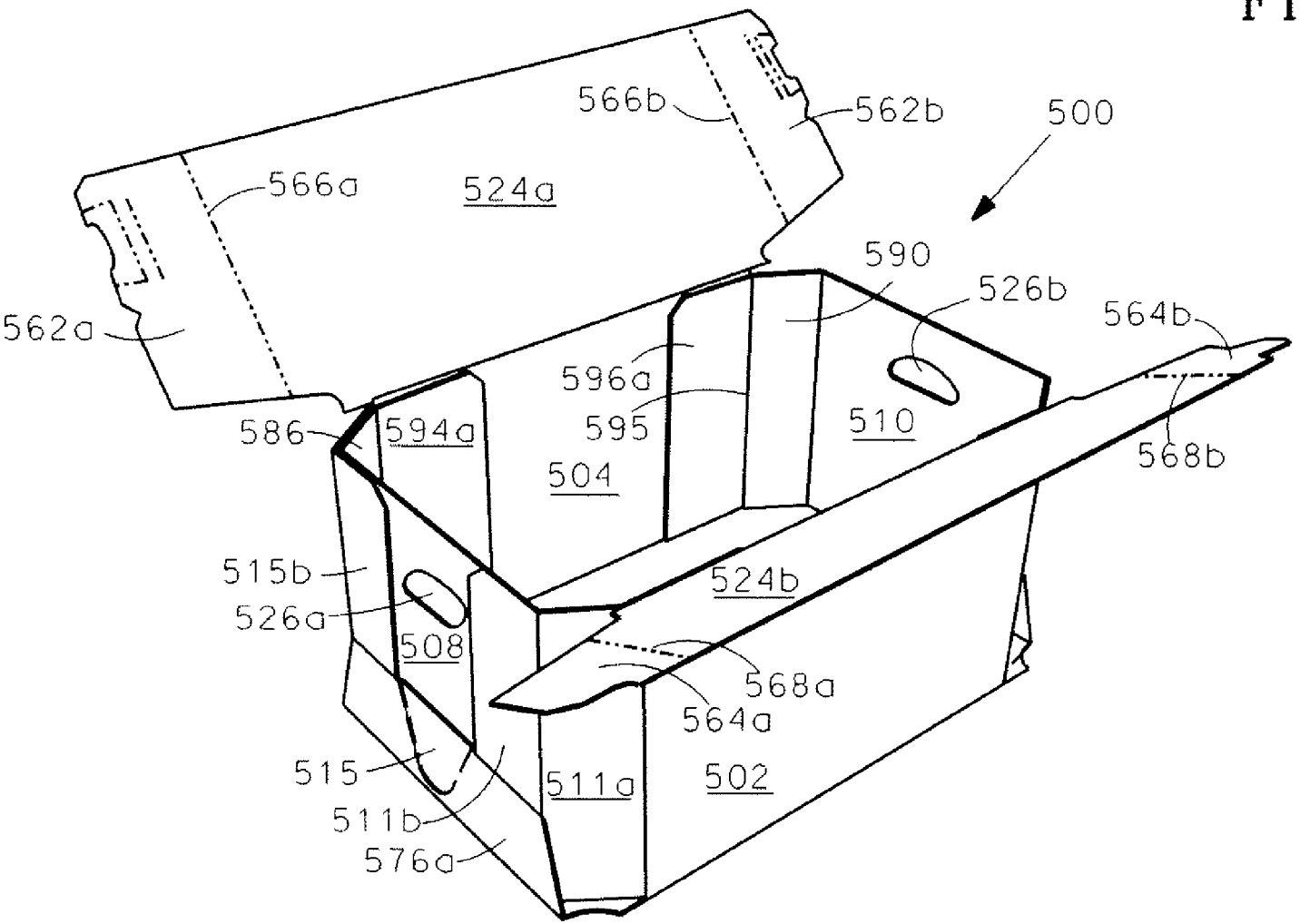
FIG. 28 is a top perspective view of a three pieces multi-sided container in accordance with a six embodiment of the invention in an opened position.
Figure 29:
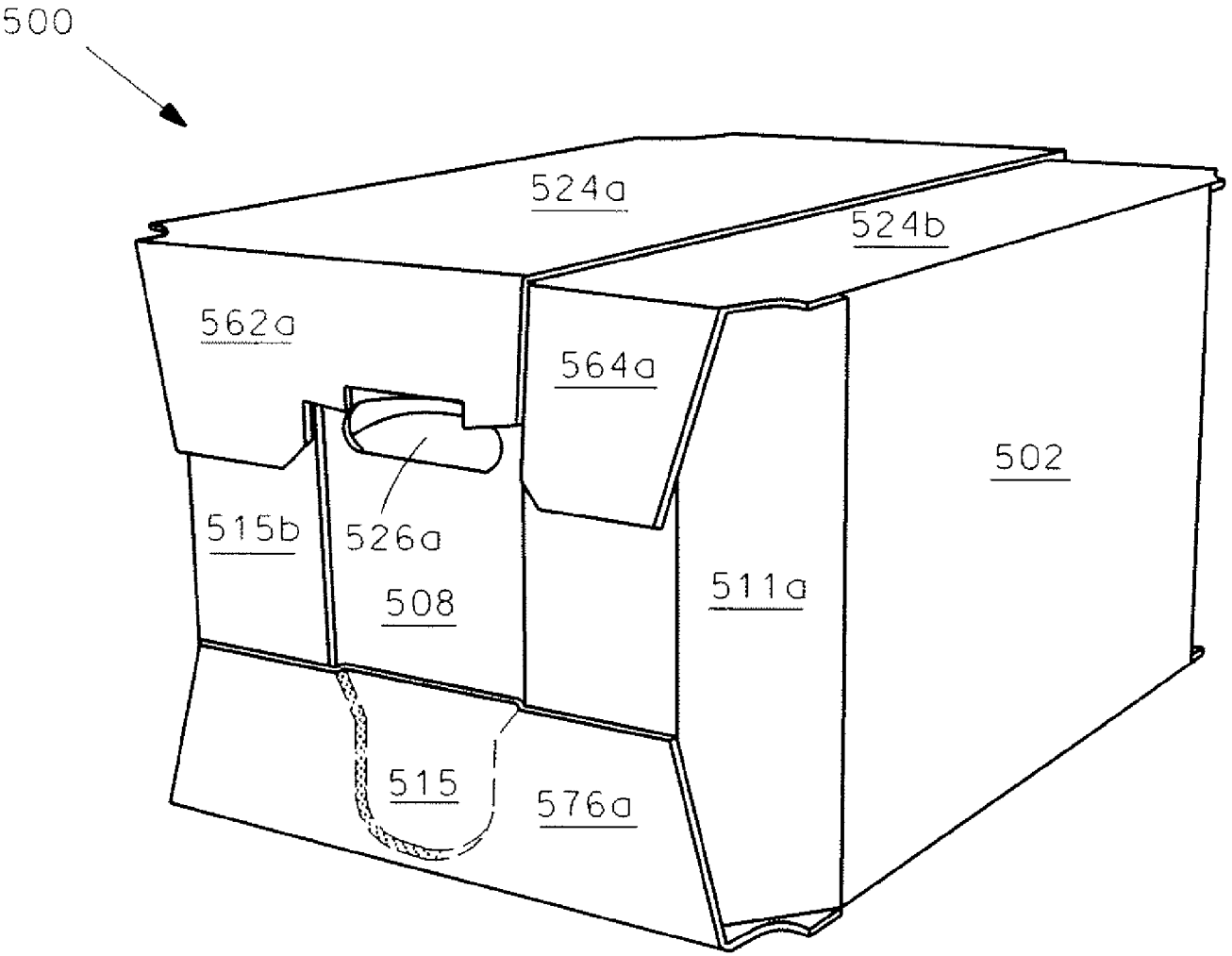
FIG. 29 is the same as FIG. 28, illustrating the three pieces multi-sided container in a closed position.

FIG. 28 is a top perspective view of a three piece container 500 in accordance with a fifth embodiment of the invention in an opened position showing the wrapper blank 550 folded and glued against the end pieces 580*a*, 580*b* to form the bottom wall 502 and side walls 504, 506 of the container 500. The respective side wall forming panels 504*a*' and 506*b*' are folded at 90 degrees with respect to the panel 502' along the fold lines 554, 556 and configured to be attached with the respective partial sidewall panels 594*a*, 594*b* and 596*a*, 596*b* so that the respective side wall forming panels 504*a*' and 506*b*' and the respective partial sidewall 594*a*, 594*b* and 596*a*, 596*b* are glued to one another. Next, the respective top wall panels 524*a*', 524*b*' are folded along respective fold lines 558, 560 to form top wall 524*a*, 524*b* as depicted in FIG. 27. The respective flaps 562*a*', 562*b*', 564*a*', 564*b*' are folded along the respective fold lines 566*a*, 566*b*, 568*a*, 568*b* and fold out the container 500. Then the flaps 576*a*', 576*b*' are glued to the respective end walls 508, 510. It should be noted that Tray/Bliss wrapper 550 "outside bottom end sealing flap 576" is split into 3 sections, but with a crushed and scored area 515 instead of with slits or slots. This yields a full width, relatively smooth and straight label surface. The mid section of the Tray/Bliss wrapper 550 "outside bottom end sealing flap" is bordered by a crushed zone that allows the center portion 515 to be pushed inward to secure to the Tray/Bliss end Panel 576. FIG. 29 is the same as FIG. 28, illustrating the three pieces container 500 in a closed position.

Figure 26:
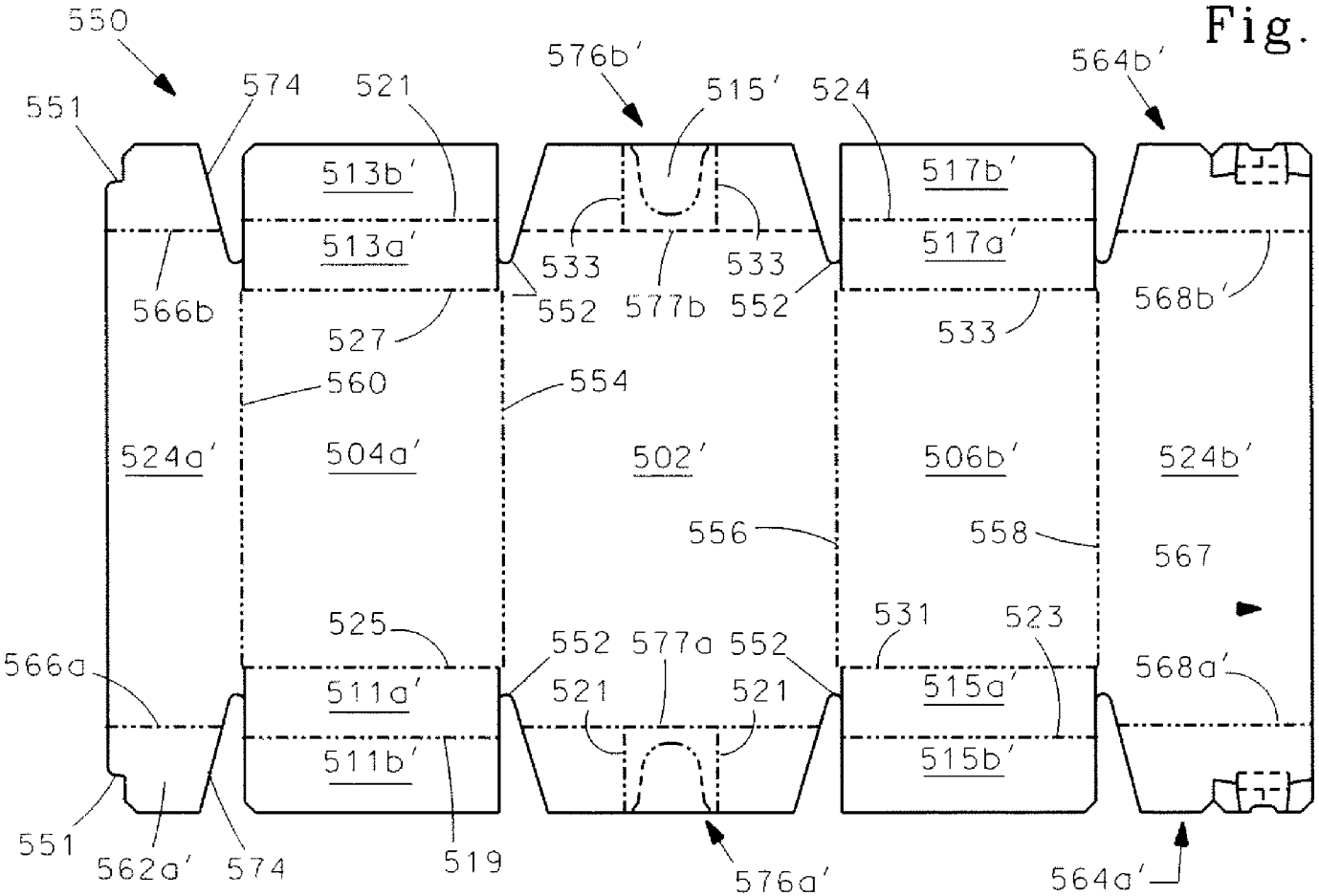
FIG. 26 is a plan view of an eight corners 37 degrees angles tray bliss arc/perf wrapper blank having hand holes lock that forms the bottom wall, top and side walls of a three pieces container similar to the three pieces container depicted in FIG. 29 in accordance with a seventh embodiment of the invention.

FIG. 26 is a plan view of an eight corners 37 degrees angles tray bliss arc/perf wrapper blank 550 having hand holes lock 551 that forms the bottom wall 502', top and side walls 524*a*', 504*a*' & 506*b*' of a the three piece container 500 depicted in FIG. 27 in accordance with a six embodiment of the invention. The wrapper blank 550 comprises a centrally located rectangular panel 502' that forms the bottom wall 502. The rectangular panel 502' has an advantage of having four identical rounded corners 552 which enhances the integrity of the container 500 when the wrapper blank 550 is folded. Side wall forming panels 504' and 506' are foldably joined to opposite side edges of the panel 502' by respective fold lines 554, 556. Each longitudinal end of the side wall panels 504*a*', 506*b*' includes a respective pair of reinforcement flaps 511*a*', 511*b*', 513*a*', 513*b*' and 515*a*', 515*b*', 517*a*' 517*b*'. The reinforcement flap 511*a*', 511*b*' are defined by fold lines 519, 525. The reinforcement flaps 513*a*', 513*b*' are defined by fold lines 521, 527. The reinforcement flaps 515*a*', 515*b*' are defined by fold lines 523, 531. The reinforcement flaps 517*a*', 517*b*' are defined by fold lines 524, 533. Top wall panels 524*a*' and 524*b*' are foldably joined to respective longitudinal edges of the sidewall panels 504*a*' and 506*b*', opposite of their folded connection to the panel 502', by fold lines 558, 560. Each of the top wall panels 524*a*', 524*b*' includes two respective identical flaps 562*a*', 562*b*' and 564*a*', 564*b*' defined by respective fold lines 566*a*', 566*b*', and 568*a*', 568*b*'. An Arrow mark 567 indicates the direction of corrugation of the wrapper blank 550. Similarly, each of the top wall panels 524*a*', 524*b*', as noted with respect to the rectangular panel 502', has an advantage of having two identical rounded corners 572 which enhances the integrity of the container 500 when the wrapper blank 550 is folded. In addition, it should be noted that one side edge 574 of each flaps 562*a*', 562*b*' and 564*a*', 564*b*' is tapered so that when these flaps are folded, the tapered 547 would align the tapered edges of the flaps 511*b*', 513*b*', 515*b*', and 517*b*'. A pair of flaps 576*a*', 576*b*' is foldably joined to respective transverse edges of the panel 502' by fold lines 577*a*', 577*b*'. The flaps 576*a*', 576*b*' are essentially identical to one another and they are mirror images of one another. Each of the flaps 576*a*', 576*b*' is split into three sections by fold lines 521, 531 with a crushed and scored area 515. This yield a full width, relatively smooth and straight label surface. The mid section of the Tray/Bliss wrapper 550 "outside bottom end sealing flap" is bordered by a crushed zone that allows the center portion 515 to be pushed inward to secure to the Tray/Bliss end Panel 576. The respective flaps 576*a*', 576*b*' are glued to the respective end walls 508, 510 when the wrapper blank 550 is folded to form the bottom wall 502, side walls 504, 506, and top walls 524*a* and 524*b*. It should be noted that it is preferred that the corners angle of tray bliss be 33 or 37 degrees, however, other angles such as 30, 31, 32, 34, 35, 36, 38, 39, 40, 41, 42, 43, 44 degrees are within the scope of the invention.

FIGS. 27A-B is a plan view of one of a pair of blanks 580 that form the tray bliss end pieces used to construct the three-piece container depicted in FIG. 25. One of the pair of end pieces 580*a*' and 580*b*' is attached to respective transverse edges of the panel 502'. The end pieces 580*a*' and 580*b*' are essentially identical to one another and they are mirror images of one another. The end piece 580*a*' includes an end wall panel 508', two relatively narrow reinforcing corner panels 586' and 588' foldably joined to opposite ends of the panel 508' by fold lines 582*a*', 582*b*', and second partial sidewall panels 594*a*', 594*b*' are foldably joined to outer edges of respective narrow reinforcing corner panels 586' and 588' by fold lines 591 and 593. Similarly, The end piece 580*b*' includes an end wall panel 510', two relatively narrow reinforcing corner panels 590' and 592' foldably joined to opposite ends of the panel 510' by fold lines 584*a*', 584*b*', and second partial sidewall panels 596*a*', 596*b*' are foldably joined to outer edges of respective narrow reinforcing corner panels 590' and 592' by fold lines 595 and 597. Openings 562*a*', 562*b*' are formed on the respective end wall panels 508', 510' so that when the end pieces 580*a*', 580*b*' are folded, these openings 562*a*', 562*b*' forms the hand hole openings 562*a*, 562*b* in the container 500 as described with reference to FIG. 27.

Figure 30:
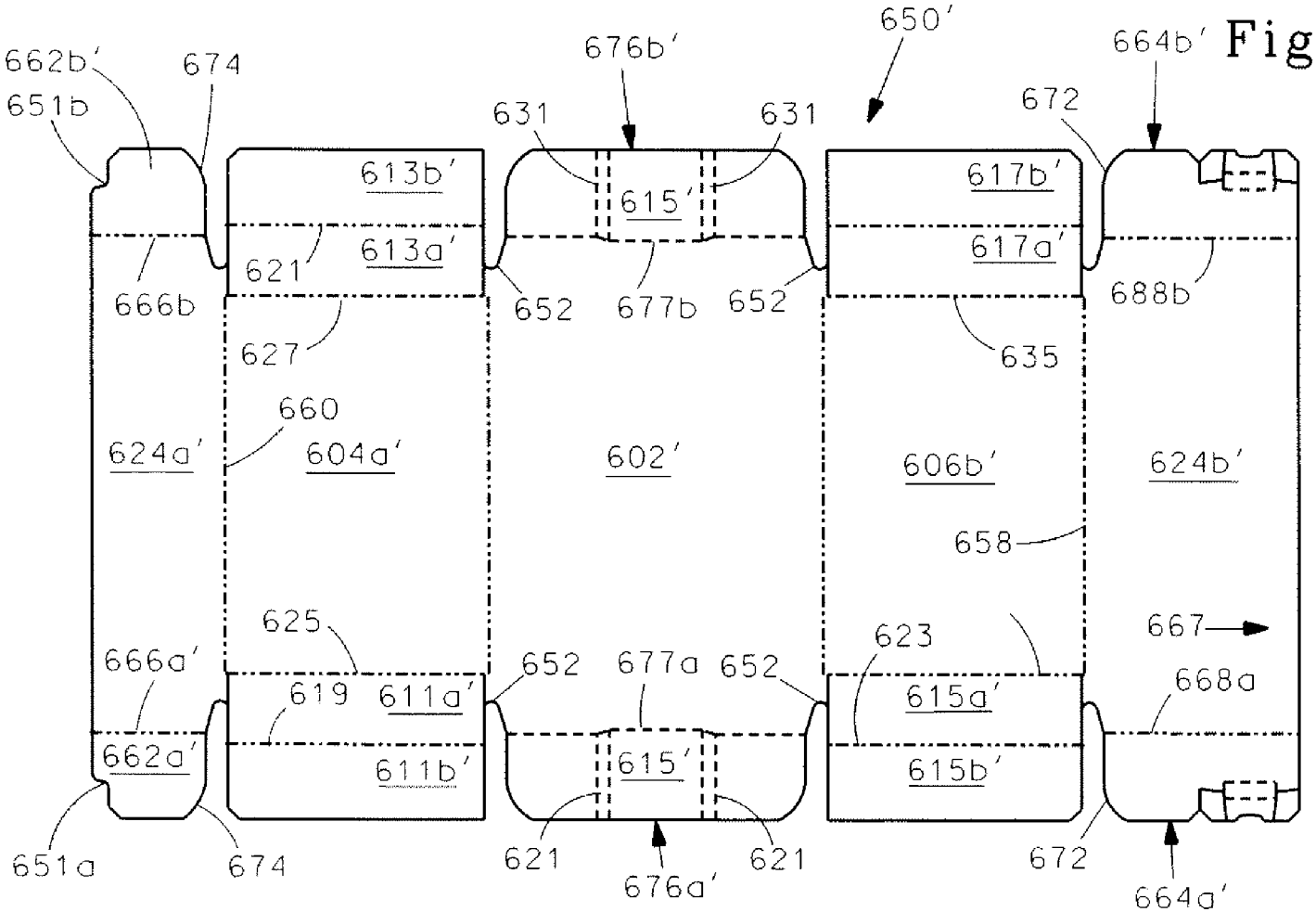
FIG. 30 is a plan view of a eight corners 33 degrees angles tray bliss wrapper blank having hand holes lock that forms the bottom wall, top and side walls of a three pieces multi-sided container similar to the three pieces container depicted in FIG. 31 in accordance with an eighth embodiment of the invention.
Figure 31:
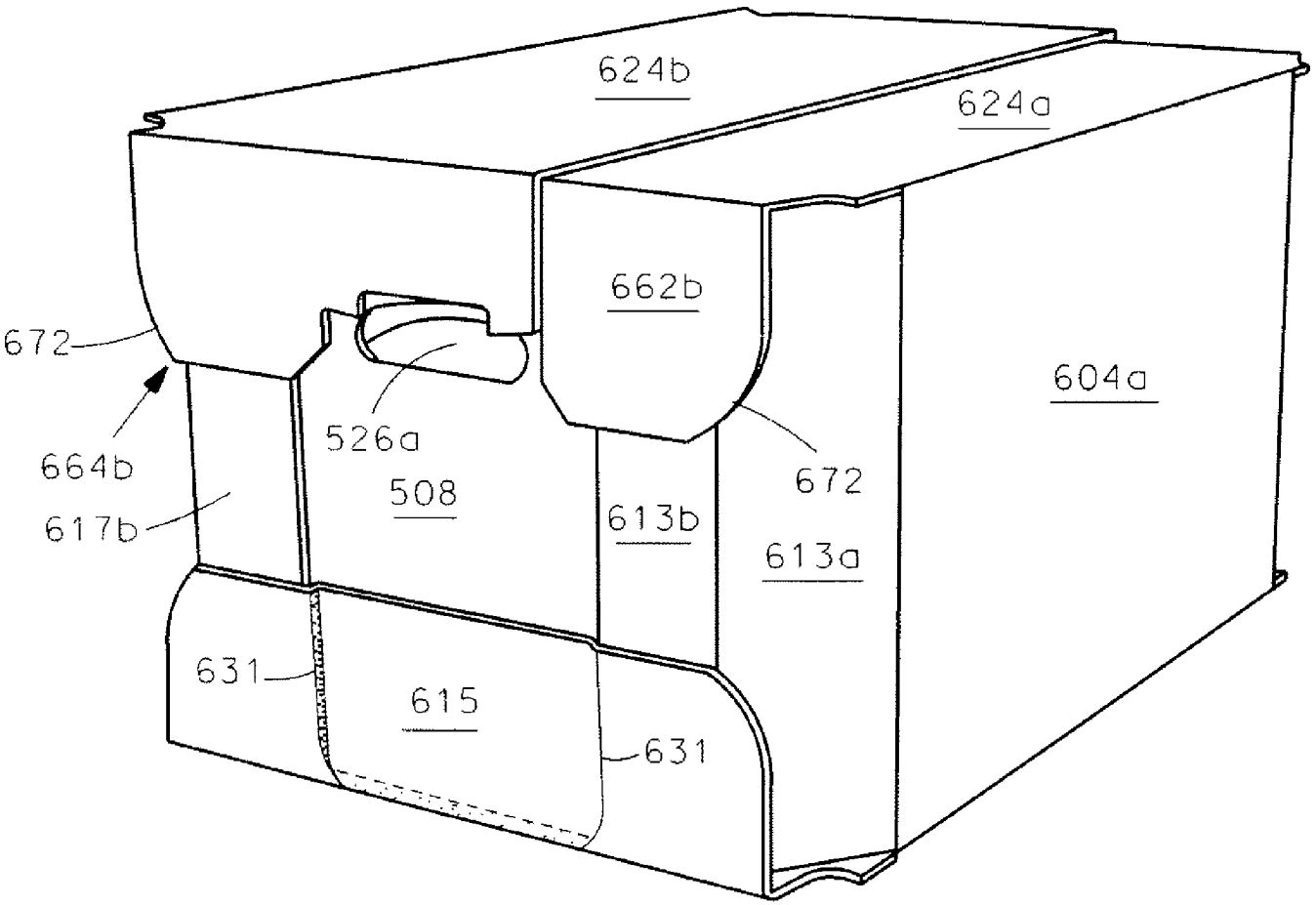
FIG. 31 is a perspective view of the fully constructed three-piece multi-sided container of the tray bliss wrapper blank of FIG. 30, illustrating the three pieces multi-sided container in a closed position.

FIG. 30 is a plan view of a eight corners 33 degrees angles tray bliss wrapper blank 650 having hand hole locks 651 that forms the bottom wall 602', respective top and side walls 624*a*', 624*b*' and 604*a*', 606*b*' of a three piece container similar to the three pieces container depicted in FIG. 31 in accordance with a seventh embodiment of the invention. The wrapper blank 650 comprises a centrally located rectangular panel 602' that forms the bottom wall 602. The rectangular panel 602' has an advantage of having four identical rounded corners 652 which enhances the integrity of the container 600 when the wrapper blank 650 is folded. Side wall forming panels 604' and 606' are foldably joined to opposite side edges of the panel 602' by respective fold lines 654, 656. Each longitudinal end of the side wall panels 604*a*', 606*b*' includes a respective pair of reinforcement flaps 611*a*', 611*b*', 613*a*', 613*b*' and 615*a*', 615*b*', 617*a*' 617*b*'. The reinforcement flap panels 611*a*', 611*b*' are defined by fold lines 619, 625. The reinforcement flaps 613*a*', 613*b*' are defined by fold lines 621, 627. The reinforcement flaps 615*a*', 615*b*' are defined by fold lines 623, 631. The reinforcement flaps 617*a*', 617*b*' are defined by fold lines 624, 633. Top wall panels 624*a*' and 624*b*' are foldably joined to respective longitudinal edges of the sidewall panels 604*a*' and 606*b*', opposite of their folded connection to the panel 602', by fold lines 658, 660. Each of the top wall panels 624*a*', 624*b*' includes two respective identical flaps 662*a*', 662*b*' and 664*a*', 664*b*' defined by respective fold lines 666*a*', 666*b*', and 668*a*', 668*b*'. An Arrow mark 667 indicates the direction of corrugation of the wrapper blank 650. Similarly, each of the top wall panels 624*a*', 624*b*', as noted with respect to the rectangular panel 602', has an advantage of having two identical rounded corners 672 which enhances the integrity of the container 600 when the wrapper blank 650 is folded. In addition, it should be noted that one side edge 674 of each flaps 662*a*', 662*b*' and 664*a*', 664*b*' is tapered so that when these flaps are folded, the tapered 674 would align the tapered edges of the flaps 611*b*', 613*b*', 615*b*', and 617*b*'. A pair of flaps 677*a*', 677*b*' is foldably joined to respective transverse edges of the panel 602' by fold lines 676*a*', 676*b*'. The flaps 676*a*', 676*b*' are essentially identical to one another and they are mirror images of one another. Each of the flaps 676*a*', 676*b*' is split into three sections by fold lines 621, 631 with two crushed and scored area 615. The mid section of the wrap "outside bottom end sealing flap" has an inwardly offset bottom score line. This inward offset pushes the mid section in to be adhered to the Tray/Bliss end. This yields a full width, relatively smooth and straight label surface. The mid section of the Tray/Bliss wrapper 650 "outside bottom end sealing flap" is bordered by a crushed zone that allows the center portion 615 to be pushed inward to secure to the Tray/Bliss end Panel 676. Because the Tray/Bliss wrap "outside bottom end sealing flap" mid section bottom score line is offset inward, and the mid sections sides are still connected to the outer portions of the panel the wrap bottom mid section may bulge downward creating an unstable bottom stacking surface on a lightly loaded package. The respective flaps 676*a*', 676*b*' are glued to the respective end walls 608, 610 when the wrapper blank 650 is folded to form the bottom wall 602, side walls 604, 606, and top walls 624*a* and 624*b*. FIG. 31 is a perspective view of the fully constructed three-piece multi-sided container of the tray bliss wrapper blank of FIG. 30, illustrating the three pieces multi-sided container in a closed position.

Figure 32:
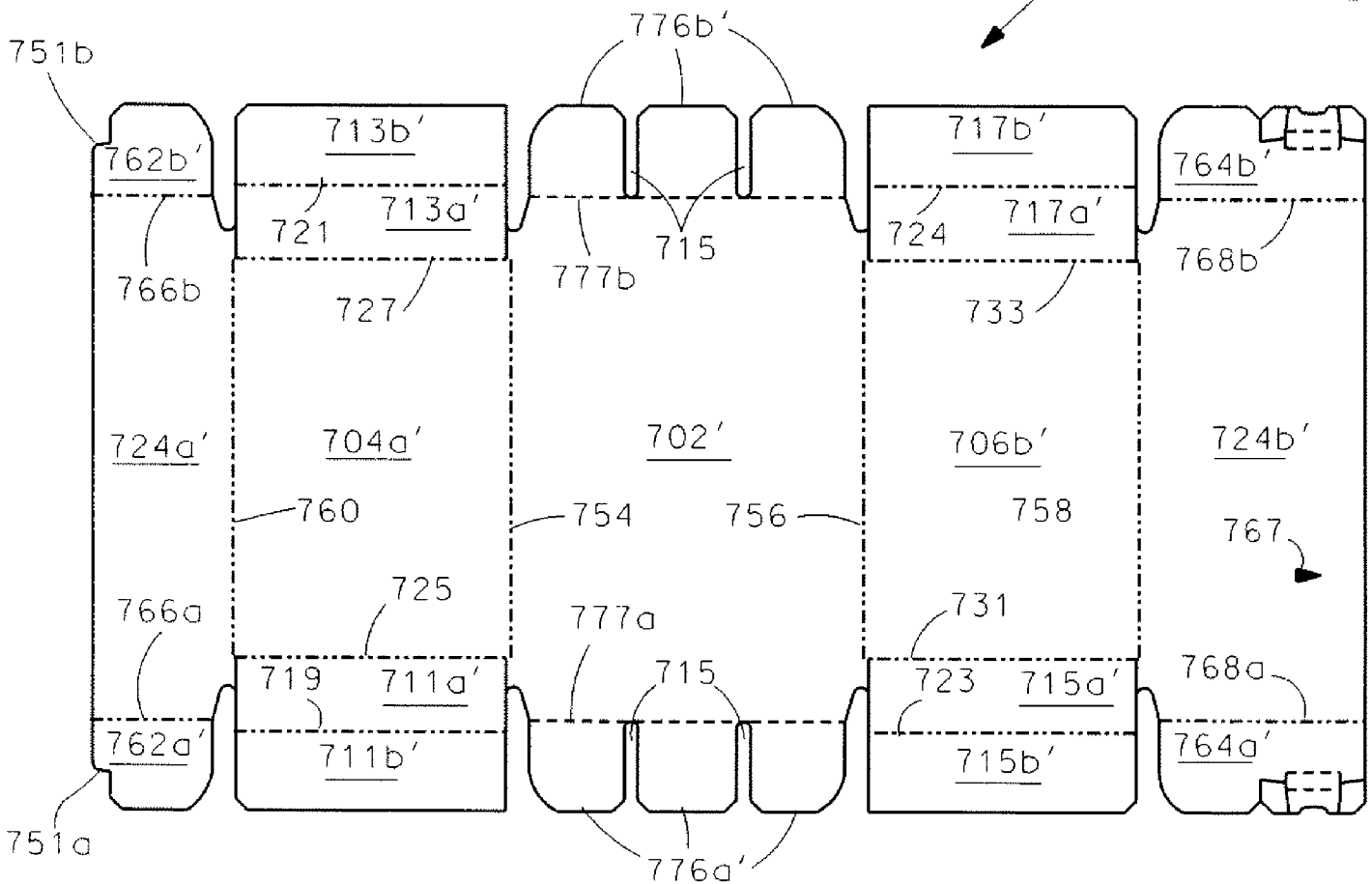
FIG. 32 is a plan view of a eight corners tray bliss wrapper blank having hand holes lock that forms the bottom wall, top and side walls of a three pieces container similar to three pieces container depicted in FIG. 33 in accordance with a ninth embodiment of the invention.
Figure 33:
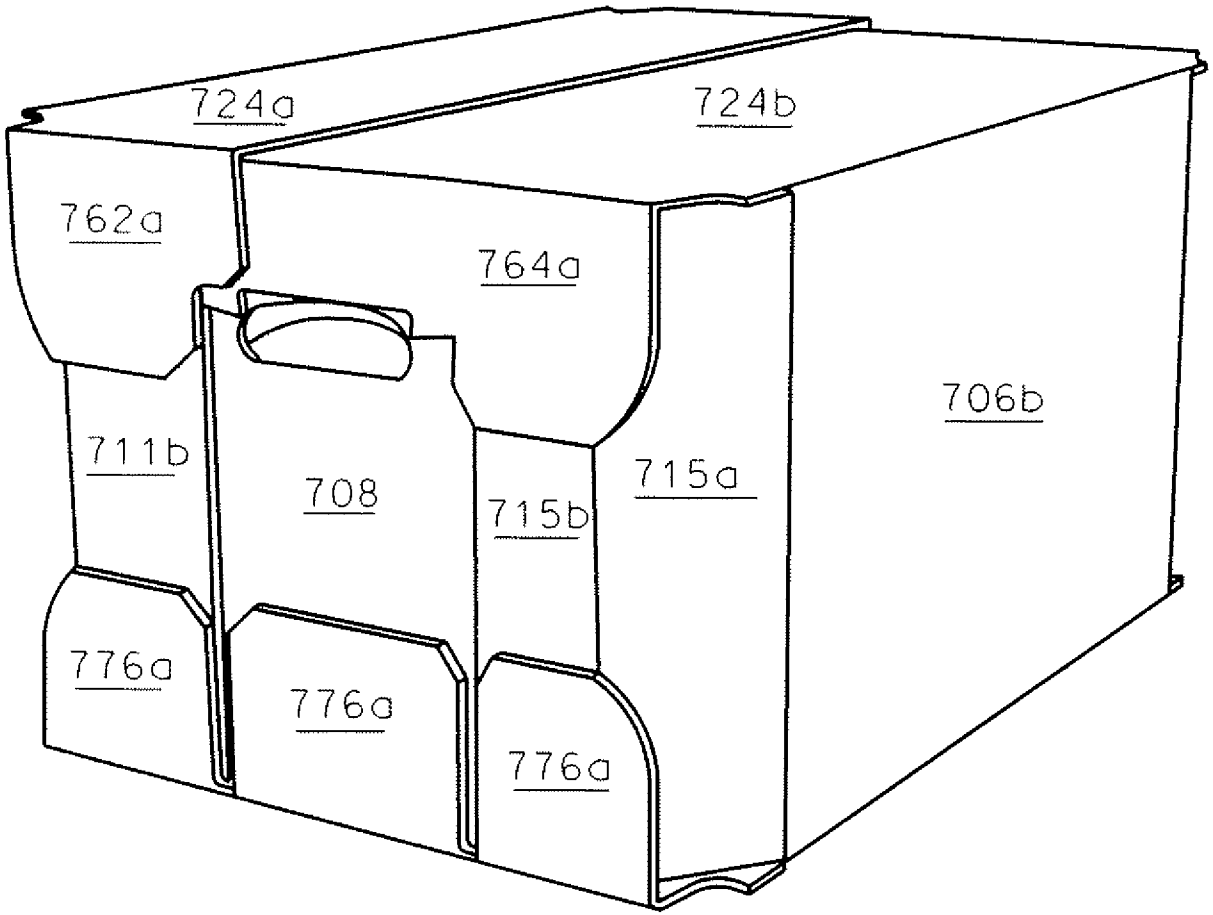
FIG. 33 is a perspective view of the fully constructed three-piece multi-sided container of the tray bliss wrapper blank of FIG. 32, illustrating the three pieces multi-sided container in a closed position.

FIG. 32 is a plan view of a eight corners tray bliss wrapper blank 750 having hand holes lock 751 that forms the bottom wall 702, respective top and side walls 724*a*, 724*b*, 704, 706 of a three pieces container (not shown) similar to three pieces container 500 depicted in FIG. 27 in accordance with a eighth embodiment of the invention. The wrapper blank 750 comprises a centrally located rectangular panel 702' that forms the bottom wall 702. The rectangular panel 702' has an advantage of having four identical rounded corners 752 which enhances the integrity of the container 700 (not shown) when the wrapper blank 750' is folded. Side wall forming panels 704' and 706' are foldably joined to opposite side edges of the panel 702' by respective fold lines 754, 756. Each longitudinal end of the side wall panels 704*a*', 706*b*' includes a respective pair of reinforcement flaps 711*a*', 711*b*', 713*a*', 713*b*' and 715*a*', 715*b*', 717*a*', 717*b*'. The reinforcement flap panels 711*a*', 711*b*' are defined by fold lines 719, 725. The reinforcement flaps 713*a*', 713*b*' are defined by fold lines 721, 727. The reinforcement flaps 715*a*', 715*b*' are defined by fold lines 723, 731. The reinforcement flaps 717*a*', 717*b*' are defined by fold lines 724, 733. Top wall panels 724*a*' and 724*b*' are foldably joined to respective longitudinal edges of the sidewall panels 704*a*' and 706*b*', opposite of their folded connection to the panel 702', by fold lines 758, 760. Each of the top wall panels 724*a*', 724*b*' includes two respective identical flaps 762*a*', 762*b*' and 764*a*', 764*b*' defined by respective fold lines 766*a*', 766*b*', and 768*a*', 768*b*'. An Arrow mark 767 indicates the direction of corrugation of the wrapper blank 750. Similarly, each of the top wall panels 724*a*', 724*b*', as noted with respect to the rectangular panel 702', has an advantage of having two identical rounded corners 772 which enhances the integrity of the container 700 when the wrapper blank 650 is folded. In addition, it should be noted that one side edge 774 of each flaps 762*a*', 762*b*' and 764*a*', 764*b*' is tapered so that when these flaps are folded, the tapered 747 would align the tapered edges of the flaps 711*b*', 713*b*', 715*b*', and 717*b*'. A pair of flaps 777*a*', 777*b*' is foldably joined to respective transverse edges of the panel 702' by fold lines 776*a*', 776*b*'. The flaps 776*a*', 776*b*' are essentially identical to one another and they are mirror images of one another. Each of the flaps 776*a*', 776*b*' is split into three sections by slot or slit 715. The sections towards the sides of the container are secured to the Wrap's "vertical end walls". The separate mid section is inset with an offset score so that the flap can secure directly to mid section of the Tray/Bliss end. The respective flaps 776*a*', 776*b*' are glued to the respective end walls 708, 710 when the wrapper blank 750 is folded to form the bottom wall 702, side walls 704, 706, and top walls 724*a* and 724*b*. FIG. 33 is a perspective view of the fully constructed three-piece multi-sided container of the tray bliss wrapper blank of FIG. 32, illustrating the three pieces multi-sided container in a closed position.

Figure 34:
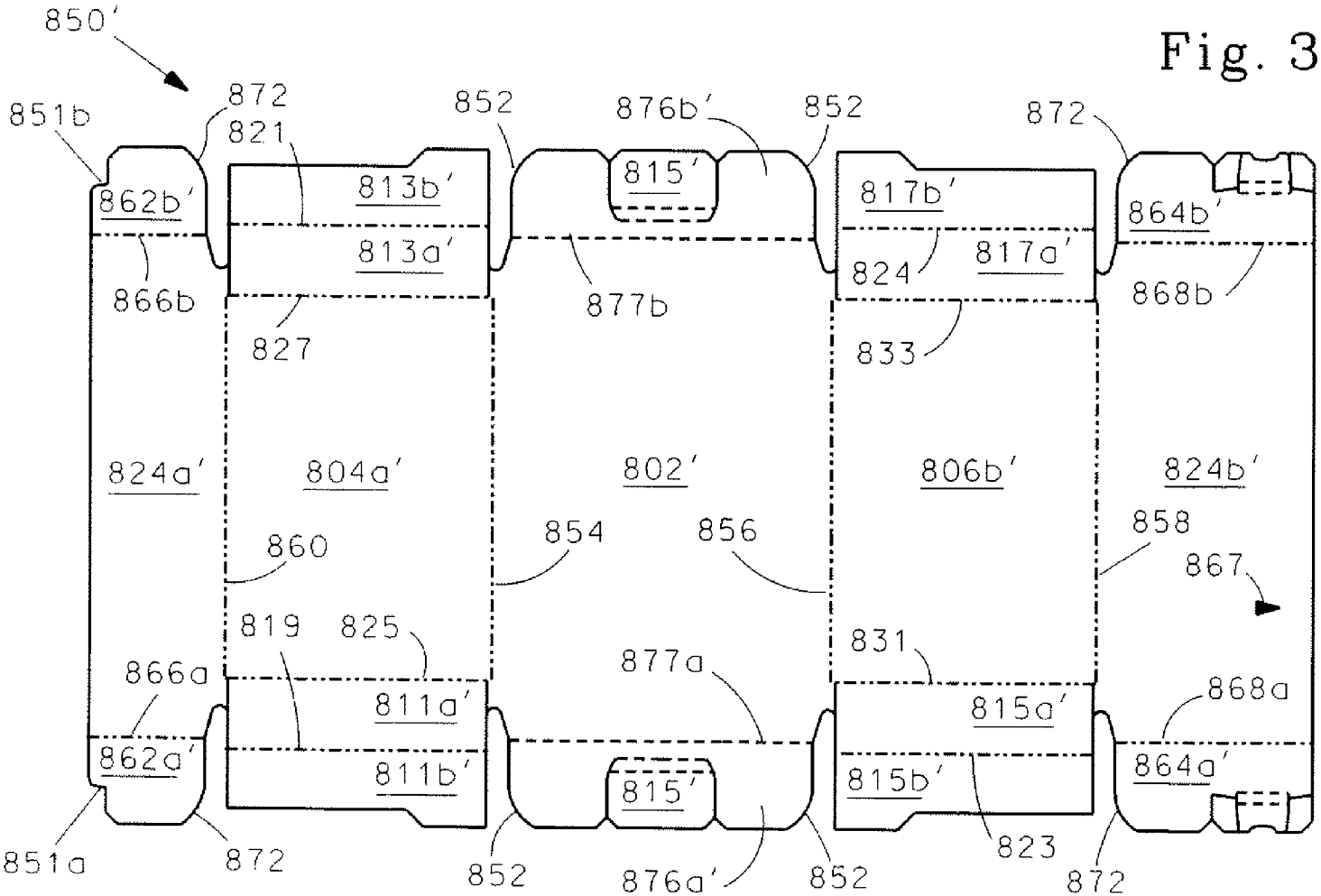
FIG. 34 is a plan view of a eight corners 33 degrees angles tray bliss slit wrapper blank having hand holes lock that forms the bottom wall, top and side walls of a three pieces container similar to the three pieces container depicted in FIG. 35 in accordance with a tenth embodiment of the invention.
Figure 35:
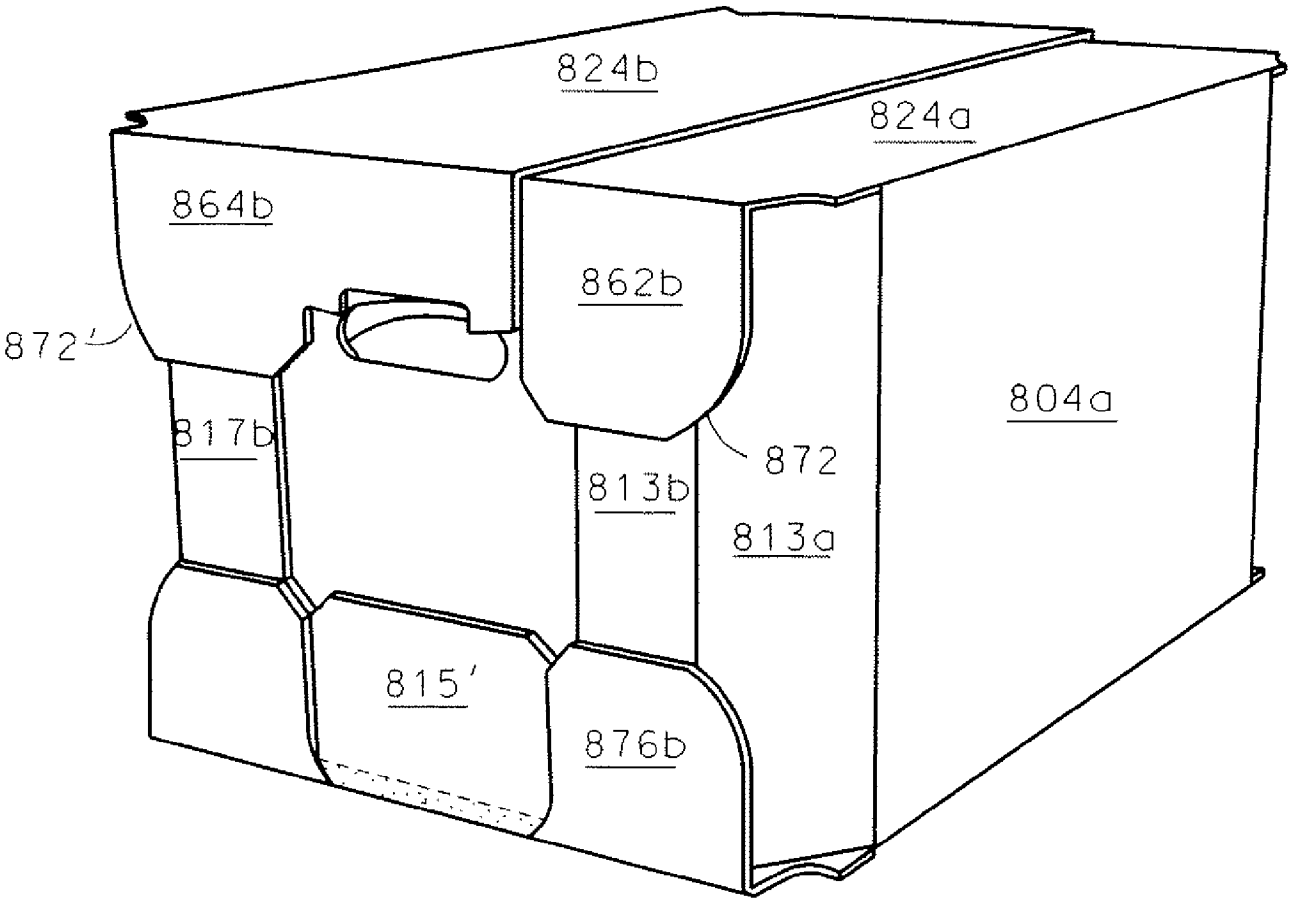
FIG. 35 is a perspective view of the fully constructed three-piece multi-sided container of the tray bliss wrapper blank of FIG. 34, illustrating the three pieces multi-sided container in a closed position.

FIG. 34 is a plan view of a eight corners 33 degrees angles tray bliss slit wrapper blank 850' having hand holes lock 851 that forms the bottom wall 802, respective top and side walls 824, 804, 806 of a three pieces container (not shown) similar to the three pieces container 500 depicted in FIG. 27 in accordance with a ninth embodiment of the invention. The wrapper blank 850 comprises a centrally located rectangular panel 802' that forms the bottom wall 802. The rectangular panel 802' has an advantage of having four identical rounded corners 852 which enhances the integrity of the container 800 (not shown) when the wrapper blank 850 is folded. Side wall forming panels 804' and 806' are foldably joined to opposite side edges of the panel 802' by respective fold lines 854, 856. Each longitudinal end of the side wall panels 804*a*', 806*b*' includes a respective pair of reinforcement flaps 811*a*', 811*b*', 813*a*', 813*b*' and 815*a*', 815*b*', 817*a*', 817*b*'. The reinforcement flap panels 811*a*', 811*b*' are defined by fold lines 819, 825. The reinforcement flaps 813*a*', 813*b*' are defined by fold lines 821, 827. The reinforcement flaps 815*a*', 815*b*' are defined by fold lines 823, 831. The reinforcement flaps 817*a*', 817*b*' are defined by fold lines 824, 833. Top wall panels 824*a*' and 824*b*' are foldably joined to respective longitudinal edges of the sidewall panels 804*a*' and 806*b*', opposite of their folded connection to the panel 802', by fold lines 858, 860. Each of the top wall panels 824*a*', 824*b*' includes two respective identical flaps 862*a*', 862*b*' and 864*a*', 864*b*' defined by respective fold lines 866*a*', 866*b*', and 868*a*', 868*b*'. An Arrow mark 867 indicates the direction of corrugation of the wrapper blank 850. Similarly, each of the top wall panels 824*a*', 824*b*', as noted with respect to the rectangular panel 802', has an advantage of having two identical rounded corners 872 which enhances the integrity of the container 800 (not shown) when the wrapper blank 850 is folded. In addition, it should be noted that one side edge 874 of each flap 862*a*', 862*b*' and 864*a*', 864*b*' is tapered so that when these flaps are folded, the tapered 847 would align the tapered edges of the flaps 811*b*', 813*b*', 815*b*', and 817*b*'. A pair of flaps 876*a*', 876*b*' is foldably joined to respective transverse edges of the panel 802' by fold lines 876*a*', 876*b*'. The flaps 876*a*', 876*b*' are essentially identical to one another and they are mirror images of one another. Each of the flaps 876*a*', 876*b*' is split into three sections but not fully as shown by section 815. The "outside bottom end sealing flap" bottom connection score line remains unbroken which will improve the package's rough handling durability. The inset panel of the "outside bottom end sealing flap" uses double scores to push the panel inward towards the Tray/Bliss end. The double scores form a "Boxed Bream" along the bottom end of the package. This may improve package end stiffness. The uneven surface of the 3 part wrap "outside bottom end sealing flap" limits its use as a label application area. The Tray/Bliss wrap "vertical end walls" have been cut back to allow an end panel label to be placed between them and above the mid section of the "outside bottom end sealing flap". The location of the label area between the "top closure flaps" and the "outside bottom end sealing flap" links the height of the label area to the difference between the total package height and the width of the 2 flaps. Shallow depth packages may not have any label space available. FIG. 35 is a perspective view of the fully constructed three-piece multi-sided container of the tray bliss wrapper blank of FIG. 34, illustrating the three pieces multi-sided container in a closed position.

Figure 36:
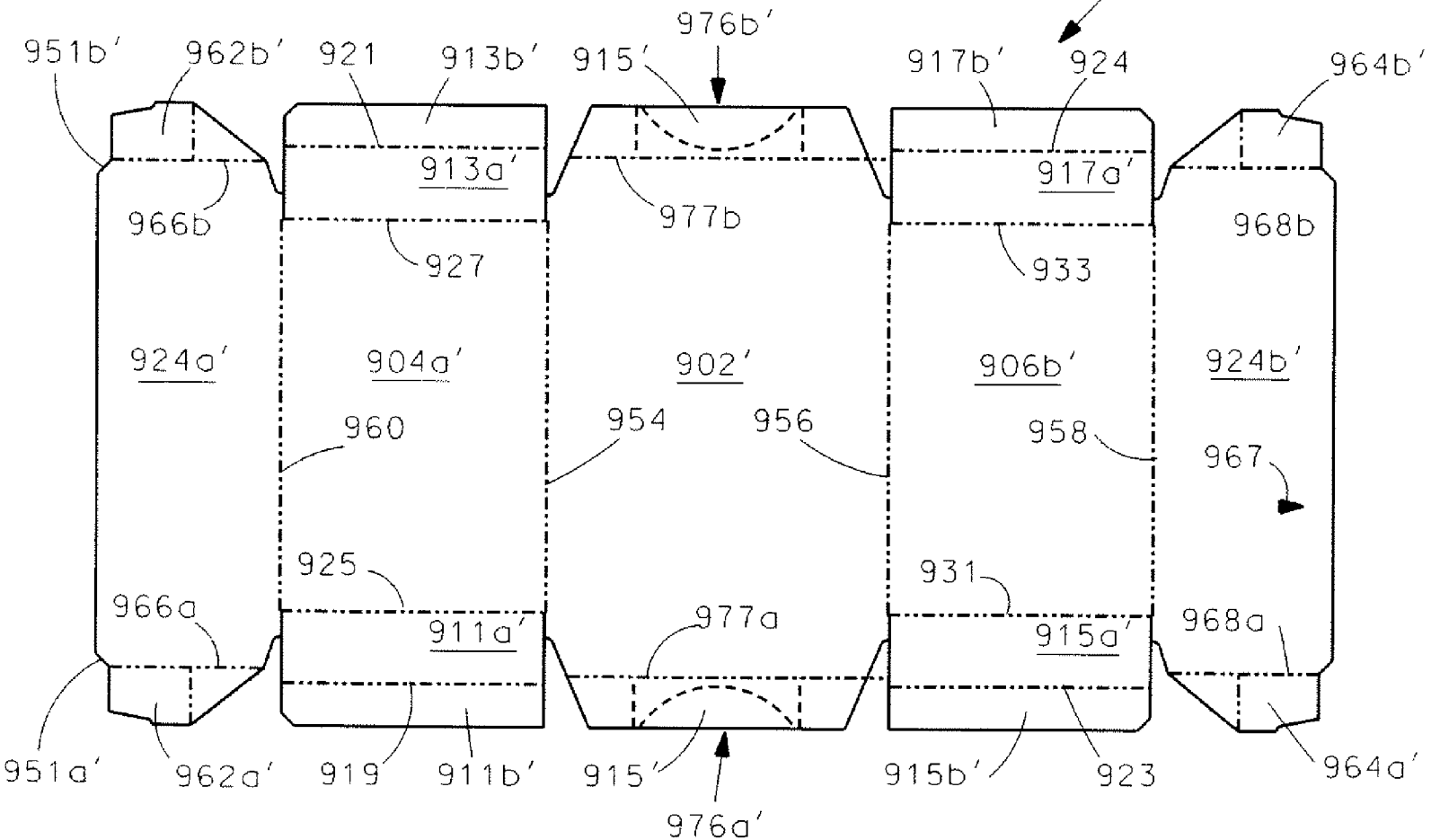
FIG. 36 is a plan view of a eight corners 37 degrees angles tray bliss arc/perf wrapper blank having hand holes lock that forms the bottom wall and side walls of a three pieces container in accordance with an eleventh embodiment of the invention.

FIG. 36 is a plan view of a eight corners 37 degrees angles tray bliss arc/perf wrapper blank 550" having hand holes lock that forms the bottom wall and side walls of a three pieces container in accordance with an tenth embodiment of the invention. The wrapper blank 550" is similar to the wrapper blank 550 as described hereinabove in detail and will not be described again to avoid redundancy.

Figure 37:
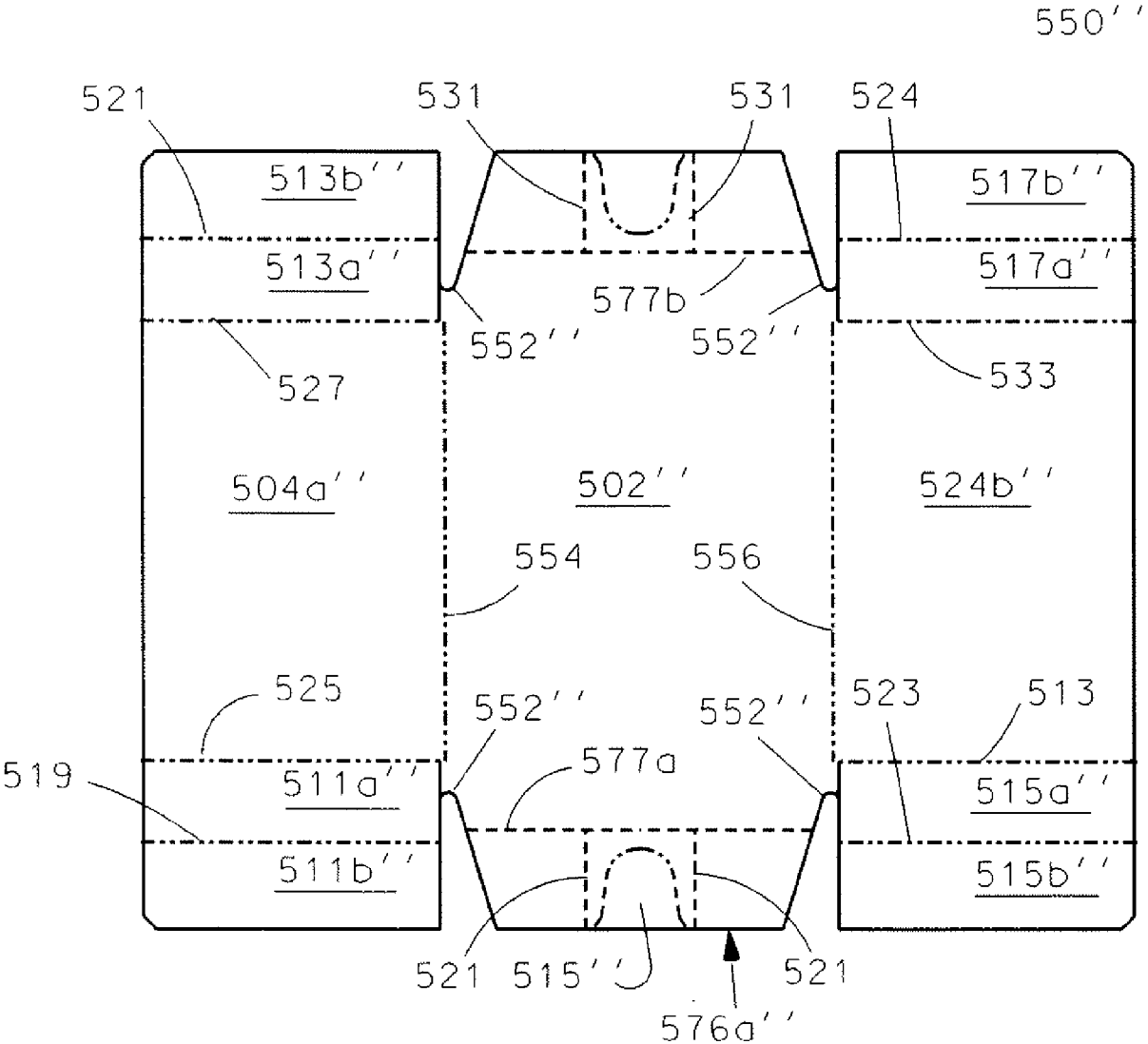
FIG. 37 is a plan view of a eight corners 37 degrees angles tray bliss arc/perf wrapper-side seal blank having hand holes lock that forms the bottom wall and side walls of a three pieces container similar to the three pieces container depicted in FIG. 35 in accordance with a twelfth embodiment of the invention.

FIG. 37 is a plan view of a eight corners 37 degrees angles tray bliss arc/perf wrapper-side seal blank 950 having hand holes lock 951 that forms the bottom wall 902, top and side walls 924, 904, 906 of a three pieces container similar to the three pieces container depicted in FIG. 27 in accordance with a twelfth embodiment of the invention. The wrapper blank 950 is similar to the wrapper blank 550 as described hereinabove in detail and will not be described again to avoid redundancy.

Figure 38:
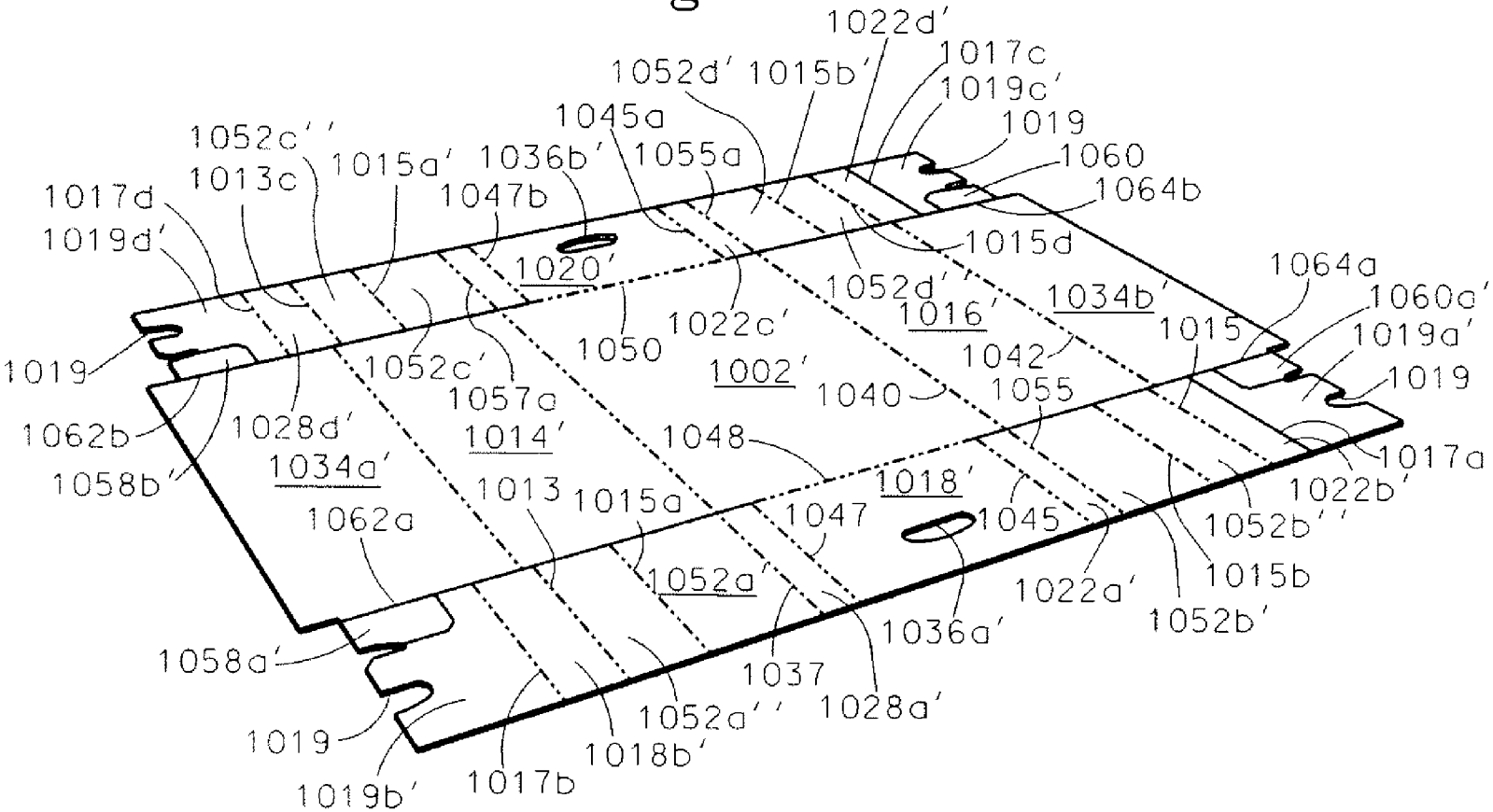
FIG. 38 is a perspective view of a unitary blank B4 used to form a multi-sided container having triangulated corners in accordance with a thirteen embodiment of the invention.
Figure 40:
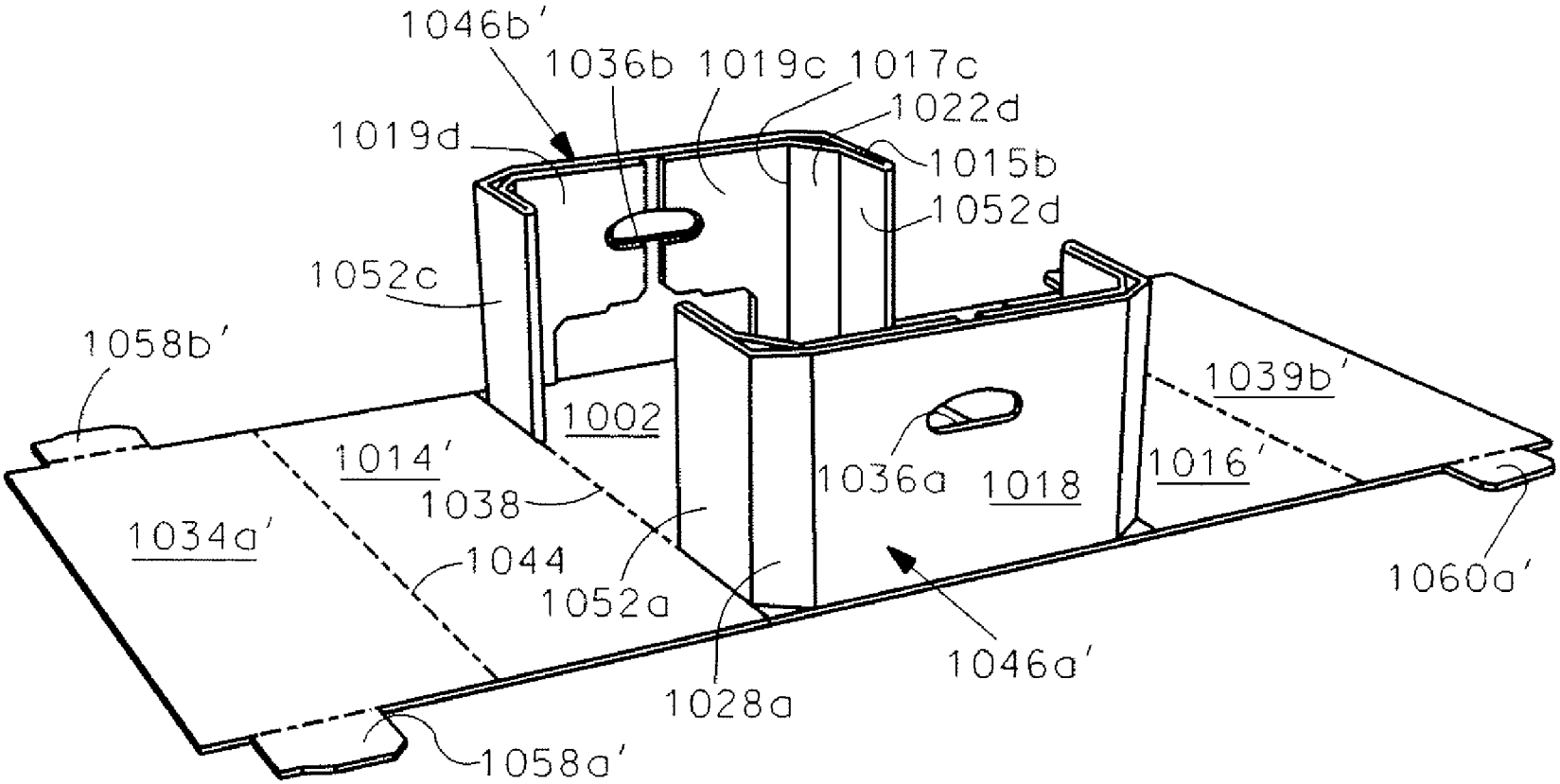
FIG. 40 is similar to FIG. 39, illustrating that the end pieces are in operative position to form the end walls.
Figure 43:
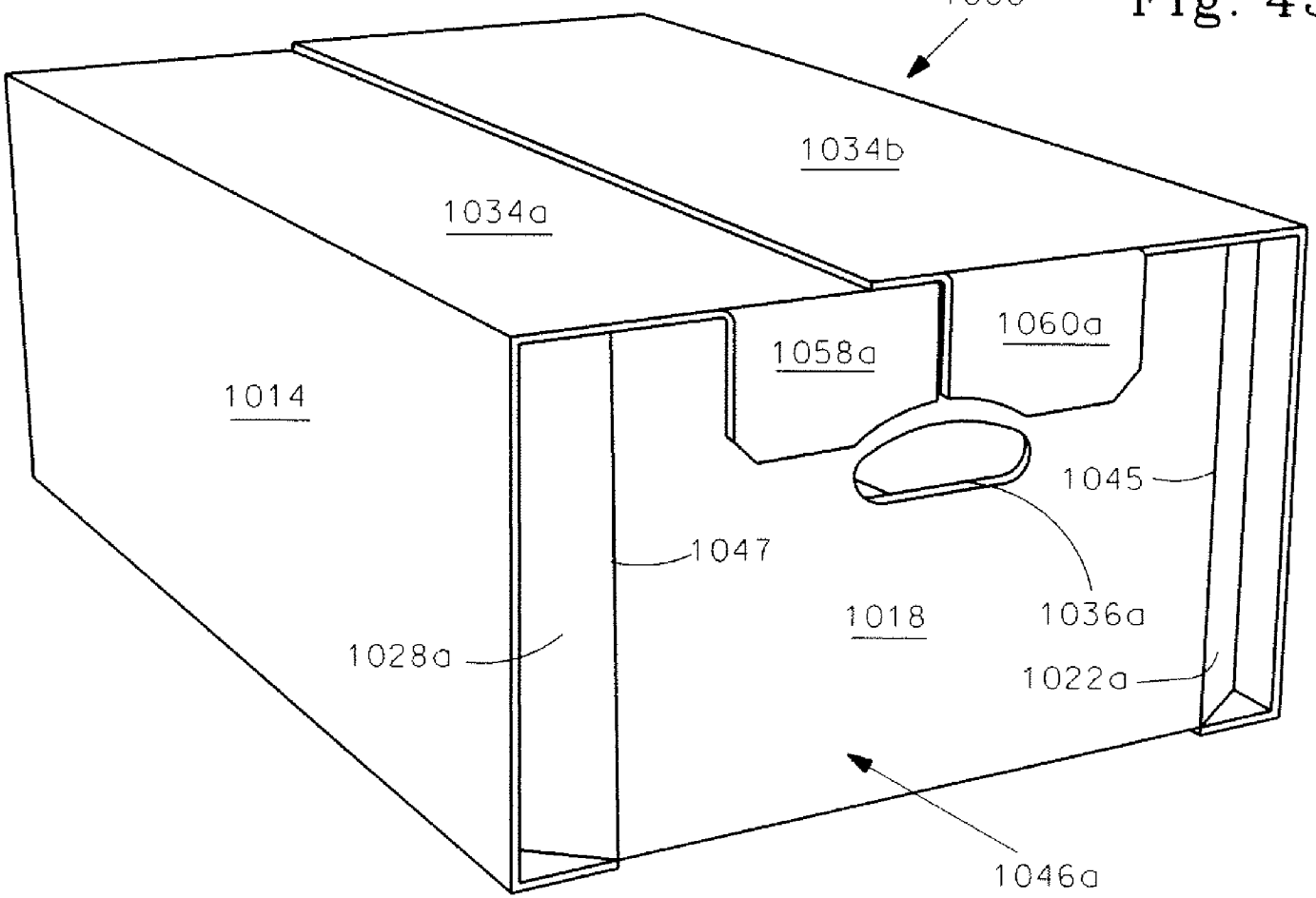
FIG. 43 is the same as FIG. 42, illustrating the multi-sided container having triangulated corners in a closed position.

FIG. 38 is a perspective view of a unitary blank B4 used to form the container 1000 shown in FIG. 43 in accordance with a thirteenth embodiment of the invention. The blank B4 is defined by a wrap 1001 in the central portion and two end pieces 1046*a*', 1046*b*' defined by fold line 1048 and 1050 and located on the longitudinal side of the blank B4. The wrap 1001 comprises a centrally located rectangular panel 1002' that forms the bottom wall 1002 (FIG. 40). Side wall forming panels 1014' and 1016' are foldably joined to opposite side edges of the bottom panel 1002' by respective fold lines 1038, 1040. Top wall panels 1034*a*' and 1034*b*' are foldably joined to respective longitudinal edges of the sidewall panels 1014' and 1016', opposite of their folded connection to the bottom panel 1002', by fold lines 1042, 1044. Each of the top wall panels 1034*a*', 1034*b*' includes two respective identical flaps 1058*a*', 1058*b*' and 1060*a*', 1060*b*' defined by respective fold lines 1062*a*, 1062*b*, and 1064*a*, 1064*b*.

A pair of end pieces 1046*a*', 1046*b*' is foldably joined to respective long sides of the wrap 1001 by fold lines 1048, 1050. The end pieces 1046*a*', 1046*b*' are essentially identical to one another and they are mirror images of one another. The end piece 1046*a*' includes an end wall panel 1018', two relatively narrow diagonal corner panels or gusset panels 1022*a*', 1028*b*' foldably joined to opposite ends of the panel 1018' by fold lines 1045, 1047, and partial sidewall panels 1052*a*', 1052*a*", 1052*b*', 1052*b*" are foldably joined to the respective narrow corner panels 1028*a*', 1022*b*' by fold lines 1057 and 1055. The diagonal corner panels or gusset panels 1018*b*', 1022*b*' are defined as inner diagonal corner panels or gusset panels and the diagonal corner panels or gusset panels 1022*a*', 1028*a*' are defined as outer diagonal corner panels or gusset panels. The partial sidewall panels 1052*a*', 1052*a*" are foldably joined to one another by fold line 1015*a* and the partial sidewall panels 1052*b*', 1052*b*" are foldably joined to one another by fold line 1015*b*. Respective gusset panels 1018*b*', 1022*b*' are foldably joined to respective partial sidewall panels 1052*a*", 1052*b*" by respective fold line 1013 and 1015. Respective flap panels 1019*a*', 1019*b*' are foldably joined to the respective gusset panels or diagonal corner panels 1018*b*', 1022*b*' by respective fold lines 1017*b* and 1017*a*. It should be noted that diagonal corner panels 1028*a*' and panel 1018*b*' have different widths with respect to one another and panel 1052*a*' and 1052*a*" have different widths with respect to one another as well. For example, the width of diagonal corner panel 1018*b*' is less than the width of diagonal corner panel 1028*a*'. Diagonal corner panels 1022*a*' and panel 1022*b*' have different widths with respect to one another and panels 1052*b*' and 1052*b*" have different widths with respect to one another as well. Similarly, the width of diagonal corner panel 1022*a*' is less than the width of diagonal corner panel 1022*b*'. Likewise, the width of partial sidewall panels 1052*a*" is less than the width of partial sidewall panels 1052*a*' and the width of partial sidewall panels 1052*b*" is less than the width of partial sidewall panels 1052*b*'. Since the opposite end piece 1046*b*' is a mirror image of the end piece 1046*a*', therefore the widths of partial sidewall panels are different and widths of diagonal corner panels are different with respect to one another, accordingly. These panels 1022*a*', 1022*b*', 1052*b*', 1052*b*" are sized differently so that it forms triangulated corners when the blank B4 is folded to construct the container 1000.

The end piece 1046*b*' includes an end wall panel 1020', two relatively narrow corner panels 1022*c*', 1028*c*' foldably joined to opposite ends of the end wall panel 1020' by fold lines 1045*a*, 1047*b*, and partial sidewall panels 1052*c*', 1052*c*", 1052*d*', 1052*d*" are foldably joined to the respective narrow corner panels 1028*c*', 1022*c*' by fold lines 1057*a* and 1055*a*. The partial sidewall panels 1052*c*', 1052*c*" are foldably joined to one another by fold line 1015*a*' and the partial sidewall panels 1052*b*', 1052*b*" are foldably joined to one another by fold line 1015*b*'. Respective gusset panels 1028*d*', 1022*d*' are foldably joined to respective partial sidewall panels 1052*c*", 1052*d*" by respective fold line 1013*c* and 1015*d*. Respective flap panels 1019*c*', 1019*d*' are foldably joined to the respective gusset panels 1028*d*', 1022*d*' by respective fold lines 1017*c* and 1017*d*. Each of the end wall panels 1018', 1020' includes a respective hand hole openings 1036*a*', 1036*b*' that are used for carrying container 1000. A respective cut out 1019 is formed on each of the respective flap panels 1019*a*', 1019*b*', 1019*c*', and 1019*d*'. The cut out 1019 is aligned with the hand hole openings 1036*a*', 1036*b*' so that it prevents the flap panels 1019*a*', 1019*b*', 1019*c*', 1019*d*' to obstruct the hand hole openings when the flap panels 1019*a*', 1019*b*', 1019*c*', 1019*d*' are folded onto the respective end wall panels 1018', 1020'. It should be noted that panels 1028*c*' and panel 1028*d*' have different widths with respect to one another and panel 1052*c*' and 1052*c*" have different widths with respect to one another as well. Similarly, panels 1022*c*' and panel 1022*d*' have different widths with respect to one another and panels 1052*d*' and 1052*d*" have different widths with respect to one another as well. These panels 1022*c*', 1022*d*', 1052*d*', 1052*d*" are sized differently so that it facilitates and forms triangulated corners when the blank B4 is folded to construct the container 42.

Figure 39:
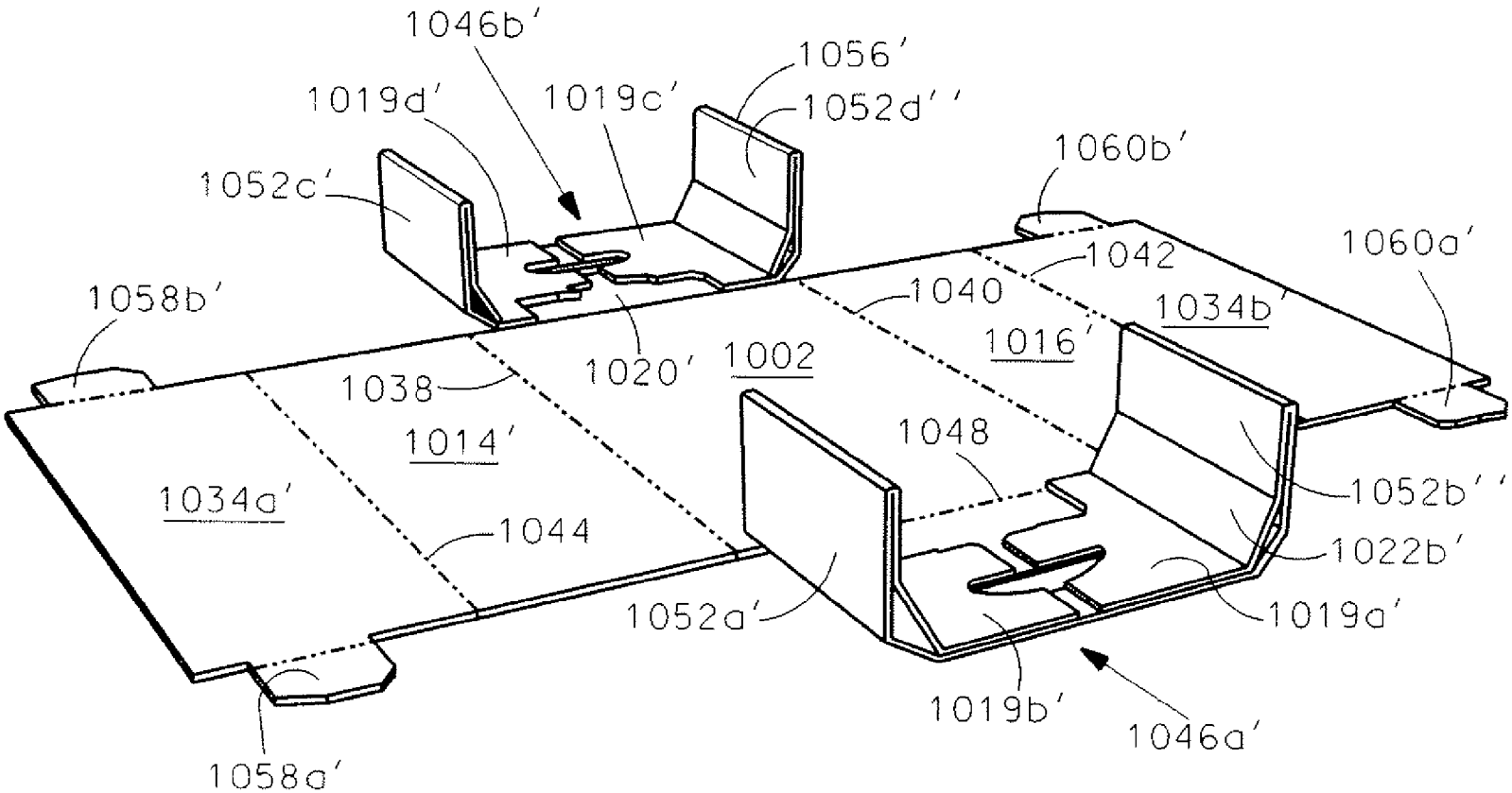
FIG. 39 is similar to FIG. 38, which illustrating that end pieces are in the folded position.
Figure 41A:
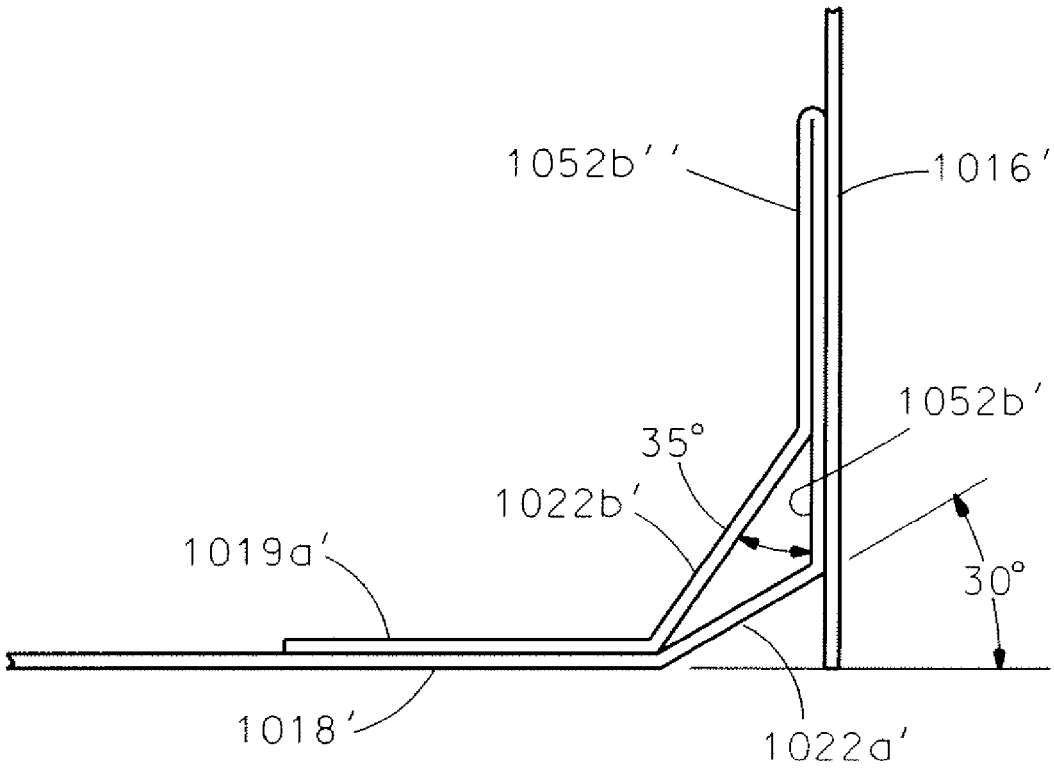
FIG. 41*a* is a sectional view a portion of corner of the container shown in FIGS. 42 and 43.
Figure 41B:
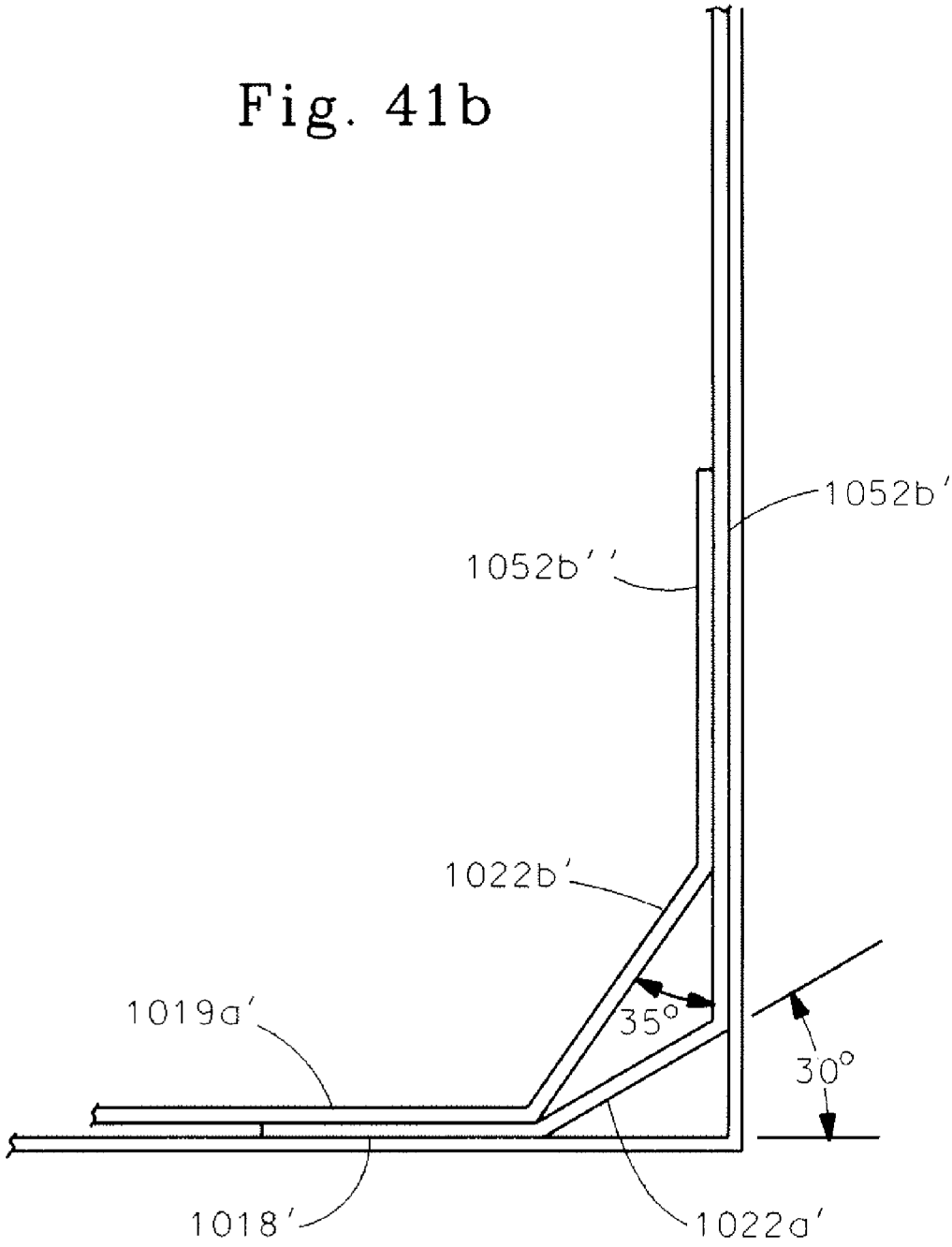
FIG. 41*b* is a sectional view a portion of corner of the container shown in FIG. 46.

FIG. 39 is similar to FIG. 38 which illustrates respective end pieces 1046*a*', 1046*b*' being in the folded position. To construct the end pieces 1046*a*', 1046*b*', the respective partial sidewall panels 1052*a*', 1052*a*" and 1052*b*', 1052*b*" are folded onto one another by respective fold lines 1015*a*, 1015*b*. Similarly, the respective partial sidewall panels 1052*c*', 1052*c*" and 1052*d*', 1052*d*" are folded onto one another by respective fold lines 1015*a*', 1015*b*'. Next, the respective flap panels 1019*a*', 1019*b*' are folded onto the end wall panel 1018' and the respective flap panels 1019*c*', and 1019*d*' are folded onto the end wall panel 1020'. FIG. 40 is similar to FIG. 39, illustrates the end pieces being in the operative position to form the end walls 1018, 1020. The end pieces 1046*a*', 1046*b*' are folded 90° degrees with respect to the fold lines 1048, 1050. It should be noted that when the end pieces 1046*a*', 1046*b*' are constructed, each of the respective gusset panels 1018*b*', 1022*b*', 1028*d*', 1022*d*' act as a gusset plate which significantly enhances stacking compression strength of the container 1000. This configuration Improves eight sided container 1000 resistance to end to end and side to side shape distortion. Each of the corners of the container 1000 is constructed from four angular folds as best depicted in FIG. 41. These four angular folds form opposing dual triangulated corners. Each of these triangulated corners is less than 45 degrees to their attached side or end wall. The outside diagonal corners of the wrap 1001 form approximately 30 degree angles to direct their largest thrust vectors in the side to side direction. The inside diagonal corners of the ends form approximately 35 degree angles to direct their largest thrust vectors in the end to end direction. These opposing thrust vectors greatly improve the container's side to side and end to end resistance to horizontal distortion. For only illustrative purposes, the outside diagonal corner is shown 30 degrees and inside diagonal corner is shown 35 degrees, but one of ordinary skill in the art would appreciate that other combination of number of angles may be used for the outside and inside diagonal corners. For example, in general, for outside/inside diagonal corners, angles greater than 20 degrees and less than 45 degrees would be within the scope of the invention.

Figure 42:
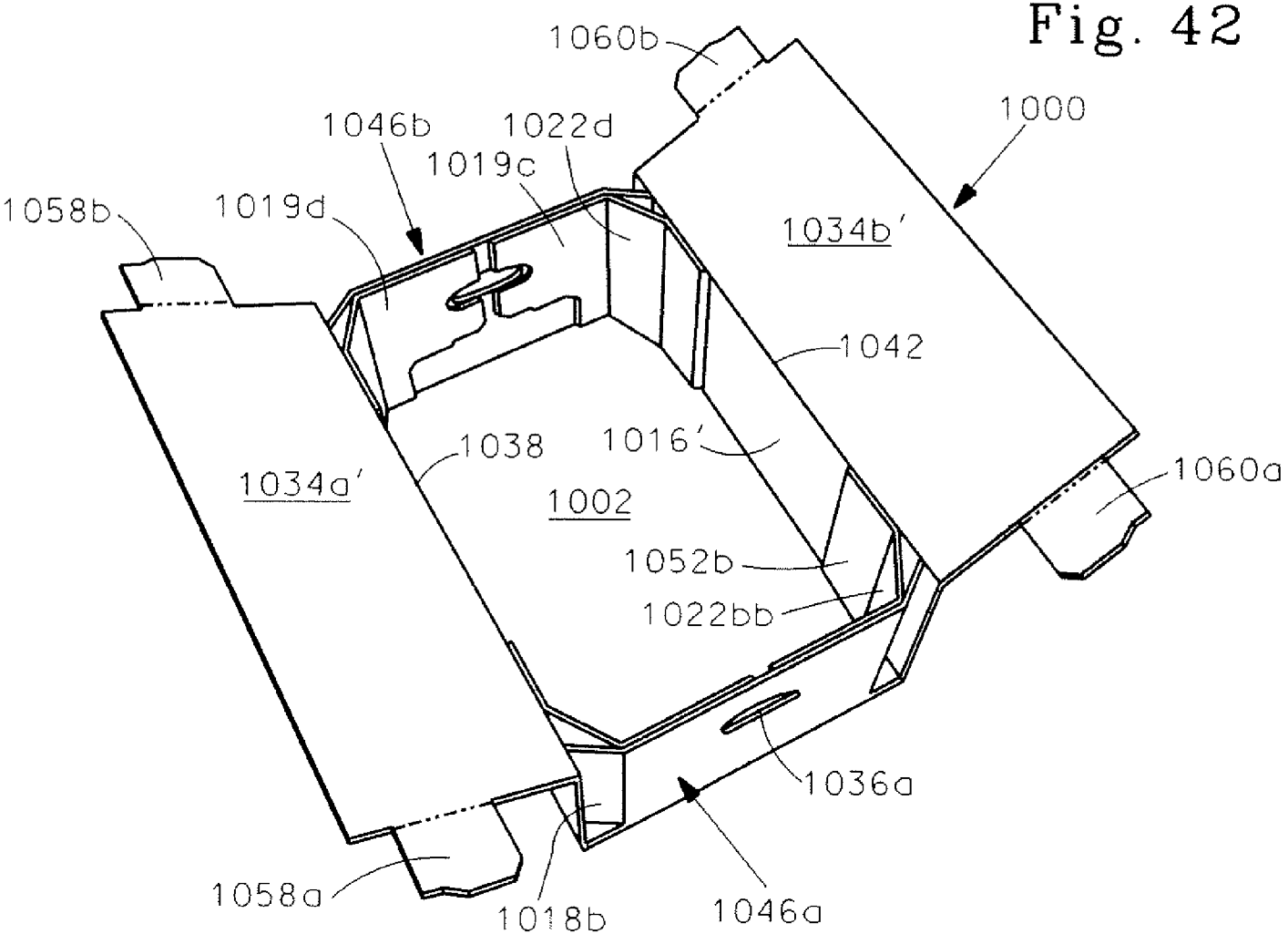
FIG. 42 is similar to FIG. 40, by illustrating a wrapper portion of the unitary blank B4 folded onto the end walls of the multi-sided container having triangulated corners wherein the container being shown in an open position depicted.

FIG. 42 is similar to FIG. 40, by illustrating a wrapper portion 1000 of the unitary blank B4 folded onto the end walls of the multi-sided container 1000 having triangulated corners wherein the container 1000 being shown in an open position. The opposing dual triangulated corners form a structural honeycomb in each of the container's four outer quadrants (16 corners per container). This array of folds and panels in each corner of the container 1000 provides a relatively broad and stable container stacking platform even when the container stacks are misaligned. In use, goods or products such as, but not limited to, poultry and/or meat are placed in the container and the container is then enclosed as depicted in FIG. 43.

Figure 44:
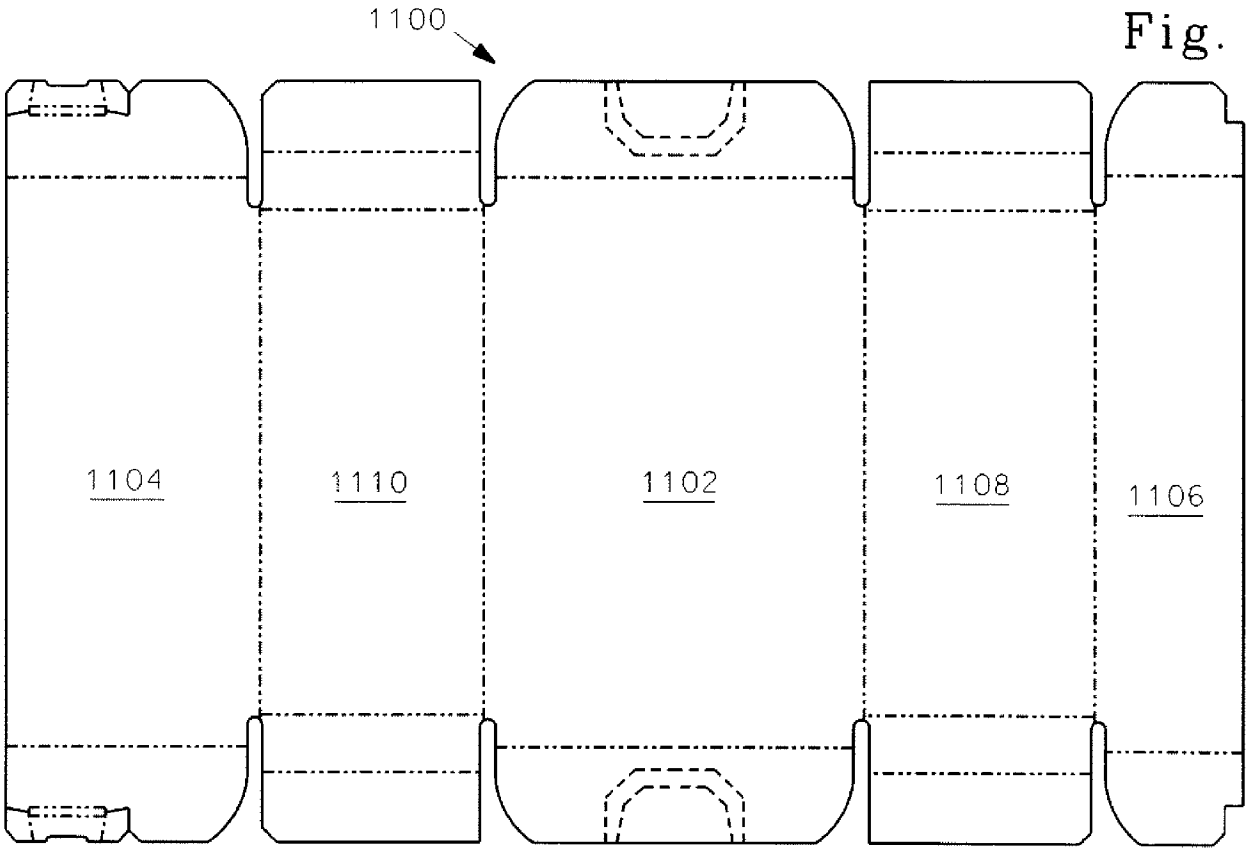
FIG. 44 is a plan view of a wrapper blank that forms the bottom wall, top and side walls of the multi-sided container having triangulated corners depicted in FIG. 46 in accordance with a fourteenth embodiment of the invention.

FIG. 44 is a plan view of a wrapper blank 1100 that forms the bottom wall 1102, top walls 1104, 1106, and side walls 1108, 1110 of the multi-sided container 1200 having triangulated corners depicted in FIG. 42 or 43 in accordance with a fourteenth embodiment of the invention. The wrapper blank 1100 is similar to the wrapper blank described in FIG. 26 and therefore, the description of wrapper blank 1100 is avoided for redundancy. The Tray Bliss wrapper 1100 "outside bottom end sealing flap" crosses the container full width. This full width panel adds to the container 1200 bottom end beam strength. This full width panel also provides a large end panel labeling surface. For example, almost all poultry and meat containers are labeled on the container ends. The Tray Bliss wrap "outside bottom end sealing flap" "insert panel" flexes inward to adhere to the Tray Bliss end between the two "vertical outside end walls". The small space below the "insert panel" and above the bottom score line remains uncrushed to improve the panel's beam strength.

Figure 45:
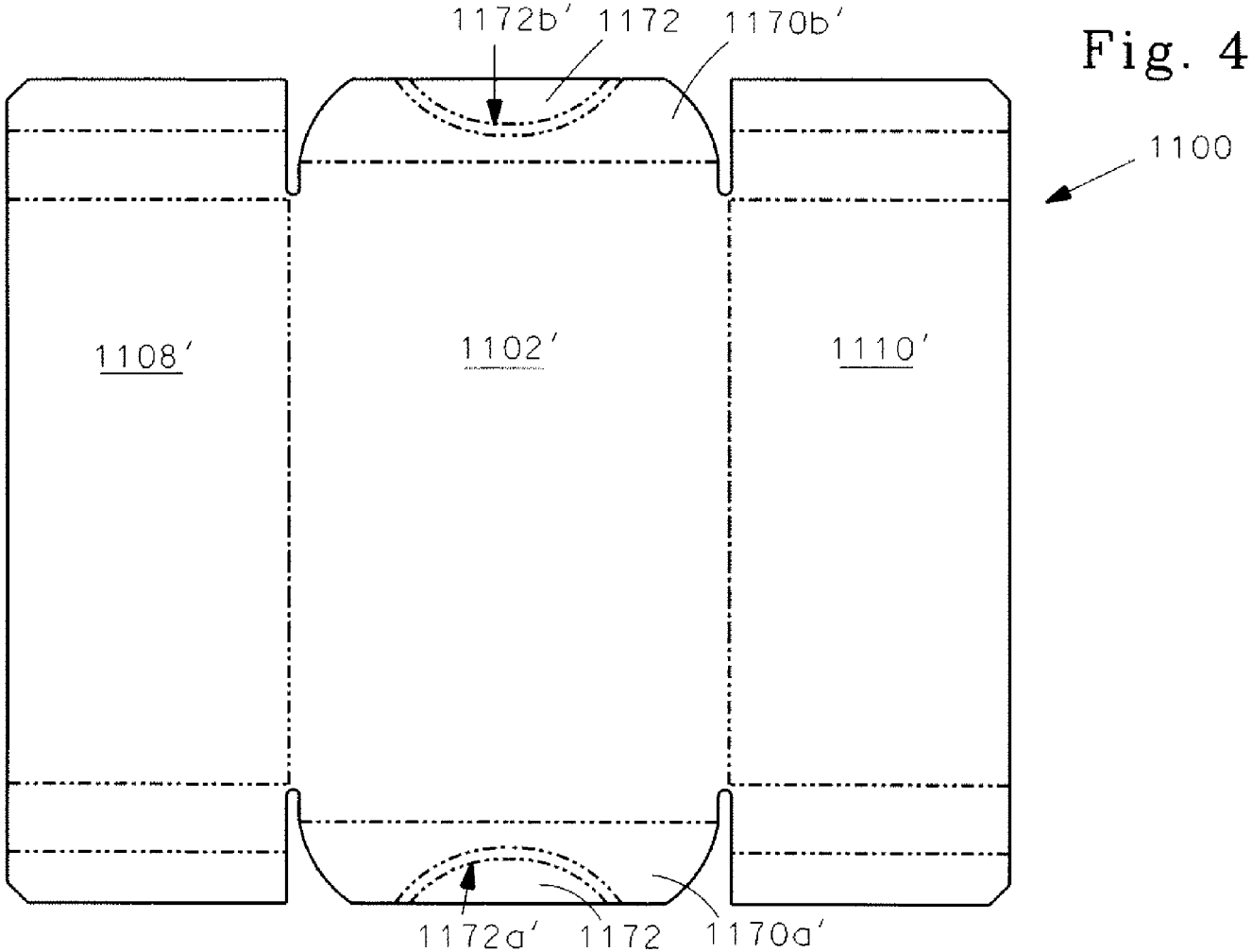
FIG. 45 is a plan view of an alternative wrapper blank shown in FIG. 44 that forms the bottom wall and side walls of the multi-sided container without incorporating the top walls.

FIG. 45 is a plan view of a wrapper blank 1100' that forms the bottom wall 1102' and side walls 1108', 1110' of the multi-sided container 1200 without incorporating the top walls 1104, 1106 shown in FIG. 44. The wrapper blank 1100' is similar to the wrapper blank described in FIG. 37. Each of the flaps 1170*a*', 1170*b*' has a respective crushed and scored area 1172*a*' and 1172*b*'. The scored area allows the center portion 1172 to be pushed inward to secure to the Tray/Bliss end Panel.

Figure 46:
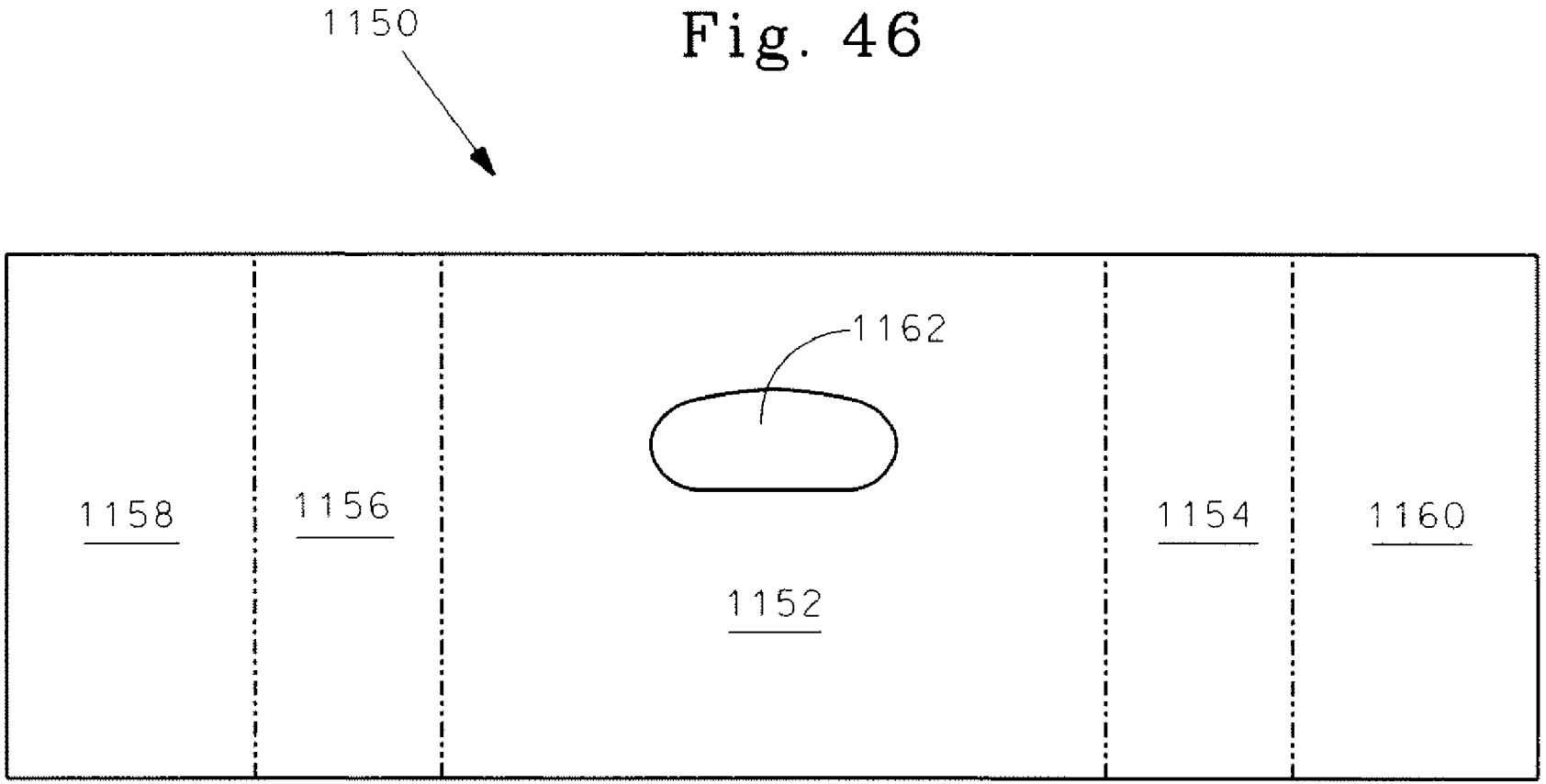
FIG. 46 is a plan view of a pair of blanks that form the end pieces used to construct the multi-sided container having triangulated corners depicted in FIG. 42 or 43.

FIG. 46 is a plan view of a pair of blanks that form the end pieces used to construct the multi-sided container 1200 having triangulated corners depicted in FIG. 42 or 43. These pair of blanks 1150 (shown only one here) is similar to the pair of blanks described in FIG. 22 or 27 and therefore, the description of pair of blanks 1150 is avoided for redundancy.

Figure 47:
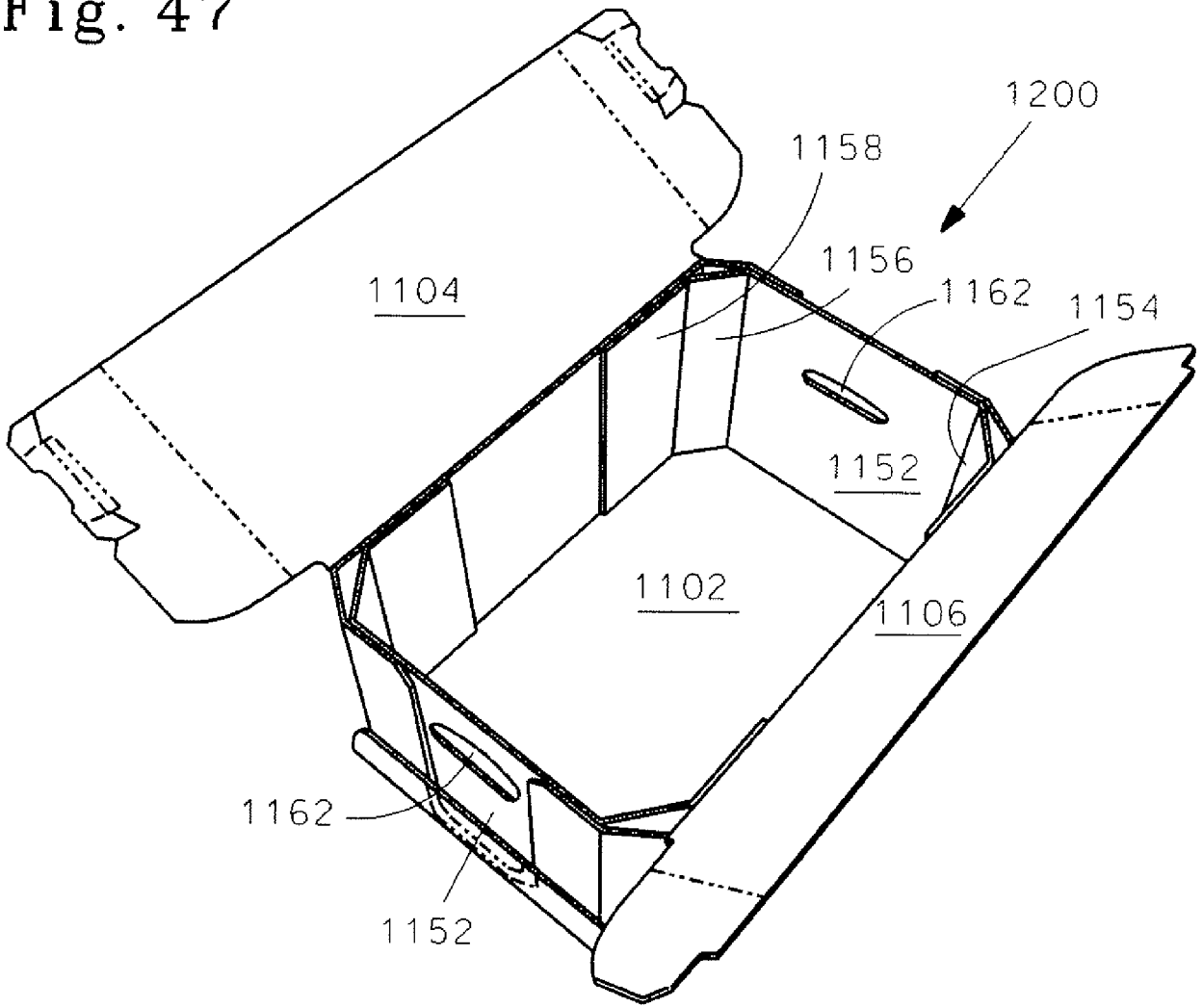
FIG. 47 is a perspective view of a multi-sided container having triangulated corners fully constructed from the wrapper blank and the end pieces depicted in FIGS. 44 and 45.

FIG. 47 is a perspective view of a multi-sided container 1200 having triangulated corners fully constructed from the wrapper blank and the end pieces depicted in FIGS. 44 and 45. The interior of the container has four strongly modified diagonal corners (about 35° deg. to the side wall) with attached "inside vertical side wall" panels that glue to the Tray Bliss wrap "outside side walls". The strongly modified diagonal corners move the attached end "inside vertical side walls" inward towards the container mid section. This places the two ply lamination area of the container sides in the weakest portion of the container, the mid section of the sides. This added structure in this weakest portion of the container, improves the overall container stacking strength and field performance. The modified diagonal corners (less than 45° degrees) are also lengthened. The longer diagonal also improves the top to bottom compression strength.

A multi-sided container manufactured as above can be made with automated equipment, and when made and glued up as described, all seams and joints are sealed against the environment.

It should be noted that the angles of the reinforcing diagonal corner panel for all embodiments are from about 33° to about 38° degrees which helps to stiffen the structure of the container 10 or 70 or 200 or 300, 1000, 1200 to resist both outward and inward flexing of both the end walls and sidewalls of the container. Generally, a force against the end wall inwardly, tends to cause a somewhat equal reaction outwards on the sidewall of the container. Conversely, if the product inside the container pushes outwardly against the end wall, it tends to cause a somewhat equal reaction on the sidewalls and thereby force them to flex inwardly. This aspect is important for a couple of reasons: first, If the end wall flexes inward, it will cause the side walls to flex outward, as well as affecting positive sealing during the final closure of the side flaps. These flaps need to have a somewhat perpendicular and rigid surface to seal against as the machinery accomplishes the sealing which relies on a positive resistance from the end wall. Also, if the sidewall flexes outwardly, the intended distance between the top flaps edges will be affected causing less of an overlap, or more of a gap depending on the final sealing intention. Second, if the end wall flexes outwards, it will force the sidewalls to flex inward which will cause the top flaps to overlap more than they are intended to or have less of a gap depending on the final sealing intention. Additionally, the sealing of the side flaps will be difficult due to the end wall extending outward past a 90 degree position. Therefore, by modifying the diagonal corner panel angle ranges from about 33° to about 38° degrees, it tends to make the end walls and side walls react independently of one another when forces are applied thereto. In addition, because these reactions are now separated from each other, the flexing of the end panel is limited to the normal range that one would see in a traditional square cornered box making the final sealing of the side flaps easier.

In general, a conventional four sided internal flange bliss package generates good stacking performance with a fairly efficient use of materials. The bliss wrap provides the top, bottom and sides for containment with relatively light weight materials. The heavier weight, flanged end panels are laminated to the side walls and secured to the wrap bottom and side edges to complete the package containment and generate significant package stacking compression strength from four two ply corners.

The corner post bliss is a modest improvement over the conventional four sided bliss. The corner post bliss has end panels with extra vertical scores to create diagonal corners between the end and side walls. The wrap has extended glue flanges that stretch over the corner void and secure to the main panel of the end creating a corner post. The exterior of the package remains rectangular. The inside is eight sided. The finished package generates more compression strength with twelve single ply corners. The wrap blank size is larger than the four sided bliss wrap.

The two ply wrapped corner eight sided bliss utilizes modified diagonal corners on both the end and wrap. When the package is assembled the outer wrap and ends are laminated into a continuous two ply corner that wraps from the package side on to its ends. Some advantages of the present modification, not limited to, are 1) eight laminated corners provide additional stacking strength and overall package stiffness 2) the wrap blank size is the same as a four sided bliss (lower cost than the corner post wrap) and 3) the wrap flanges extend across a larger portion of the end panel which increases end panel stiffness.

The eight Sided Tray/Bliss package combines three sheets of corrugated material very efficiently into the container (i.e., all the embodiments described hereinabove) that has significantly improved package stacking strength compared to a "typical" bliss package of similar size. The eight Sided Tray/Bliss also have significantly better end to end rigidity than a similar sized eight sided tray. The general characteristic of multi-sided container is:

1. The wrap & end pieces can be made from different materials. Typically the wrap is lighter weight with a focus on containment. Typically the end pieces are heavier materials focused toward stacking strength.
2. The container configuration is compatible with many industrial packaging applications, but is focused toward the food industry, especially the fresh meat and poultry industries. Fresh meat and poultry packaging requires an area on the end of the container for product labeling. This labeling is often in the form of a pressure sensitive label.

3. The package has eight two ply corners for stacking strength. The two ply corners also dramatically stiffen the end to end rigidity of the container. A typical eight sided tray generally has quite a bit of "flex" end to end and side to side.
4. The package can be made with integral top flaps or as an open top container with a separate cover.
5. If top flaps are used, the flaps can be glued with a side sealing format, or, they can be secured with a hand hole lock flap. It should be noted that the good end to end rigidity is critical to a glued side seal operation.
6. The "bottom outside end sealing flap" can be large enough to provide an end panel label area.
7. The bottom panel is a full width & length smooth panel. No flaps to come open and dump contents.
8. The Tray/Bliss End "vertical side walls" are adhered to the "wrap side walls" to greatly stiffen and strengthen the "wrap side walls".

While the invention has been described with reference to preferred embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A multi-sided container comprising a bottom wall, at least one top wall, opposite side walls, opposite end walls, a longitudinal axis, a transverse axis and a plurality of dual triangulated diagonal corner walls wherein at least one of the plurality of dual triangulated diagonal corner walls being defined by two gusset panels foldably joined to two partial sidewall panels and the respective opposite end wall to form four corners within each corner of the container wherein each of the plurality of the dual triangulated diagonal corner walls comprising an inner diagonal corner panel and an outer diagonal corner panel, one of the inner and outer diagonal corner panels extending at an angle of less than 45° with respect to the respective opposite adjacent end wall, and the other of said inner and outer diagonal corner panels extending at an angle of less than 45° with respect to the respective opposite adjacent side wall, whereby said one of the inner and outer diagonal corner panels has a major thrust vector in a direction parallel to the transverse axis of the container and said other of said inner and outer diagonal corner panels has a major thrust vector in a direction parallel to the longitudinal axis of the container, the inner and outer diagonal corner panels providing resistance to both lateral and longitudinal deflection of the container.

2. The multi-sided container of claim 1 wherein the partial side walls and the opposite end walls are joined by the two gusset panels or diagonal corner panels.

3. The multi-sided container of claim 1 wherein the inner diagonal corner panel extends at an angle of less than 45° with respect to the respective opposite adjacent side wall of the container, and the outer diagonal corner panel extends at an angle of less than 45° with respect to the respective opposite adjacent end wall of the container.

4. The multi-sided container of claim 1 wherein the inner diagonal corner panel subtends an angle of about 35° with respect to the adjacent side wall; and the outer diagonal corner panel subtends an angle of about 30° with respect to the respective opposite adjacent end wall.

5. The multi-sided container of claim 1 wherein the inner diagonal corner panel subtends an angle of about 30° with respect to the respective opposite adjacent side wall; and the outer diagonal corner panel subtends an angle of about 30° with respect to the respective opposite adjacent end wall.

6. The multi-sided container of claim 1 wherein the inner and outer diagonal corner panels are foldably joined to opposite side edges of respective associated said end walls.

7. The multi-sided container of claim 1 wherein the inner and outer diagonal corner panels are sized differently.

8. The multi-sided container of claim 1 wherein the respective opposite end walls being made of corrugated paperboard comprising a fluted medium having flutes thereof oriented vertically with upwardly open ends; and the top wall extends over the end walls and covers the upwardly open ends of the flutes to prevent entry of moisture into the fluted medium.

9. The multi-sided container of claim 1 wherein the bottom wall, the side walls, and top wall are integrally attached to one another to define a wrapper and the respective end walls panels, respective diagonal corner panels, and respective partial side wall panels are integrally attached to one another to define respective end pieces.

10. The multi-sided container of claim 9 wherein the wrapper and the respective end pieces are integrally attached to one another.

11. The multi-sided container of claim 1 wherein the two partial sidewall panels are sized differently.

12. A multi-sided container having a bottom wall, opposite side walls, opposite end walls, a longitudinal axis, and a transverse axis, the container comprising:

diagonal corners connecting adjacent ends of said side walls and said end walls, said diagonal corners each comprising an inner diagonal corner panel and an outer diagonal corner panel, one of the inner and outer diagonal corner panels extending at an angle of less than 45° with respect to the respective opposite adjacent end wall, and the other of said inner and outer diagonal corner panels extending at an angle of less than 45° with respect to the respective opposite adjacent side wall, whereby said one of the inner and outer diagonal corner panels has a major thrust vector in a direction parallel to the transverse axis of the container and said other of said inner and outer diagonal corner panels has a major thrust vector in a direction parallel to the longitudinal axis of the container, the inner and outer diagonal corner panels providing resistance to both lateral and longitudinal deflection of the container.

13. The multi-sided container of claim 12 wherein the inner diagonal corner panel and the outer diagonal corner panel form four corners within each corner of the container.

14. The multi-sided container of claim 12 wherein the inner and outer diagonal corner panels are sized differently such that the inner and outer diagonal corner panels have different widths.

15. The multi-sided container of claim 14 wherein the width of inner diagonal corner panel is larger than the width of the diagonal corner panel.

16. A blank for making a multi-sided container having a bottom wall, at least one top wall, opposite side walls, opposite end walls, a longitudinal axis and a plurality of dual triangulated diagonal corner walls, the blank comprising:

a unitary piece of generally rectangularly shaped material having a plurality of first, approximately parallel, spaced apart fold lines delimiting a bottom wall panel, side wall panels, and top wall panels, a plurality of approximately parallel spaced apart second fold lines extending perpendicular to the first fold lines and defining a transversal edge of the bottom panel, side wall panels, and top wall panels, a plurality of reinforcement flaps and end flaps joined to the opposite transversal edges of the side wall panels, two flaps each of which being joined to the respective opposite transversal edges of the bottom wall panel, and a pair of end piece panels each of which foldably joined to the respective transversal edges of the bottom wall panel, side wall panels, and top wall panels wherein each of the end piece panels having a plurality of third, parallel, spaced apart fold lines delimiting end wall panels, dual triangulated diagonal corner panels, and partial side wall panels and wherein the dual triangulated diagonal corner panels are defined by inner and outer diagonal corner panels having different widths.

* * * * *